US011732556B2

(12) United States Patent
Eitschberger

(10) Patent No.: US 11,732,556 B2
(45) Date of Patent: Aug. 22, 2023

(54) ORIENTING PERFORATION GUN ASSEMBLY

(71) Applicant: DynaEnergetics Europe GmbH, Troisdorf (DE)

(72) Inventor: Christian Eitschberger, Munich (DE)

(73) Assignee: DYNAENERGETICS EUROPE GMBH

( * ) Notice: Subject to any disclaimer, the term of this patent is extended or adjusted under 35 U.S.C. 154(b) by 0 days.

(21) Appl. No.: 18/166,310

(22) Filed: Feb. 8, 2023

(65) Prior Publication Data

US 2023/0203923 A1 Jun. 29, 2023

Related U.S. Application Data

(63) Continuation of application No. PCT/EP2022/055191, filed on Mar. 1, 2022, which is (Continued)

(51) Int. Cl.
*E21B 43/119* (2006.01)
*E21B 43/117* (2006.01)
*E21B 43/116* (2006.01)

(52) U.S. Cl.
CPC ..... *E21B 43/119* (2013.01); *E21B 43/116* (2013.01); *E21B 43/117* (2013.01); *E21B 43/1193* (2020.05)

(58) Field of Classification Search
CPC ..... E21B 43/119; E21B 43/1193; E21B 43/1185; E21B 43/117; E21B 43/116
See application file for complete search history.

(56) References Cited

U.S. PATENT DOCUMENTS 2,216,359 A 10/1940 Spencer
2,358,466 A 9/1944 Miller
(Continued)

FOREIGN PATENT DOCUMENTS

AU 2010217183 B2 6/2016
CA 2821506 A1 1/2015
(Continued)

OTHER PUBLICATIONS

Core Lab, ZERO180 Gun System Assembly and Arming Procedures MAN-Z180-000 (R10); Copyright 2015—2021 Owen Oil Tools; dated May 7, 2021; 38 pages.
(Continued)

*Primary Examiner* — Yong-Suk (Philip) Ro
(74) *Attorney, Agent, or Firm* — Womble Bond Dickinson (US) LLP

(57) ABSTRACT

According to some embodiments, a system is presented for orienting one or more shaped charge within a well. For example, a perforating gun assembly may include a housing and an orienting internal assembly configured to be disposed within a longitudinal bore of the housing. In some embodiments, the orienting internal assembly may include at least one shaped charge holder or charge tube, a rotation support system, and a detonator holder and/or a detonator. The rotation support system may be configured so that the detonator holder and/or detonator rotate together as a whole with the at least one shaped charge holder or charge tube. In some embodiments, the rotation support system may include at least one bearing assembly, a plurality of rollers, or combinations thereof. Some embodiments may be configured for gravitational orientation.

20 Claims, 45 Drawing Sheets

Related U.S. Application Data a continuation-in-part of application No. 17/677,478, filed on Feb. 22, 2022.

(60) Provisional application No. 63/309,674, filed on Feb. 14, 2022, provisional application No. 63/276,103, filed on Nov. 5, 2021, provisional application No. 63/271,846, filed on Oct. 26, 2021, provisional application No. 63/166,720, filed on Mar. 26, 2021, provisional application No. 63/155,902, filed on Mar. 3, 2021.

(56) References Cited

U.S. PATENT DOCUMENTS 2,418,486 A 4/1947 Smylie
2,598,651 A 5/1952 Spencer
2,742,857 A 4/1956 Turechek
2,821,136 A 1/1958 Castel
2,889,775 A 6/1959 Owen
3,170,400 A 2/1965 Nelson
3,246,707 A 4/1966 Bell
3,374,735 A 3/1968 Moore
3,414,071 A 12/1968 Alberts
3,504,723 A 4/1970 Cushman et al.
3,859,921 A 1/1975 Stephenson
4,007,790 A 2/1977 Henning
4,007,796 A 2/1977 Boop
4,058,061 A 11/1977 Mansur, Jr. et al.
4,140,188 A 2/1979 Vann
4,182,216 A 1/1980 DeCaro
4,266,613 A 5/1981 Boop
4,290,486 A 9/1981 Regalbuto
4,491,185 A 1/1985 McClure
4,496,008 A 1/1985 Pottier et al.
4,523,650 A 6/1985 Sehnert et al.
4,574,892 A 3/1986 Grigar et al.
4,598,775 A 7/1986 Vann et al.
4,621,396 A 11/1986 Walker et al.
4,637,478 A 1/1987 George
4,650,009 A 3/1987 McClure et al.
4,657,089 A 4/1987 Stout
4,747,201 A 5/1988 Donovan et al.
4,753,170 A 6/1988 Regalbuto et al.
4,776,393 A 10/1988 Forehand et al.
4,790,383 A 12/1988 Savage et al.
4,800,815 A 1/1989 Appledorn et al.
4,889,183 A 12/1989 Sommers et al.
5,027,708 A 7/1991 Gonzalez et al.
5,040,619 A 8/1991 Jordan et al.
5,052,489 A 10/1991 Carisella et al.
5,060,573 A 10/1991 Montgomery et al.
5,088,413 A 2/1992 Huber
5,105,742 A 4/1992 Sumner
5,159,145 A 10/1992 Carisella et al.
5,159,146 A 10/1992 Carisella et al.
5,211,714 A 5/1993 Jordan et al.
5,322,019 A 6/1994 Hyland
5,392,860 A 2/1995 Ross
5,436,791 A 7/1995 Turano et al.
5,603,384 A 2/1997 Bethel et al.
5,703,319 A 12/1997 Fritz et al.
5,775,426 A 7/1998 Snider et al.
5,816,343 A 10/1998 Markel et al.
5,964,294 A 10/1999 Edwards et al.
5,992,289 A 11/1999 George et al.
6,006,833 A 12/1999 Burleson et al.
6,012,525 A 1/2000 Burleson et al.
6,112,666 A 9/2000 Murray et al.
6,257,792 B1 7/2001 Read, Jr.
6,263,283 B1 7/2001 Snider et al.
6,269,875 B1 8/2001 Harrison, III et al.
6,272,782 B1 8/2001 Dittrich et al.
6,283,214 B1 9/2001 Guinot et al.
6,295,912 B1 10/2001 Burleson et al.
6,297,447 B1 10/2001 Burnett et al.
6,298,915 B1 10/2001 George
6,305,287 B1 10/2001 Capers et al.
6,315,461 B1 11/2001 Cairns
6,333,699 B1 12/2001 Zierolf
6,354,374 B1 3/2002 Edwards et al.
6,418,853 B1 7/2002 Duguet et al.
6,595,290 B2 7/2003 George et al.
6,651,747 B2 11/2003 Chen et al.
6,679,327 B2 1/2004 Sloan et al.
6,739,265 B1 5/2004 Badger et al.
6,742,602 B2 6/2004 Trotechaud
6,752,083 B1 6/2004 Lerche et al.
6,837,310 B2 1/2005 Martin
6,843,317 B2 1/2005 Mackenzie
6,942,033 B2 9/2005 Brooks et al.
7,000,699 B2 2/2006 Yang et al.
7,107,908 B2 9/2006 Forman et al.
7,114,564 B2 10/2006 Parrott et al.
7,193,527 B2 3/2007 Hall
7,278,491 B2 10/2007 Scott
7,364,451 B2 4/2008 Ring et al.
7,568,429 B2 8/2009 Hummel et al.
7,762,172 B2 7/2010 Li et al.
7,778,006 B2 8/2010 Stewart et al.
7,810,430 B2 10/2010 Chan et al.
7,886,842 B2 2/2011 Howard et al.
7,901,247 B2 3/2011 Ring
7,908,970 B1 3/2011 Jakaboski et al.
7,929,270 B2 4/2011 Hummel et al.
8,061,425 B2 11/2011 Hales et al.
8,066,083 B2 11/2011 Hales et al.
8,069,789 B2 12/2011 Hummel et al.
8,157,022 B2 4/2012 Bertoja et al.
8,181,718 B2 * 5/2012 Burleson ..... E21B 43/119 175/4.51
8,182,212 B2 5/2012 Parcell
8,186,259 B2 5/2012 Burleson et al.
8,256,337 B2 9/2012 Hill
8,395,878 B2 3/2013 Stewart et al.
8,439,114 B2 5/2013 Parrott et al.
8,443,886 B2 5/2013 Torres et al.
8,451,137 B2 5/2013 Bonavides et al.
8,661,978 B2 3/2014 Backhus et al.
8,684,083 B2 4/2014 Torres et al.
8,695,506 B2 4/2014 Lanclos
8,851,160 B2 * 10/2014 Stolboushkin .... E21B 43/11855 166/55
8,863,665 B2 10/2014 DeVries et al.
8,875,787 B2 11/2014 Tassaroli
8,881,816 B2 11/2014 Glenn et al.
9,080,433 B2 7/2015 Lanclos et al.
9,115,572 B1 8/2015 Hardesty et al.
9,181,790 B2 11/2015 Mace et al.
9,194,219 B1 11/2015 Hardesty et al.
9,284,819 B2 3/2016 Tolman et al.
9,382,783 B2 7/2016 Langford et al.
9,382,784 B1 7/2016 Hardesty et al.
9,441,438 B2 9/2016 Allison et al.
9,476,289 B2 10/2016 Wells
9,494,021 B2 11/2016 Parks et al.
9,581,422 B2 2/2017 Preiss et al.
9,598,942 B2 3/2017 Wells et al.
9,605,937 B2 3/2017 Eitschberger et al.
9,677,363 B2 6/2017 Schacherer et al.
9,689,223 B2 6/2017 Schacherer et al.
9,702,680 B2 7/2017 Parks et al.
9,784,549 B2 10/2017 Eitschberger
9,845,666 B2 12/2017 Hardesty et al.
9,903,185 B2 2/2018 Ursi et al.
9,903,192 B2 2/2018 Entchev et al.
10,060,234 B2 8/2018 Robey et al.
10,066,921 B2 9/2018 Eitschberger
10,077,641 B2 9/2018 Rogman et al.
10,138,713 B2 11/2018 Tolman et al.
10,151,180 B2 12/2018 Robey et al.
10,188,990 B2 1/2019 Burmeister et al.
10,190,398 B2 1/2019 Soodman et al.
10,273,788 B2 4/2019 Bradley et al.

(56) References Cited

U.S. PATENT DOCUMENTS 10,309,199 B2 6/2019 Eitschberger
10,352,136 B2 7/2019 Goyeneche
10,429,161 B2 10/2019 Parks et al.
10,458,213 B1 10/2019 Eitschberger et al.
10,472,901 B2 11/2019 Engel et al.
10,472,938 B2 11/2019 Parks et al.
10,507,433 B2 12/2019 Eitschberger et al.
10,578,235 B2 3/2020 Graham et al.
10,641,068 B2 5/2020 Hardesty et al.
10,689,955 B1 6/2020 Mauldin et al.
10,731,443 B2 8/2020 Kaenel et al.
10,844,696 B2 11/2020 Eitschberger et al.
10,844,697 B2 11/2020 Preiss et al.
D908,754 S 1/2021 Eitschberger
10,900,334 B2 1/2021 Knight et al.
10,954,761 B2 3/2021 Kaenel et al.
10,982,513 B2 * 4/2021 Gupta ..... E21B 43/119
D920,402 S 5/2021 Eitschberger
11,078,762 B2 * 8/2021 Mauldin ..... E21B 43/1185
11,125,056 B2 9/2021 Parks et al.
11,168,546 B2 11/2021 Melhus et al.
11,215,041 B2 1/2022 Knight et al.
11,339,614 B2 5/2022 Mulhern et al.
11,339,632 B2 5/2022 Eitschberger et al.
11,492,854 B2 11/2022 Langford et al.
11,492,878 B2 11/2022 Sokolove et al.
11,499,401 B2 * 11/2022 Eitschberger ..... E21B 43/117
11,542,792 B2 1/2023 Preiss
2002/0020320 A1 2/2002 Lebaudy et al.
2002/0062991 A1 5/2002 Farrant et al.
2002/0185275 A1 12/2002 Yang et al.
2003/0000411 A1 1/2003 Cernocky et al.
2003/0001753 A1 1/2003 Cernocky et al.
2003/0098158 A1 5/2003 George et al.
2005/0139352 A1 6/2005 Mauldin
2005/0178282 A1 8/2005 Brooks et al.
2005/0186823 A1 8/2005 Ring et al.
2005/0194146 A1 9/2005 Barker et al.
2005/0229805 A1 10/2005 Myers, Jr. et al.
2007/0084336 A1 4/2007 Neves
2007/0119327 A1 5/2007 Myers et al.
2007/0125540 A1 6/2007 Gerez et al.
2007/0158071 A1 7/2007 Mooney, Jr. et al.
2008/0047456 A1 2/2008 Li et al.
2008/0110612 A1 5/2008 Prinz et al.
2008/0134922 A1 6/2008 Grattan et al.
2008/0149338 A1 6/2008 Goodman et al.
2008/0173204 A1 7/2008 Anderson et al.
2008/0264639 A1 10/2008 Parrott et al.
2009/0050322 A1 2/2009 Hill et al.
2009/0151588 A1 6/2009 Burleson et al.
2009/0272529 A1 11/2009 Crawford
2010/0000789 A1 1/2010 Barton et al.
2010/0089643 A1 4/2010 Vidal
2010/0163224 A1 7/2010 Strickland
2010/0230104 A1 9/2010 Nölke et al.
2010/0230163 A1 9/2010 Hales et al.
2010/0300750 A1 12/2010 Hales et al.
2011/0024116 A1 2/2011 McCann et al.
2011/0100627 A1 5/2011 Hales et al.
2012/0085538 A1 4/2012 Guerrero et al.
2012/0199031 A1 8/2012 Landos
2012/0199352 A1 8/2012 Landos et al.
2012/0241169 A1 9/2012 Hales et al.
2012/0242135 A1 9/2012 Thomson et al.
2012/0247769 A1 * 10/2012 Schacherer ..... E21B 43/117 166/63
2012/0247771 A1 10/2012 Black et al.
2012/0298361 A1 11/2012 Sampson
2013/0008639 A1 1/2013 Tassaroli et al.
2013/0062055 A1 3/2013 Tolman et al.
2013/0118342 A1 5/2013 Tassaroli
2013/0199843 A1 8/2013 Ross
2013/0220614 A1 8/2013 Torres et al.
2013/0248174 A1 9/2013 Dale et al.
2014/0131035 A1 5/2014 Entchev et al.
2015/0176386 A1 6/2015 Castillo et al.
2015/0226044 A1 8/2015 Ursi et al.
2015/0330192 A1 11/2015 Rogman et al.
2016/0040520 A1 2/2016 Tolman et al.
2016/0061572 A1 3/2016 Eitschberger et al.
2016/0069163 A1 3/2016 Tolman et al.
2016/0084048 A1 3/2016 Harrigan et al.
2016/0084075 A1 3/2016 Ingraham et al.
2016/0153271 A1 6/2016 Mace et al.
2016/0168961 A1 6/2016 Parks et al.
2016/0208587 A1 7/2016 Hardesty et al.
2016/0290084 A1 10/2016 LaGrange et al.
2016/0356132 A1 12/2016 Burmeister et al.
2017/0030693 A1 2/2017 Preiss et al.
2017/0052011 A1 * 2/2017 Parks ..... E21B 43/11855
2017/0074078 A1 3/2017 Eitschberger
2017/0145798 A1 5/2017 Robey et al.
2017/0211363 A1 7/2017 Bradley et al.
2017/0241244 A1 8/2017 Barker et al.
2017/0268317 A1 9/2017 Kaenel et al.
2017/0268860 A1 9/2017 Eitschberger
2017/0276465 A1 9/2017 Parks et al.
2017/0314372 A1 11/2017 Tolman et al.
2018/0030334 A1 2/2018 Collier et al.
2018/0135398 A1 5/2018 Entchev et al.
2018/0202790 A1 7/2018 Parks et al.
2018/0209251 A1 7/2018 Robey et al.
2018/0274342 A1 9/2018 Sites
2018/0299239 A1 10/2018 Eitschberger et al.
2018/0306010 A1 10/2018 Von Kaenel et al.
2018/0318770 A1 11/2018 Eitschberger et al.
2019/0040722 A1 2/2019 Yang et al.
2019/0048693 A1 2/2019 Henke et al.
2019/0049225 A1 2/2019 Eitschberger
2019/0186241 A1 6/2019 Yang et al.
2019/0195054 A1 6/2019 Bradley et al.
2019/0211655 A1 7/2019 Bradley et al.
2019/0264548 A1 8/2019 Zhao et al.
2019/0284889 A1 9/2019 LaGrange et al.
2019/0292887 A1 9/2019 Austin, II et al.
2019/0316449 A1 10/2019 Schultz et al.
2019/0366272 A1 12/2019 Eitschberger et al.
2020/0032626 A1 1/2020 Parks et al.
2020/0157924 A1 * 5/2020 Melhus ..... E21B 43/119
2020/0199983 A1 6/2020 Preiss et al.
2020/0284126 A1 9/2020 Mauldin et al.
2020/0332630 A1 10/2020 Davis et al.
2020/0399995 A1 12/2020 Preiss et al.
2021/0172298 A1 * 6/2021 Knight ..... E21B 43/117
2021/0238966 A1 8/2021 Preiss et al.
2021/0277752 A1 9/2021 Eitschberger
2021/0277753 A1 * 9/2021 Ursi ..... E21B 17/043
2021/0301599 A1 9/2021 Mulhern et al.
2021/0317728 A1 10/2021 Preiss et al.
2022/0074289 A1 3/2022 Cardenas et al.
2022/0170727 A1 6/2022 Eitschberger
2022/0243567 A1 8/2022 Eitschberger et al.
2022/0258103 A1 8/2022 Eitschberger et al.
2022/0282578 A1 9/2022 Eitschberger
2022/0307330 A1 9/2022 Eitschberger et al.
2022/0372851 A1 11/2022 Preiss et al.
2023/0016759 A1 1/2023 Eitschberger et al.
2023/0017269 A1 1/2023 Eitschberger et al.
2023/0023338 A1 1/2023 Eitschberger et al.

FOREIGN PATENT DOCUMENTS

CA 2824838 A1 2/2015
CA 2941648 A1 9/2015
CA 2821506 C 3/2020
CN 85107897 9/1986
CN 101397890 A 4/2009
CN 101178005 B 10/2010
CN 201620848 U 11/2010
CN 104278976 A 1/2015
CN 204200197 U 3/2015
CN 104989335 A 10/2015
CN 205805521 U 12/2016

(56) References Cited

FOREIGN PATENT DOCUMENTS

| | | | |
|---|---|---|---|
| CN | 104314529 | B | 1/2017 |
| CN | 205895214 | U | 1/2017 |
| CN | 207847603 | U | 9/2018 |
| CN | 209195375 | U | 8/2019 |
| CN | 211287646 | U | 8/2020 |
| CN | 212837726 | U | 3/2021 |
| CN | 214836284 | U | 11/2021 |
| EP | 132330 | B1 | 9/1988 |
| EP | 3245380 | B1 | 4/2020 |
| GB | 2395970 | A | 6/2004 |
| GB | 2548203 | A | 9/2017 |
| RU | 78521 | U1 | 11/2008 |
| RU | 2633904 | C1 | 10/2017 |
| WO | 0159401 | A1 | 8/2001 |
| WO | 2001059401 | A1 | 8/2001 |
| WO | 2008098047 | A2 | 8/2008 |
| WO | 2008098052 | A3 | 10/2008 |
| WO | 2009091422 | A2 | 7/2009 |
| WO | 2010104634 | A2 | 9/2010 |
| WO | 2010104634 | A3 | 11/2010 |
| WO | 2012006357 | A2 | 1/2012 |
| WO | 2012135101 | A2 | 10/2012 |
| WO | 2014179689 | A1 | 11/2014 |
| WO | 2015006869 | A1 | 1/2015 |
| WO | 2015134719 | A1 | 9/2015 |
| WO | 2018009223 | A1 | 1/2018 |
| WO | 2018067598 | A1 | 4/2018 |
| WO | 2018125180 | A1 | 7/2018 |
| WO | 2019009735 | A1 | 1/2019 |
| WO | 2019098991 | A1 | 5/2019 |
| WO | 2019148009 | A2 | 8/2019 |
| WO | 2020016644 | A1 | 1/2020 |
| WO | 2020112983 | A1 | 6/2020 |
| WO | 2020232242 | A1 | 11/2020 |
| WO | 2020249744 | A2 | 12/2020 |
| WO | 2021025716 | A1 | 2/2021 |
| WO | 2021116336 | A1 | 6/2021 |
| WO | 2021116338 | A1 | 6/2021 |
| WO | 2021122797 | A1 | 6/2021 |
| WO | 2021198193 | A1 | 10/2021 |
| WO | 2022122742 | A2 | 6/2022 |
| WO | 2022184654 | A1 | 9/2022 |
| WO | 2022184731 | A1 | 9/2022 |

OTHER PUBLICATIONS

Core Lab, ZERO180™ Gun SystemAssembly and Arming Procedures—MAN-Z180-000 (RO7), Dec. 4, 2019, 33 pgs., https://www.corelab.com/owen/CMS/docs/Manuals/gunsys/zero180/MAN-Z180-000.pdf.

Core Lab, ZERO180™ Gun SystemAssembly and Arming Procedures, 2015, 33 pgs., https://www.corelab.com/owen/CMS/docs/Manuals/gunsys/zero180/MAN-Z180-000.pdf.

Dynaenergetics Europe Gmbh; Patent Owner's Preliminary Response for PGR2020-00072; dated Oct. 23, 2020; 108 pages.

Dynaenergetics Gmbh & Co. Kg, Patent Owner's Response to Hunting Titan's Petition for Inter Parties Review—Case IPR2018-00600, filed Dec. 6, 2018, 73 pages.

European Patent Office; Rule 161 Communication for EP Application No. 21734751.7; dated Jan. 24, 2023; 3 pages.

Halliburton, Halliburton Velocity™ Aligned Gun SysteM, Economic, Compact, and Versatile System for Orienting Perforations in Horizontal Wells, 2022, 2 pgs., www.halliburton.com.

Halliburton; Wireline and Perforating Advances in Perforating; dated Nov. 2012; 12 pages.

International Searching Authority; International Preliminary Report on Patentability for PCT Appl. No. PCT/CA2014/050673; dated Jan. 19, 2016; 5 pages.

International Searching Authority; International Preliminary Report on Patentability for PCT/EP2021/066119; dated Dec. 13, 2022; 10 pages.

International Searching Authority; International Preliminary Report on Patentability of the International Searching Authority for PCT/EP2021/058182; dated Oct. 13, 2022; 10 pages.

International Searching Authority; International Preliminary Report on Patentability of the International Searching Authority for PCT/EP2020/066327; dated Dec. 21, 2021; 10 pages.

International Searching Authority; International Search Report and Written Opinion for PCT App. No. PCT/CA2014/050673; dated Oct. 9, 2014; 7 pages.

International Searching Authority; International Search Report and Written Opinion for PCT App. No. PCT/EP2019/069165; dated Oct. 22, 2019; 13 pages.

International Searching Authority; International Search Report and Written Opinion for PCT Application No. EP2020066327; dated Jan. 11, 2021; 17 pages.

International Searching Authority; International Search Report and Written Opinion of the International Searching Authority for PCT/EP2020/085624; dated Apr. 12, 2021; 11 pages.

International Searching Authority; International Search Report and Written Opinion of the International Searching Authority for PCT/EP2020/085622; dated Apr. 1, 2021; 10 pages.

International Searching Authority; International Search Report and Written Opinion of the International Searching Authority for PCT/EP2020/086496; dated Apr. 7, 2021; 10 pages.

International Searching Authority; International Search Report and Written Opinion of the International Searching Authority for PCT/EP2021/058182; dated Aug. 26, 2021; 16 pages.

International Searching Authority; International Search Report and Written Opinion of the International Searching Authority for PCT/EP2022/055014; dated Jul. 4, 2022; 17 pages.

International Searching Authority; International Search Report and Written Opinion of the International Searching Authority for PCT/EP2021/079019; dated Feb. 28, 2022; 14 pages.

Jet Research Center, Velocity™ Perforating System Plug and Play Guns for Pumpdown Operation, Ivarado, Texas, Jul. 2019, 8 pgs., https://www.jetresearch.com/content/dam/jrc/Documents/Brochures/jrc-velocity-perforating-system.pdf.

Nextier Completion Solutions Inc.; Defendant Nextier Completion Solutions Inc.'s First Amended Answer and Counterclaims to Plaintiffs' First Amended Complaint for Civil Action No. 6:20-CV-01201; dated Jun. 28, 2021; 17 pages.

Nextier Oilfield Solutions Inc; Petition for Inter Partes Review No. IPR2021-00082; dated Oct. 21, 2020; 111 pages.

Parrot, Robert; Declaration, PGR 2020-00080; dated Aug. 11, 2020; 400 pages.

Parrott, Robert A.; Declaration in Support of PGR20201-00089; dated Jun. 1, 2021; 353 pages.

Perforating Services Catalog 2008 part 1 of 2; Exhibit 1020 of PGR No. 2021-00089 dated 2008; 282 pages.

Perforating Services Catalog 2008 part 2 of 2; Exhibit 1020 of PGR No. 2021-00089; dated 2008; 239 pages.

Preiss Frank et al.; Lowering Total Cost of Operations Through Higher Perforating Efficiency while simultaneously enhancing safety; May 10, 2016; 26 pages.

Ratanasirigulchai, Wanchai; U.S. Appl. No. 60/351,252; dated Jan. 23, 2002; 11 pages.

Rodgers, John; Declaration for PGR No. 2021-00089; dated Sep. 16, 2021; 93 pages.

Rodgers, John; Declaration for PGR2020-00072; dated Oct. 23, 2020; 116 pages.

Rodgers, John; Declaration for PGR2020-00080; dated Nov. 18, 2020; 142 pages.

Rodgers, John; Declaration for PGR2021-00078; dated Aug. 19, 2021; 137 pages.

Schlumberger, Perforating Services Catalog, 2008, 521 pages.

SWM International, LLC; Exhibit B: DynaEnergetics' Infringement of U.S. Pat. No. 11,078,762 for Civil Action No. 6:21-cv-00804; dated Aug. 3, 2021; 22 pages.

SWM International, LLC; SWM International, LLC's Responsive Claim Construction Brief for Civil Action No. 6:21-cv-804-ADA; dated Apr. 11, 2022; 21 pages.

United States Patent and Trademark Office, Non-Final Office Action of U.S. Appl. No. 14/767,058, dated Jul. 15, 2016, 9 pages.

(56) References Cited

OTHER PUBLICATIONS

United States Patent Trial and Appeal Board; Decision Denying Institution of Post-Grant Review; PGR No. 2020-00072; dated Jan. 19, 2021; 38 pages.
United States Patent Trial and Appeal Board; Institution Decision for PGR 2020-00080; dated Feb. 12, 2021; 15 pages.
United States Patent Trial and Appeal Board; Record of Oral Hearing held Feb. 18, 2020 for IPR dated 2018-00600; dated Feb. 18, 2020; 27 pages.
Waters & Wang, The Impact of Geomechanics and Perforation on Hydraulic Fracture Initiation & Complexity in Horizontal Well Completions, Sep. 26-28, 2016, SPE-181684-MS, 36 pg.
Core Lab, ZERO180 Gun System Assembly and Arming Procedures—MAN-Z180-000 (R09), Jul. 9, 2020, 38 pages.
Dynaenergetics, DS NLine™ Oriented Perforating System, Precise Charge Alignment for Plug-and-Perf Operations, Jul. 18, 2019, 2 pgs., dynaenergetics.com.
Dynaenergetics, DS NLine™ System, Internal Frequently Asked Questions, Mar. 10, 2020, 4 pgs., dynaenergetics.com.
Dynaenergetics, DYNAselect Electronic Detonator 0015 TFSFDE RDX 1.4B, Product Information, Apr. 23, 2015, 1 pg.
Dynaenergetics, No Debris Gun System (NDG), Hamburg, Germany, Feb. 6, 2008, 26 pgs.
GR Energy Operating GP LLC, GR Energy Services Management, LP and GR Energy Services, LLC; Exhibit S U.S. Pat. No. 10,844,697 vs Harrigan '048; dated Aug. 30, 2021; 7 pages.
International Searching Authority; International Search Report and Written Opinion for International Application No. PCT/US2020/032879; dated Aug. 20, 2020; 9 pages.
International Searching Authority; International Search Report and Written Opinion of the International Searching Authority for PCT/EP2022/055191; dated May 20, 2022; 10 pages.
Promperforator LLC, Perforating Systems Design and Manufacturing, 2014, 36 pgs., http://www.promperforator.ru/upload/file/katalog_eng_2014.pdf.
Schlumberger, OrientXact, 2013 2 pgs., https://www.slb.com/-/media/files/pe/product-sheet/orientxact-ps.ashx.
Amit Govil, Selective Perforation: A Game Changer in Perforating Technology—Case Study, presented at the 2012 European and West African Perforating Symposium, Schlumberger, Nov. 7-9, 2012, 14 pgs.
Austin Powder Company; A-140 F & Block, Detonator & Block Assembly; Jan. 5, 2017; 2 pgs.; https://www.austinpowder.com/wp-content/uploads/2019/01/OilStar_A140Fbk-2.pdf.
Baker Hughes, Long Gun Deployment Systems IPS-12-28, 2012 International Perforating Symposium; Apr. 26-27, 2011; 11 pages.
Baker Hughes; SurePerf Rapid Select-Fire System Perforate production zones in a single run; 2012; 2 pages.
Dynaenergetics, DYNAselect Electronic Detonator 0015 SFDE RDX 1.4B, Product Information, Dec. 16, 2011, 1 pg.
Dynaenergetics, DYNAselect Electronic Detonator 0015 SFDE RDX 1.4S, Product Information, Dec. 16, 2011, 1 pg.
Dynaenergetics, DYNAselect System, information downloaded from website, Jul. 3, 2013, 2 pages, http://www.dynaenergetics.com/.
Dynaenergetics, Electronic Top Fire Detonator, Product Information Sheet, Jul. 30, 2013, 1 pg.
Dynaenergetics, Gun Assembly, Product Summary Sheet, May 7, 2004, 1 page.
Dynaenergetics, Selective Perforating Switch, information downloaded from website, Jul. 3, 2013, 2 pages, http://www.dynaenergetics.com/.
Dynaenergetics, Selective Perforating Switch, Product Information Sheet, May 27, 2011, 1 pg.
Eric H. Findlay, Jury Trial Demand in Civil Action No. 6:20-cv-00069-ADA, dated Apr. 22, 2020, 32 pages.
Gilliat et al.; New Select-Fire System: Improved Reliability and Safety in Select Fire Operations; 2012; 16 pgs.
Horizontal Wireline Services, Presentation of a completion method of shale demonstrated through an example of Marcellus Shale, Pennsylvania, USA, Presented at 2012 International Perforating Symposium (Apr. 26-28, 2012), 17 pages.
Hunting Titan Inc.; Petition for Post Grant Review of U.S. Pat. No. 10,429,161; dated Jun. 30, 2020; 109 pages.
Hunting Titan, Wireline Top Fire Detonator Systems, Nov. 24, 2014, 2 pgs, http://www.hunting-intl.com/titan/perforating-guns-and-setting-tools/wireline-top-fire-detonator-systems.
Jet Research Center Inc., JRC Catalog, 2008, 36 pgs., https://www.jetresearch.com/content/dam/jrc/Documents/Books_Catalogs/06_Dets.pdf.
Jet Research Center Inc., Red RF Safe Detonators Brochure, 2008, 2 pages, www.jetresearch.com.
Owen Oil Tools & Pacific Scientific; RF-Safe Green Det, Side Block for Side Initiation, Jul. 26, 2017, 2 pgs.
Owen Oil Tools, Recommended Practice for Oilfield Explosive Safety, Presented at 2011 MENAPS Middle East and North Africa Perforating Symposium, Nov. 28-30, 2011, 6 pages.
Schlumberger & Said Abubakr, Combining and Customizing Technologies for Perforating Horizontal Wells in Algeria, Presented at 2011 MENAPS, Nov. 28-30, 2011, 20 pages.
Smylie, Tom, New Safe and Secure Detonators for the Industry's consideration, presented at Explosives Safety & Security Conference, Marathon Oil Co, Houston; Feb. 23-24, 2005, 20 pages.
U.S. Patent Trial and Appeal Board, Institution of Inter Partes Review of U.S. Pat. No. 9,581,422, Case IPR2018-00600,Aug. 21, 2018, 9 pages.
United States District Court for the Southern District of Texas Houston Division, Case 4:19-cv-01611 for U.S. Pat. No. 9,581,422B2, Plainfiff's Complaint and Exhibits, dated May 2, 2019, 26 pgs.
United States District Court for the Southern District of Texas Houston Division, Case 4:19-cv-01611 for U.S. Pat. No. 9,581,422B2, Defendant's Answers, Counterclaims and Exhibits, dated May 28, 2019, 135 pgs.
United States District Court for the Southern District of Texas Houston Division, Case 4:19-cv-01611 for U.S. Pat. No. 9,581,422B2, Plaintiffs' Motion to Dismiss and Exhibits, dated Jun. 17, 2019, 63 pgs.
United States Patent and Trademark Office, Case IPR2018-00600 for U.S. Pat. No. 9,581,422 B2, Reply in Support of Patent Owner's Motion to Amend, dated Mar. 21, 2019, 15 pgs.
United States Patent and Trademark Office, Case IPR2018-00600 for U.S. Pat. No. 9,581,422 B2, Decision of Precedential Opinion Panel, Granting Patent Owner's Request for Hearing and Granting Patent Owner's motion to Amend, dated Jul. 6, 2020, 27 pgs.
United States Patent and Trademark Office, Case IPR2018-00600 for U.S. Pat. No. 9,581,422 B2, DynaEnergetics GmbH & Co. KG's Patent Owner Preliminary Response, dated May 22, 2018, 47 pgs.
United States Patent and Trademark Office, Case IPR2018-00600 for U.S. Pat. No. 9,581,422 B2, Order Granting Precedential Opinion Panel, Paper No. 46, dated Nov. 7, 2019, 4 pgs.
United States Patent and Trademark Office, Case IPR2018-00600 for U.S. Pat. No. 9,581,422 B2, Patent Owner's Motion to Amend, dated Dec. 6, 2018, 53 pgs.
United States Patent and Trademark Office, Case IPR2018-00600 for U.S. Pat. No. 9,581,422 B2, Patent Owners Opening Submission to Precedential Opinion Panel, dated Dec. 20, 2019, 21 pgs.
United States Patent and Trademark Office, Case IPR2018-00600 for U.S. Pat. No. 9,581,422 B2, Patent Owners Request for Hearing, dated Sep. 18, 2019, 19 pgs.
United States Patent and Trademark Office, Case IPR2018-00600 for U.S. Pat. No. 9,581,422 B2, Patent Owners Responsive Submission to Precedential Opinion Panel, dated Jan. 6, 2020, 16 pgs.
United States Patent and Trademark Office, Case IPR2018-00600 for U.S. Pat. No. 9,581,422 B2, Patent Owner's Sur-reply, dated Mar. 21, 2019, 28 pgs.
United States Patent and Trademark Office, Case IPR2018-00600 for U.S. Pat. No. 9,581,422 B2, Petitioner's Additional Briefing to the Precedential Opinion Panel, dated Dec. 20, 2019, 23 pgs.
United States Patent and Trademark Office, Case IPR2018-00600 for U.S. Pat. No. 9,581,422 B2, Petitioner's Opposition to Patent Owner's Motion to Amend, dated Mar. 7, 2019, 30 pgs.

(56) References Cited

OTHER PUBLICATIONS

United States Patent and Trademark Office, Case IPR2018-00600 for U.S. Pat. No. 9,581,422 B2, Petitioner's Reply Briefing to the Precedential Opinion Panel, dated Jan. 6, 2020, 17 pgs.
United States Patent and Trademark Office, Case IPR2018-00600 for U.S. Pat. No. 9,581,422 B2, Petitioner's Reply in Inter Partes Review of U.S. Pat No. 9,581,422, dated Mar. 7, 2019, 44 pgs.
United States Patent and Trademark Office, Final Written Decision of Case IPR2018-00600 for U.S. Pat. No. 9,581,422 B2, Paper No. 42, dated Aug. 20, 2019, 31 pgs.
United States Patent and Trial Appeal Board; Final Written Decision on IPR2018-00600; dated Aug. 20, 2019; 31 pages.

* cited by examiner

ORIENTING PERFORATION GUN ASSEMBLY

CROSS-REFERENCE TO RELATED APPLICATIONS

This application is a continuation of and claims priority to Patent Cooperation Treaty (PCT) Application No. PCT/EP2022/055191 filed Mar. 1, 2022. Patent Cooperation Treaty (PCT) Application No. PCT/EP2022/055191 claims the benefit of U.S. Provisional Patent Application No. 63/309,674 filed Feb. 14, 2022. Patent Cooperation Treaty (PCT) Application No. PCT/EP2022/055191 claims the benefit of U.S. Provisional Patent Application No. 63/271,846 filed Oct. 26, 2021. Patent Cooperation Treaty (PCT) Application No. PCT/EP2022/055191 claims the benefit of U.S. Provisional Patent Application No. 63/276,103 filed Nov. 5, 2021. Patent Cooperation Treaty (PCT) Application No. PCT/EP2022/055191 claims the benefit of U.S. Provisional Patent Application No. 63/166,720 filed Mar. 26, 2021. Patent Cooperation Treaty (PCT) Application No. PCT/EP2022/055191 is a continuation-in-part of and claims priority to U.S. patent application Ser. No. 17/677,478 filed Feb. 22, 2022, which claims the benefit of U.S. Provisional Patent Application No. 63/155,902 filed Mar. 3, 2021. This application claims priority benefit to all of the applications listed above. The entire contents of each of the applications listed above are incorporated herein by reference.

BACKGROUND OF THE DISCLOSURE

Hydrocarbons, such as fossil fuels (e.g. oil) and natural gas, are extracted from underground wellbores extending deeply below the surface using complex machinery and explosive devices. Once the wellbore is established by placement of casing pipes after drilling and cementing the casing pipe in place, a perforating gun assembly, or train or string of multiple perforating gun assemblies, are lowered into the wellbore, and positioned adjacent one or more hydrocarbon reservoirs in underground formations.

Assembly of a perforating gun may require assembly of multiple parts. Such parts typically include a housing or outer gun barrel containing or connected to perforating gun internal components such as: an electrical wire for relaying an electrical control signal such as a detonation signal from the surface to electrical components of the perforating gun; an electrical, mechanical, and/or explosive initiator such as a percussion initiator, an igniter, and/or a detonator; a detonating cord; one or more explosive and/or ballistic charges which are held in an inner tube, strip, or other carrying device; and other known components including, for example, a booster, a sealing element, a positioning and/or retaining structure, a circuit board, and the like. The internal components may require assembly including connecting electrical components within the housing and confirming and maintaining the connections and relationships between internal components. The assembly procedure may be difficult within the relatively small free space within the housing. Typical connections may include connecting the electrical relay wire to the detonator or the circuit board, coupling the detonator and the detonating cord and/or the booster, and positioning the detonating cord in a retainer at an initiation point of each charge. In addition, typical perforating guns may not provide components that are generic and therefore available for use in different perforating guns with, e.g., different gun housing inner diameters.

The housing may also be connected at each end to a respective adjacent wellbore tool or other component of the tool string such as a firing head, tandem seal adapter or other sub assembly, or the like. Connecting the housing to the adjacent component(s) typically includes screwing the housing and the adjacent component(s) together via complementary threaded portions of the housing and the adjacent components and forming a connection and seal therebetween.

Known perforating guns may further include explosive charges, typically shaped, hollow, or projectile charges, which are initiated, e.g., by the detonating cord, to perforate holes in the casing and to blast through the formation so that the hydrocarbons can flow through the casing. In other operations, the charges may be used for penetrating just the casing, e.g., during abandonment operations that require pumping concrete into the space between the wellbore and the wellbore casing, destroying connections between components, severing a component, and the like. The exemplary embodiments in this disclosure may be applicable to any operation consistent with this disclosure. For purposes of this disclosure, the term "charge" and the phrase "shaped charge" may be used interchangeably and without limitation to a particular type of explosive, charge, or wellbore operation, unless expressly indicated.

The perforating guns may be utilized in initial fracturing process or in a refracturing process. Refracturing serves to revive a previously abandoned well in order to optimize the oil and gas reserves that can be obtained from the well. In refracturing processes, a smaller diameter casing is installed and cemented in the previously perforated and accessed well. The perforating guns must fit within the interior diameter of the smaller diameter casing, and the shaped charges installed in the perforating guns must also perforate through double layers of casing and cement combinations in order to access oil and gas reserves.

The explosive charges may be arranged and secured within the housing by the carrying device which may be, e.g., a typical hollow charge carrier or other holding device that receives and/or engages the shaped charge and maintains an orientation thereof. Typically, the charges may be arranged in different phasing, such as 60°, 90°, 120°, 180°, 270°, etc. along the length of the charge carrier, so as to form, e.g., a helical pattern along the length of the charge carrier. Charge phasing generally refers to the radial distribution of charges throughout the perforating gun, or, in other words, the angular offset between respective radii along which successive charges in a charge string extend in a direction away from an axis of the charge string. An explosive end of each charge points outwardly along a corresponding radius to fire an explosive jet through the gun housing and wellbore casing, and/or into the surrounding rock formation. Phasing the charges therefore generates explosive jets in a number of different directions and patterns that may be variously desirable for particular applications. On the other hand, it may be beneficial to have each charge fire in the same radial direction. A charge string in which each charge fires in the same radial direction would have zero-degree (0°) phasing. Still further, a gravitationally oriented shaped charge may be beneficial in certain applications. Ensuring the orientation of the shaped charges before firing may also be a critical step for ensuring accurate and effective perforating and therefore eliminating the need for multiple perforating operations for a single section of the wellbore.

Once the perforating gun(s) is properly positioned, a surface signal actuates an ignition of a fuse or detonator, which in turn initiates the detonating cord, which detonates the explosive charges to penetrate/perforate the housing and wellbore casing, and/or the surrounding rock formation to allow formation fluids to flow through the perforations thus formed and into a production string.

Typical perforating guns may suffer from shortcomings with respect to, for example, simplifying the assembly procedures for components, providing generic components that may be used in various gun housings having different inner diameters, and achieving the potential benefits of adaptable charge phasing including accurate orientation of shaped charges once the perforating gun is downhole (i.e., deployed within the wellbore). For example, various components of the perforating gun may require assembly and wiring on site and certain components must be specific to the perforating gun housing with the particular inner diameter that is being assembled. Metal charge tubes and other charge carriers that are not easily reconfigurable are not easily adaptable for use with different numbers of charges in different phasing and/or may not be capable of gravitational orientation. The number and phasing of charges in such rigid carriers may be limited by the number and orientation of charge holes/receivers in the particular charge carrier. Machining different charge carriers for every possible desired arrangement and number of charges in the perforating gun is not practically desirable.

In addition, a charge carrier that provides a very high charge phasing (i.e., a relatively severe angle between successive charges in the charge carrier) requires that a detonating cord make relatively drastic bends, especially for charges arranged with a relatively short distance between them, as it is routed between the initiating end of successive shaped charges. The detonating cord must be precisely positioned on the initiating end, above an initiation point, of the shaped charge to ensure that the detonating cord initiates detonation of the shaped charge. The detonating cord is retained at the initiation point of the shaped charge by a variety of known detonating cord retaining components. Typically, the forces and stresses on the detonating cord, especially at the detonating cord retaining components, increases as the phasing increases and the distance decreases between successive charges. The forces and stresses may damage the detonating cord and/or cause the detonating cord to become misaligned with the initiation point either to a side of the initiation point or in a direction away from the initiation point in which the detonating cord is pulling away from the retaining component.

Accordingly, a modular perforating gun platform system and corresponding perforating gun that may address one or more of the above shortcomings would be beneficial.

BRIEF DESCRIPTION OF THE EXEMPLARY EMBODIMENTS

According to one aspect, the disclosure relates to an orienting internal assembly. For example, the orienting internal assembly may include at least one shaped charge holder, at least one bearing assembly, a detonator holder and/or detonator (e.g. at least one of a detonator holder and a detonator), and an eccentric weight. The at least one shaped charge holder and the detonator holder and/or detonator may be configured to rotate as a whole.

According to another aspect, the disclosure relates to a detonator holder, for example for use with an orienting internal assembly in a perforating gun assembly. The detonator holder may include a detonator seat opening configured to receive a detonator, and an outer surface configured to fixedly attach to a rotatable inner bearing ring of a bearing assembly. The detonator holder may be configured to rotate as a whole with the inner bearing ring of the bearing assembly.

According to yet another aspect, the disclosure relates to an orienting internal assembly. In some embodiments, the orienting internal assembly may include a charge tube configured to hold and direct one or more shaped charges outward, at least one bearing assembly, and a detonator holder and/or a detonator. The charge tube and the detonator holder/detonator may be configured to rotate as a whole.

According to still another embodiment, the disclosure relates to an orienting internal assembly, which may have a charge tube configured to hold and direct one or more shaped charges outward; and a detonator holder and/or a detonator. The charge tube and the detonator holder and/or detonator may be configured to rotate as a whole within a longitudinal bore of a housing.

According to yet another embodiment, the disclosure relates to an orienting internal assembly having at least one shaped charge and a detonator holder and/or detonator. The at least one shaped charge and the detonator holder and/or detonator may be configured to rotate as a whole within a housing (e.g. within a longitudinal bore of the housing).

According to still another embodiment, the disclosure relates to an orienting internal assembly, having at least one shaped charge holder, a rotation support system, and a detonator holder and/or a detonator. The rotation support system may be configured so that the at least one shaped charge holder and the detonator holder and/or detonator rotate together as a whole within a longitudinal bore of a housing. In some embodiments, the rotation support system may include at least one bearing assembly, a plurality of rollers, or combinations thereof.

According to yet another embodiment, the disclosure relates to an orienting internal assembly, having at least one charge tube configured to retain at least one shaped charge, a rotation support system, and a detonator holder and/or a detonator. The rotation support system may be configured so that the charge tube and the detonator holder and/or detonator rotate together as a whole within a longitudinal bore of a housing. The charge tube may be configured to orient the at least one shaped charge outward (e.g. so that the perforating jet of the shaped charge is directed outward).

According to still another embodiment, the disclosure relates to an orienting internal assembly for use in a housing, including at least one shaped charge holder having one or more rollers, at least one bearing assembly, and a detonator holder and/or a detonator. The at least one shaped charge holder and the detonator holder and/or detonator may be configured to rotate as a whole. The one or more rollers may be mounted on and/or affixed to the at least one shaped charge holder and configured to contact an inner surface of the housing According to yet another embodiment, the disclosure relates to an orienting internal assembly for use in a housing, having at least one shaped charge holder, having one or more rollers mounted on/affixed to the at least one shaped charge holder and configured to contact an inner surface of the housing; and a detonator holder and/or a detonator. The at least one shaped charge holder may include one or more rollers, for example mounted on and/or affixed to the at least one shaped charge holder and configured to contact an inner surface of the housing. The at least one shaped charge holder and the detonator holder and/or detonator may be configured to rotate as a whole.

According to yet another embodiment, the disclosure relates to an orienting internal assembly for use in a housing, which may include a plurality of shaped charge holders and a detonator holder and/or a detonator. The plurality of shaped charge holders may be linked together into a unitary linkage, so as to rotate together as a whole, and the linkage may have at least two rollers mounted thereon. The plurality of shaped charge holders (e.g. the linkage) and the detonator holder and/or detonator may be configured to rotate together as a whole (e.g. rotationally fixed together).

According to still another aspect, the disclosure relates to a perforating gun assembly having a housing with a longitudinal bore, and an orienting internal assembly. In some embodiments, the orienting internal assembly may include at least one shaped charge holder, two bearing assemblies, a detonator holder and/or detonator, and an eccentric weight. The orienting internal assembly may be disposed within the longitudinal bore of the housing. In some embodiments, the at least one shaped charge holder, the detonator holder and/or detonator, and the eccentric weight are configured to rotate as a whole about a central axis of the two bearing assemblies. Other embodiments of the orienting internal assembly may include a charge tube configured to hold and direct one or more shaped charges outward, two bearing assemblies, and a detonator holder and/or a detonator, for example with the charge tube and the detonator holder/detonator configured to rotate as a whole.

According to yet another aspect, the disclosure relates to an electrical assembly for use in a housing having a longitudinal bore. For example, the electrical assembly may include a bearing assembly, having a first portion configured to be stationary with respect to the housing and a second portion configured to be rotatable with respect to the first portion, and a ground conductor which is rotationally fixed to the second portion of the bearing assembly. In some embodiments, the ground conductor and the second portion of the bearing assembly may be configured to rotate together as a whole.

BRIEF DESCRIPTION OF THE DRAWINGS

A more particular description will be rendered by reference to specific embodiments thereof that are illustrated in the appended drawings. Understanding that these drawings depict only typical embodiments thereof and are not therefore to be considered to be limiting of its scope, exemplary embodiments will be described and explained with additional specificity and detail through the use of the accompanying drawings in which.

Figure 1:
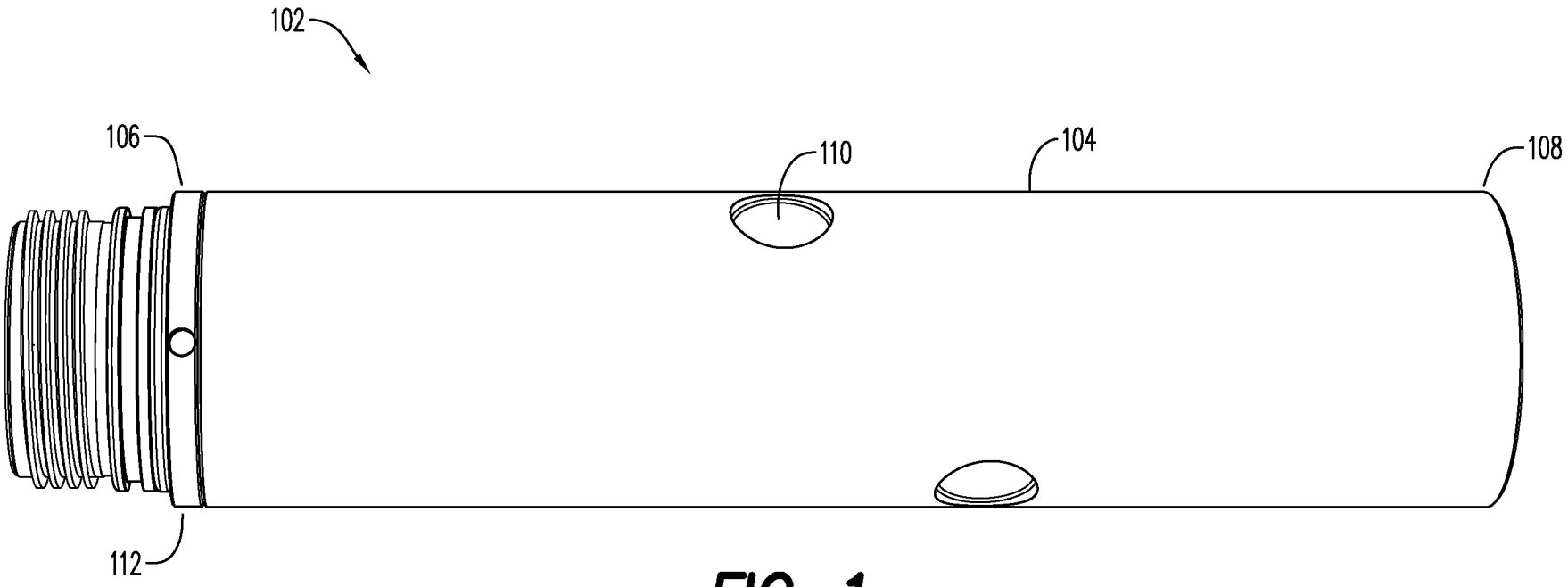
FIG. 1 is a side elevation view of an exemplary embodiment of a perforating gun in accordance with an aspect of the disclosure.

Various features, aspects, and advantages of the exemplary embodiments will become more apparent from the following detailed description, along with the accompanying drawings in which like numerals represent like components throughout the figures and detailed description. The various described features are not necessarily drawn to scale in the drawings but are drawn to aid in understanding the features of the exemplary embodiments.

The headings used herein are for organizational purposes only and are not meant to limit the scope of the disclosure or the claims. To facilitate understanding, reference numerals have been used, where possible, to designate like elements common to the figures.

DETAILED DESCRIPTION

Reference will now be made in detail to various exemplary embodiments. Each example is provided by way of explanation and is not meant as a limitation and does not constitute a definition of all possible embodiments. It is understood that reference to a particular "exemplary embodiment" of, e.g., a structure, assembly, component, configuration, method, etc. includes exemplary embodiments of, e.g., the associated features, subcomponents, method steps, etc. forming a part of the "exemplary embodiment".

For purposes of this disclosure, the phrases "devices," "systems," and "methods" may be used either individually or in any combination referring without limitation to disclosed components, grouping, arrangements, steps, functions, or processes.

A modular perforating gun platform and system according to the exemplary embodiments discussed throughout this disclosure may generally include, without limitation, separate and variously connectable or interchangeable (i.e., modular) perforating gun components. The modular components may include generic components configured for use with all variants of variable components, each variable component having variants for particular applications and configured for use with the generic component(s). Variants may have varying dimensions, geometries, structures, etc. However, each modular component may include standard features and structures (i.e., a platform) for, without limitation, connecting together in various configurations for particular applications.

The application incorporates by reference the following patent application in its entirety, to the extent not inconsistent with and/or incompatible with the present disclosure: U.S. Provisional Patent Application No. 63/166,720, filed Mar. 26, 2021.

Figure 2:
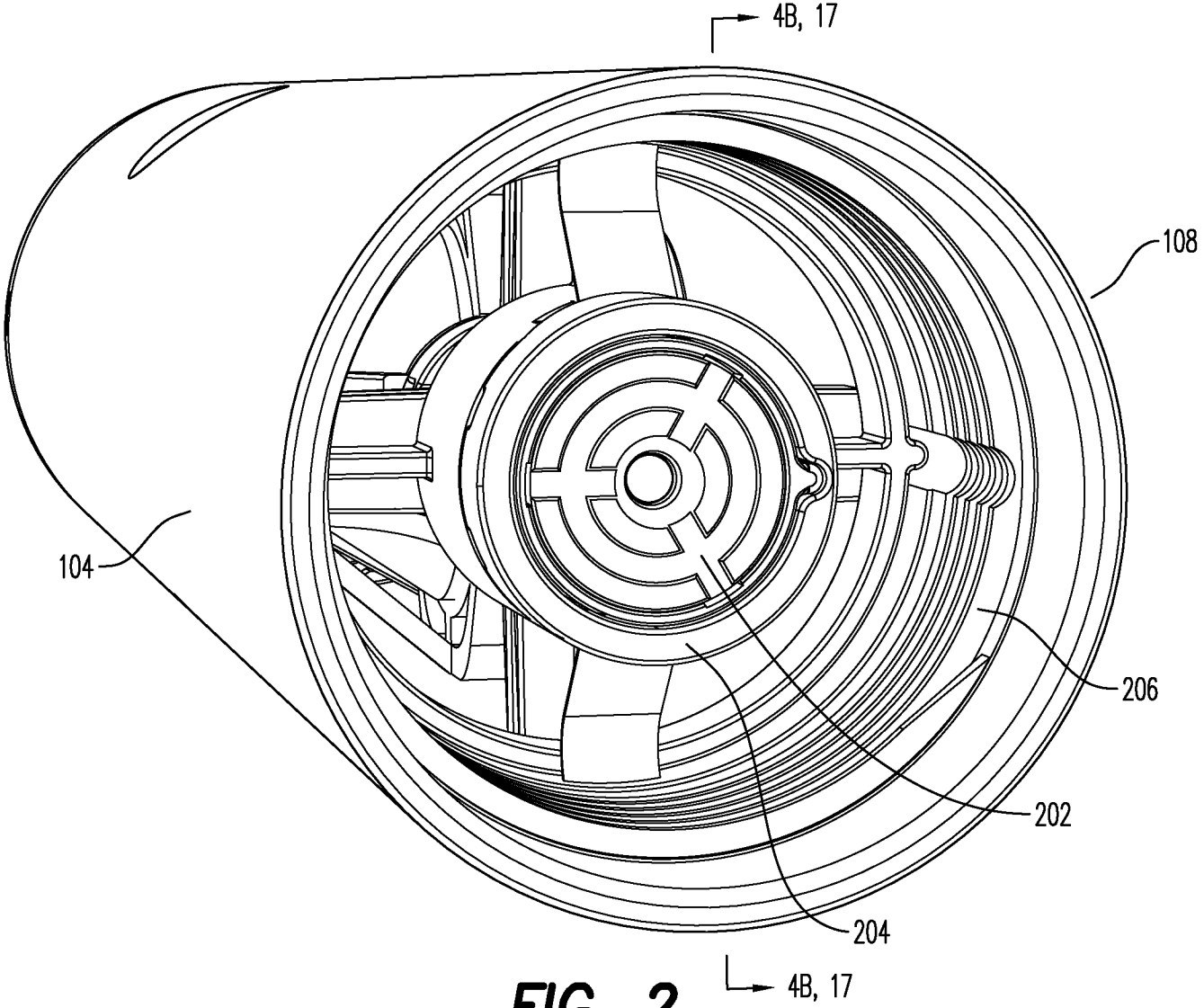
FIG. 2 is a perspective view of the perforating gun shown in FIG. 1.

With reference now to FIG. 1 and FIG. 2, an exemplary embodiment of a perforating gun 102 and perforating gun system, as discussed throughout this disclosure, includes a housing 104 with a housing first end 106 and a housing second end 108. Each of the housing first end 106 and the housing second end 108 may include inner threads 206 for connecting to, without limitation, a tandem seal adapter 112 as shown in FIG. 1, or other wellbore tools or tandem/connector subs. In an aspect, the housing first end 106 may connect to the tandem seal adapter 112 that is configured for connecting to each of the housing first end 106 of the perforating gun 102, and a housing second end of an adjacent perforating gun, thus connecting adjacent housings/perforating guns and sealing, at least in part, each housing from an external environment and from each other.

In other embodiments, a housing may have a male connection end at a housing first end. The male connection end may have an external threaded portion corresponding to and configured for connecting to the inner (i.e., female) threads 206 of the housing second end 108. The connection between the male connection end external threads and the internal threads 206 of the housing second end 108 may connect adjacent housings/perforating guns. A tandem seal adapter may not be required or used between adjacent housings with respective male and female connecting ends, or may be an internal, baffle-style tandem seal adapter. In other embodiments, each of the housing first end 106 and the housing second end 108 may have external threads for connecting to other tandem/connector subs or adjacent wellbore tools, as applications dictate. A perforating gun housing including respective male and female connecting ends may be such as disclosed in U.S. Pat. No. 10,920,543 issued Feb. 16, 2021, which is commonly owned by DynaEnergetics Europe GmbH and incorporated by reference herein, to the extent not incompatible and/or inconsistent with this disclosure. An internal, baffle-style tandem seal adapter may be such as disclosed in U.S. Pat. No. 10,844,697 issued Nov. 24, 2020, which is commonly owned by DynaEnergetics Europe GmbH and incorporated by reference herein, to the extent not incompatible and/or inconsistent with this disclosure With reference back to FIG. 1, one or more scallops 110 may be positioned along the exterior surface of the housing 104 and aligned with shaped charges positioned within an interior of the housing 104. Scallops 110 are well known as portions of a perforating gun housing at which the housing 104 has, e.g., a reduced thickness and/or additional machining to prevent potentially damaging burrs from forming when the shaped charge fires through the housing 104. Accordingly, perforating guns incorporating a housing with scallops 110 such as those shown in FIG. 1 must lock or otherwise ensure that an orientation of the shaped charges within the housing aligns with the scallops 110, if the scallops 110 are to be used.

With additional reference to FIG. 2, the exemplary embodiments include a detonator 202 retained in a detonator holder or sleeve 204 that is positioned within the housing 104 and at or near the housing second end 108. For purposes of this disclosure, the phrase "at or near" and other terms/phrases describing, for example, a position, proximity, dimension, geometry, configuration, relationship, or order, are used to aid in understanding the exemplary embodiments and without limitation to, e.g., particular boundaries, delineations, ranges or values, etc., unless expressly provided. Further, the phrase "housing second end" may be used interchangeably with the phrase "housing detonator end" with reference to an end of the housing 104 at which the detonator 202 is positioned or nearest in an assembled perforating gun 102, to aid in understanding, e.g., the position and relationship between components.

With additional reference to FIG. 3, FIG. 4A, FIG. 4B, FIG. 5, FIG. 6, and FIG. 7, the detonator holder 204 is retained and centralized within the housing 104 by a centralizer 302. The exemplary centralizer 302 as shown in, for example, FIGS. 3-5, has a ring 304 encircling an axially oriented center tube 320 defining a center tube passage 506 that receives a detonator holder stem 514 of the detonator holder 204 such that the centralizer 302 may be slid over the detonator holder stem 514 to adjoin a cap 516 of the detonator holder 204.

Figure 3:
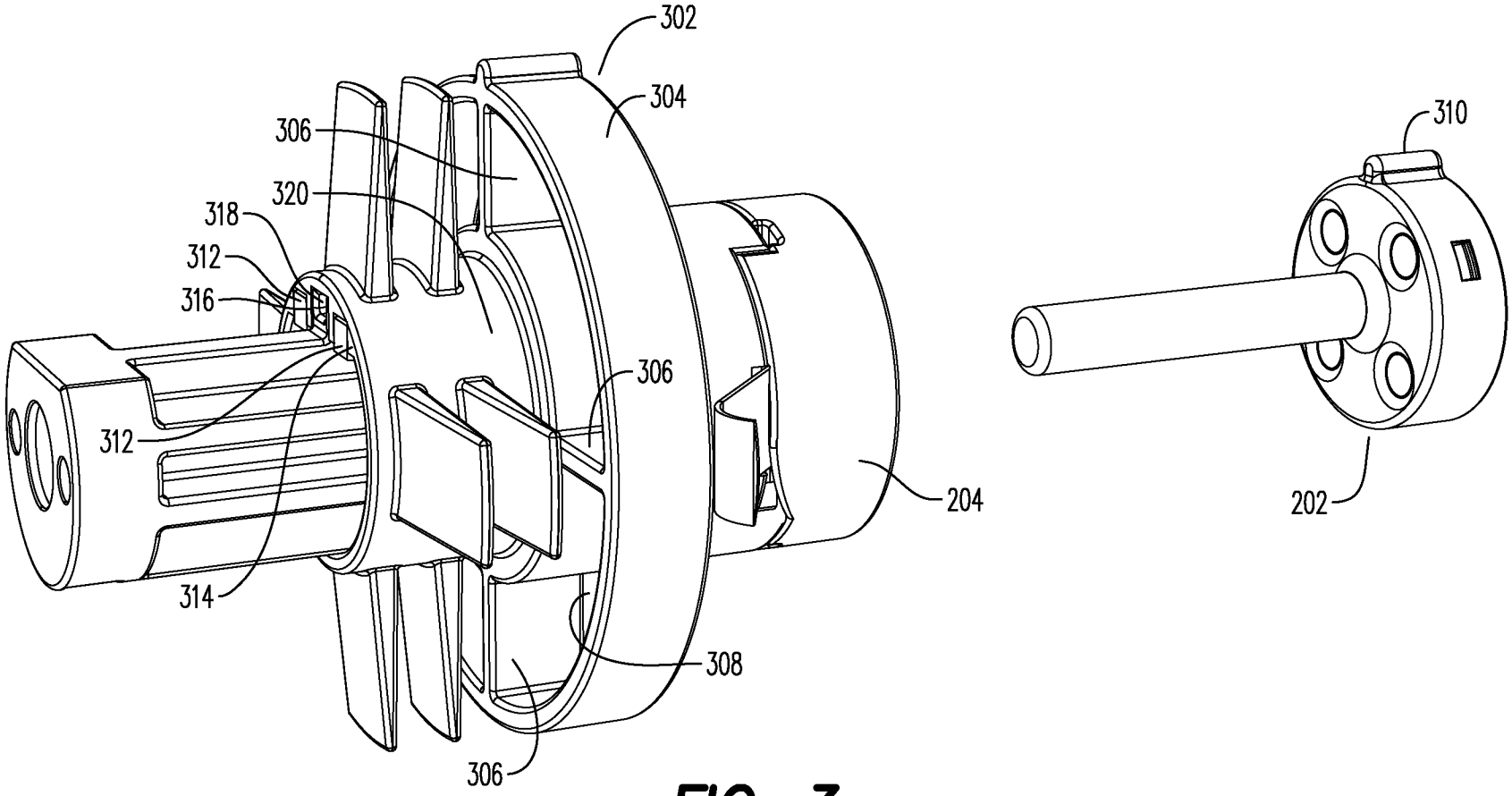
FIG. 3 is a perspective view of an assembly of a centralizer and a detonator holder, shown with a detonator in accordance with an aspect of the disclosure.
Figure 5:
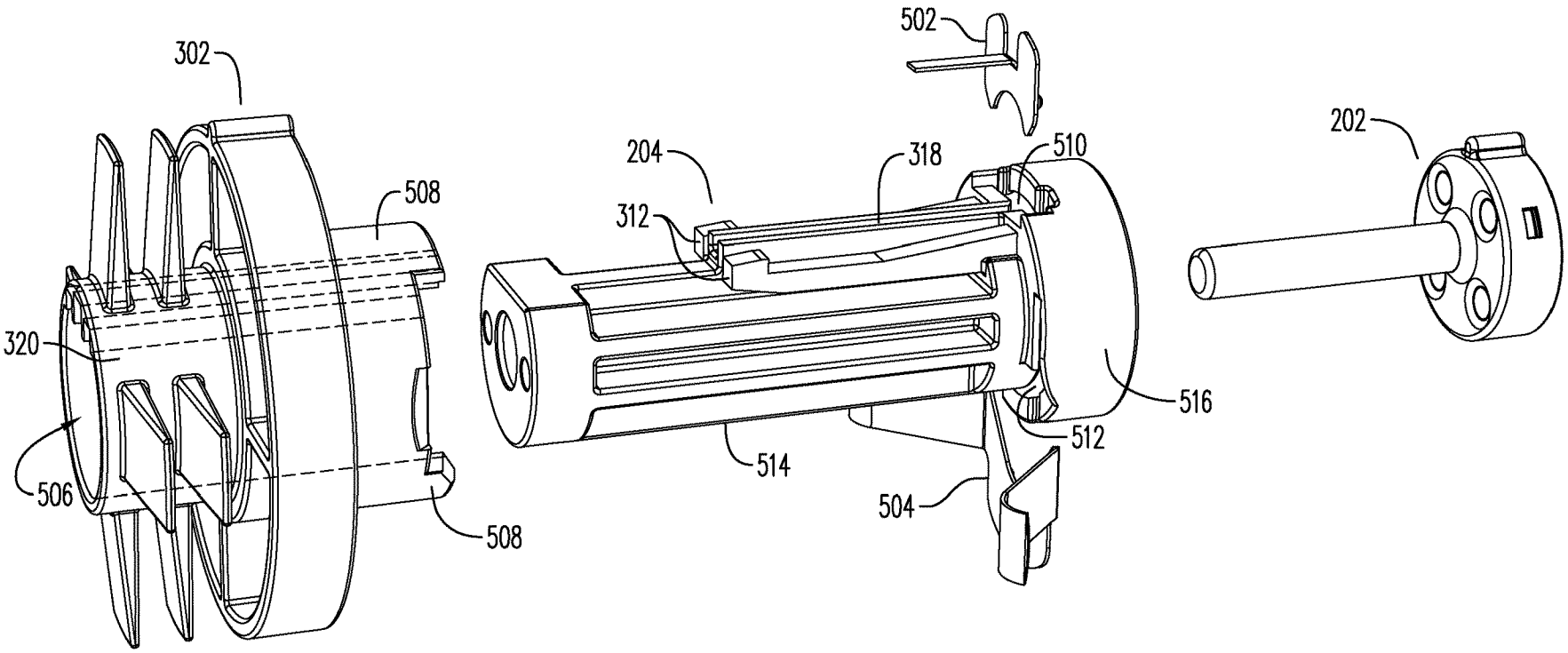
FIG. 5 is an exploded assembly view of the centralizer, detonator holder, and detonator shown in FIG. 3.

With specific reference to FIG. 3 and FIG. 5, the detonator holder 204 includes a relay wire channel 318 and two locking tabs 312 extending axially along the detonator holder stem 514. A signal relay wire 816 (FIG. 8) is routed out of the detonator holder 204 via the relay wire channel 318. When the centralizer 302 is slid over the detonator holder stem 514 the center tube 320 covers the relay wire channel 318 to hold the signal relay wire 816 in place. The center tube 320 includes a relay signal outlet 316 for the relay wire channel 318, thereby allowing the signal relay wire 816 to pass through. The center tube 320 includes tab locking structures 314 for positively locking against the locking tabs 312, to hold the detonator holder 204 in the centralizer 302.

Figure 4A:
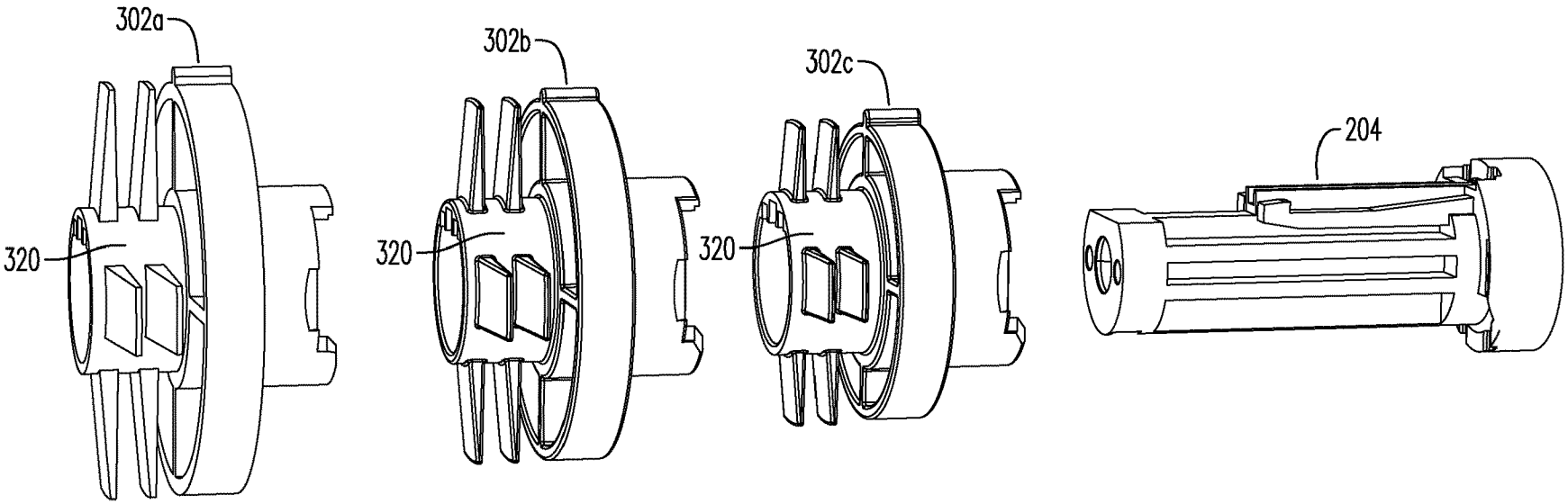
FIG. 4A is a perspective view of various sizes of centralizers that can be used with the detonator holder shown in FIG. 3 in accordance with an aspect of the disclosure.
Figure 4B:
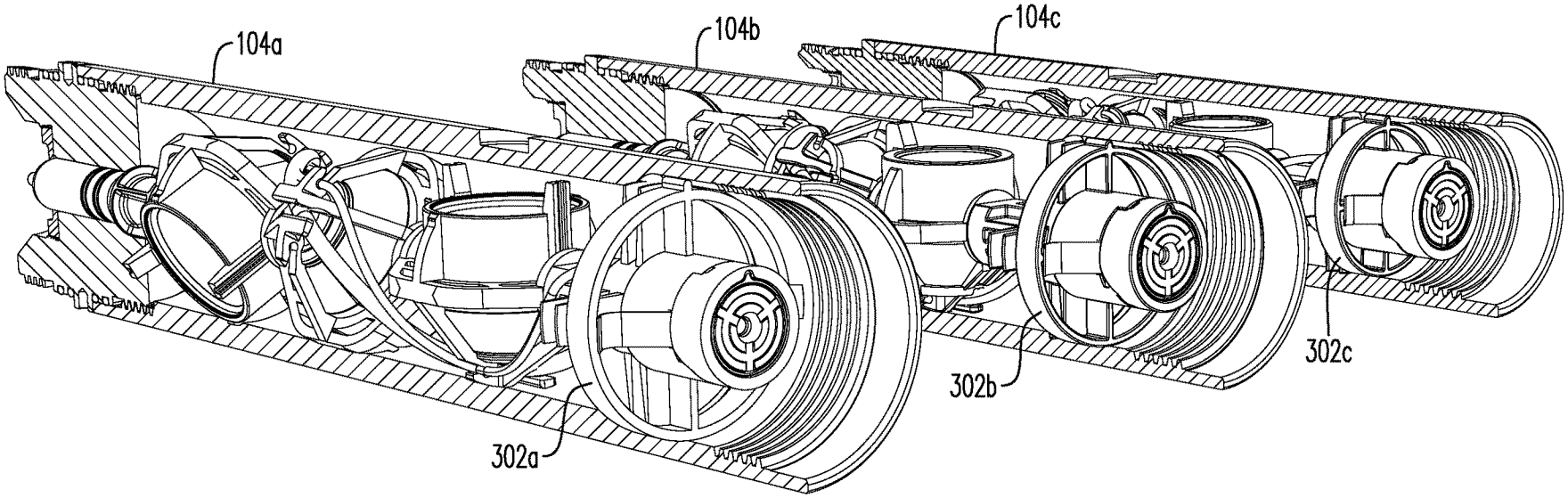
FIG. 4B shows cutaways of three sizes of perforating guns using the various sizes of centralizers and detonator holder shown in FIG. 4A in accordance with an aspect of the disclosure.

With reference specifically to FIG. 4A and FIG. 4B, the detonator holder 204 according to the exemplary embodiments is, in an aspect, a generic component that is configured for use with, e.g., a variety of centralizers 302*a*, 302*b*, 302*c*. Each of the centralizers 302*a*, 302*b*, 303*c* is correspondingly configured for use with the generic detonator holder 204. For example, each of the centralizers 302*a*, 302*b*, 302*c* will assemble to the detonator holder 204, and position the detonator holder 204 within a perforating gun housing 104*a*, 104*b*, 104*c*, in a similar manner. In an exemplary modular perforating gun platform and without limitation, each of the centralizers 302*a*, 302*b*, 302*c* may be configured, i.e., dimensioned, for use with a particular perforating gun size. The generic detonator holder 204 and a corresponding centralizer may be used for each of gun sizes (i.e., housing internal diameters) 3.5" (104*a*, 302*a*), 3⅛" (104*b*, 302*b*), and 2¾" (104*c*, 302*c*). For example, a corresponding centralizer 302*a*, 302*b*, 302*c* may have an outer diameter at the ring 304 that is substantially equal to the housing internal diameter. For purposes of this disclosure, "substantially equal" is used, without limitation, to aid in the understanding of the exemplary embodiments in which, for example, the inner diameter of the housing 104 provides a barrier against the centralizer 302 to prevent the centralizer 302 from tilting or radial misalignment. In an aspect, parts configured for particular gun sizes may be color coded to enhance a production process, while using a generic detonator holder 204 with each size variant may improve production logistics. For example, generic parts such as the detonator holder 204 may be yellow. Parts corresponding to a 3.5" gun size system (e.g., centralizer 302*a*) may be cyan, parts for a 3⅛" gun size system (e.g. centralizer 302*b*) may be blue, and parts for a 2¾" gun size system (e.g., centralizer 302*c*) may be green.

Figure 6:
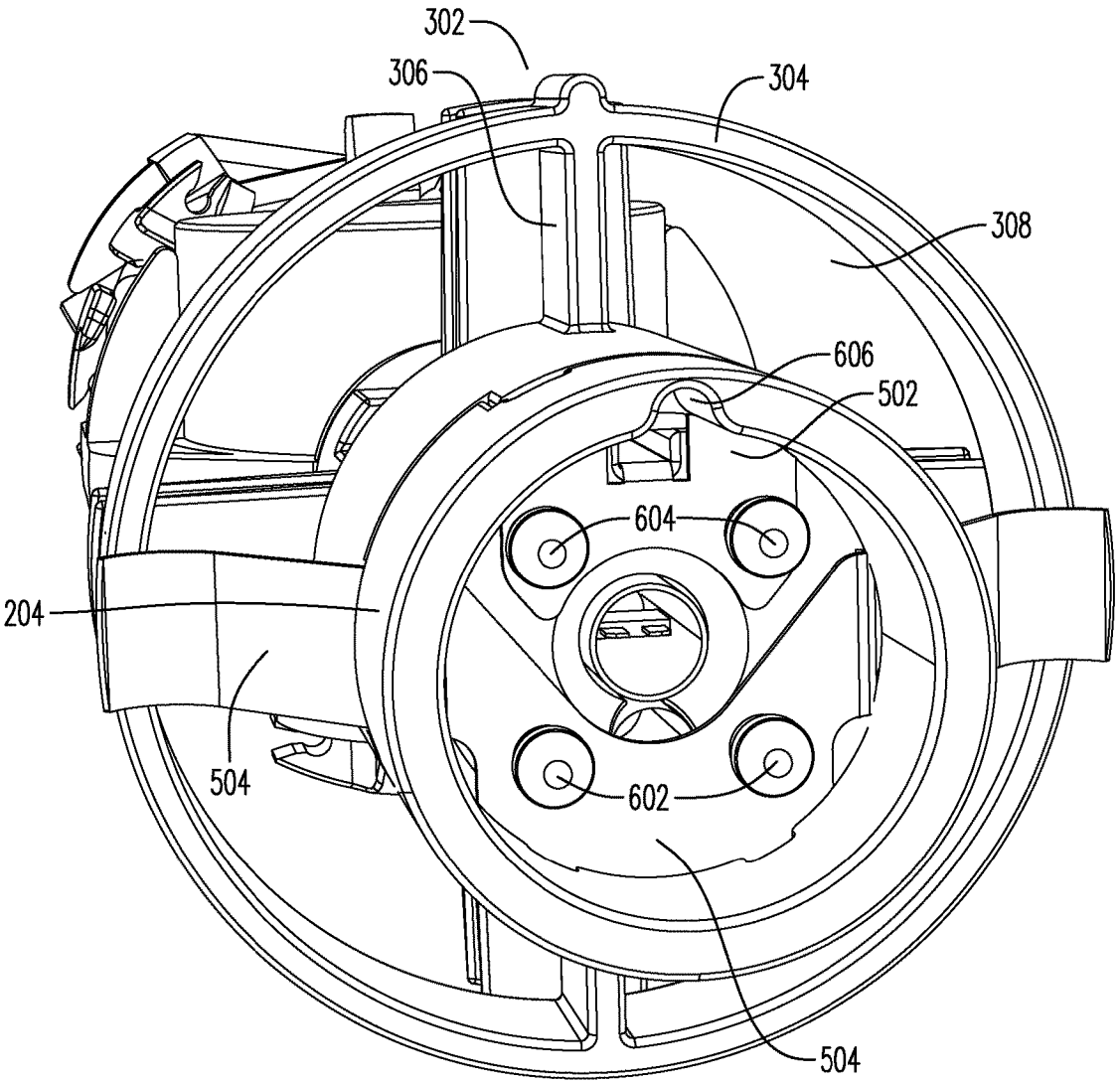
FIG. 6 is a perspective view of an internal gun assembly according to an exemplary embodiment.

With additional reference to FIG. 6, the ring 304, in an aspect, is connected to the center tube 320 by spokes 306, thereby forming open areas 308 that add to the free gun volume (i.e., volume not occupied by a physical component within the housing 104) when the centralizer 302 is positioned within the housing 104.

Figure 7:
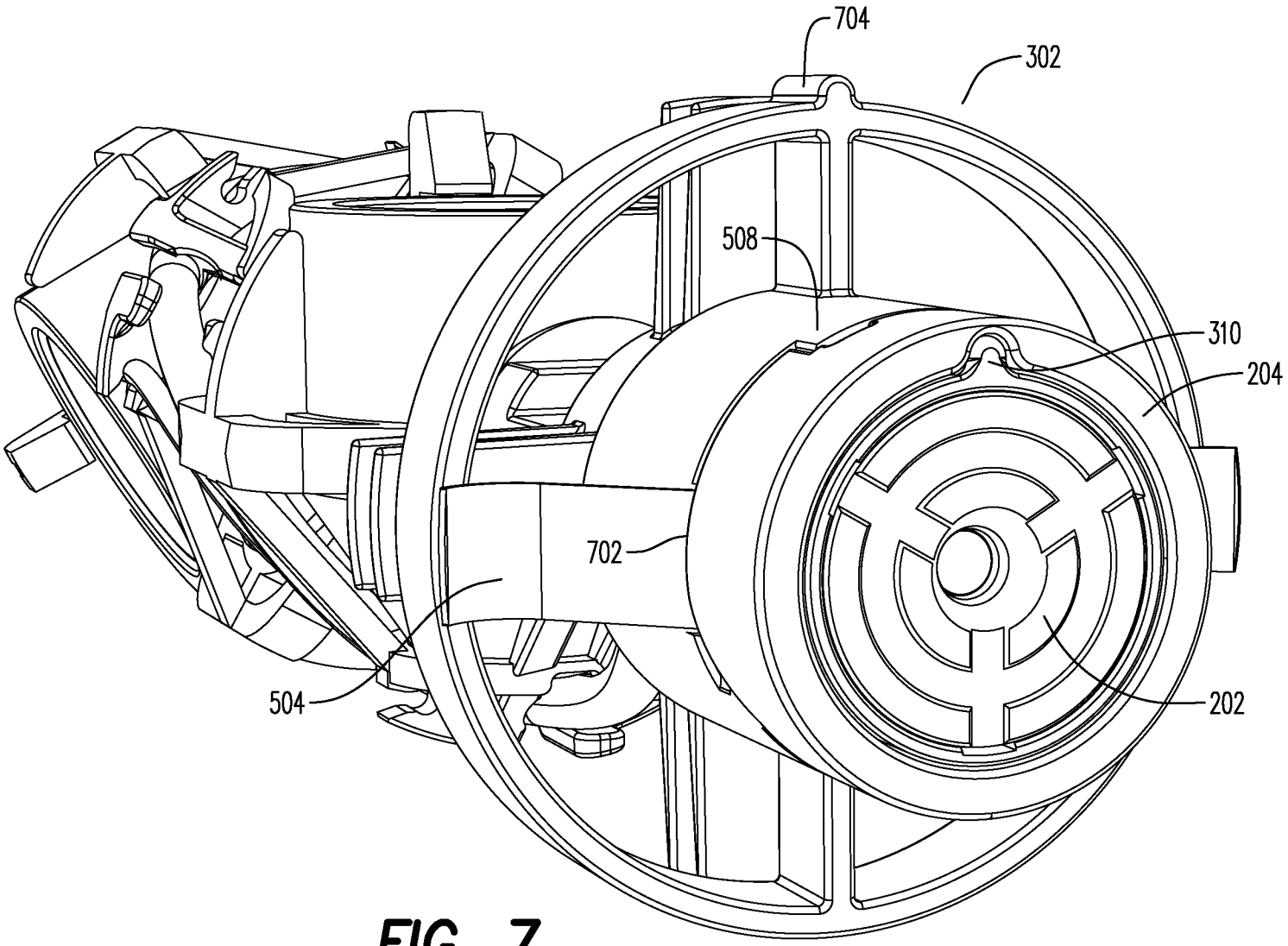
FIG. 7 is a perspective view of the internal gun assembly shown in FIG. 6, shown with a detonator according to an aspect of the disclosure.

With reference to FIG. 5, FIG. 6, and FIG. 7, the detonator holder 204 receives and houses the detonator 202. In an aspect, inserting the detonator 202 into the detonator holder 204 automatically makes various wireless electrical connections between electrical contacts on the detonator 202 and corresponding electrical contacts on the detonator holder 204, as explained further below. For purposes of this disclosure, "wireless electrical connection" means an electrical connection formed by physical contact between conductive components, without any wires electrically connecting the conductive components. "Electrical contact" means either a conductive component for making a wireless electrical connection, or a state of physical, conductive contact between conductive components, as the context makes clear.

In an aspect and as illustrated in FIG. 5 and FIG. 6, the detonator holder 204 includes a feedthrough contact plate 502 positioned and exposed within the detonator holder cap 516. The feedthrough contact plate 502 includes one or more feedthrough contact pins 604 that may include a redundancy option. A ground contact plate 504 is also positioned within the detonator holder cap 516 and includes one or more ground contact pins 602. Sliding the centralizer 302 over the detonator holder stem 514 secures each of the feedthrough contact plate 502 and the ground contact plate 504 in position within a respective feedthrough plate slot 510 and ground contact ground plate slot 512. The feedthrough contact plate 502 and the ground contact plate 504 are secured by corresponding contact plate securing structures 508 on the centralizer 302. The contact plate securing structures 508 are configured, i.e., positioned and dimensioned, to cover the feedthrough plate slot 510 and the ground contact ground plate slot 512 when the centralizer 302 adjoins the detonator holder cap 516. In an aspect, the feedthrough contact plate 502 is completely covered by the contact plate securing structure 508, and not exposed to another outside surface or body above the feedthrough plate slot 510. Accordingly, the need for a protective shield component for isolating the feedthrough contact plate 502 may be eliminated. In another aspect and as illustrated in FIG. 7, the ground contact plate 504 extends out of the detonator holder 204 through a gap 702 between the contact plate securing structures 508, and is configured for making grounding contact with the housing 104 when the centralizer 302 and detonator holder 204 are received within the housing 104. The feedthrough contact plate 502 and ground contact plate 504 are not limited to the "plate" configuration of the exemplary embodiments and may respectively take any form, configuration, shape, etc. consistent with this disclosure. With specific reference to FIG. 3, FIG. 6, and FIG. 7, the detonator 202 according to the exemplary embodiments includes a detonator alignment key 310 for properly orienting the detonator 202 within the detonator holder 204. The detonator alignment key 310 is positionable within a key slot 606 in the detonator holder 204, to orient the detonator 202 within the detonator holder 204. The centralizer 302 includes a centralizer alignment key 704 for orienting the detonator holder 204 and the detonator 202 within the housing 104. In an aspect, the detonator 202 includes an orientation sensor. Thus, the orientation of the detonator 202 within the housing 104 must be properly established as a reference for the orientation sensor to correctly determine whether the perforating gun 102 is in a desired orientation within the wellbore.

In various aspects, the detonator 202, detonator holder 204, and centralizer 302 may individually and via their interaction provide a relatively short assembly for positioning the detonator 202 within the housing 104, as discussed further below. Thus, the overall length of the perforating gun 102 may be reduced, and more perforating guns connected as part of a tool string and deployed during one perforation run into the wellbore, because, e.g., perforating gun tool string length may be limited by the cable strength, and rig-up height at the well surface.

Figure 8:
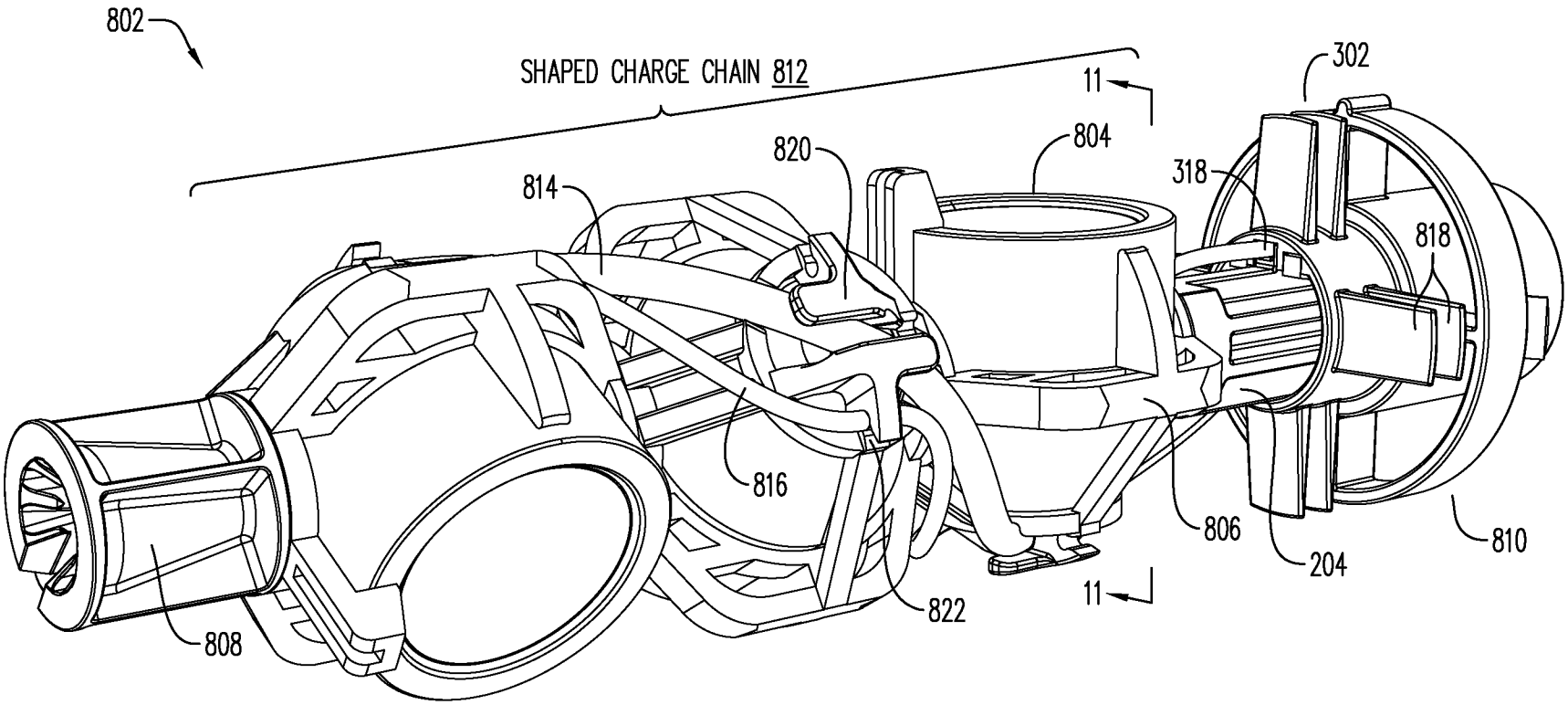
FIG. 8 is another perspective view of the internal gun assembly shown in FIG. 6.
Figure 9:
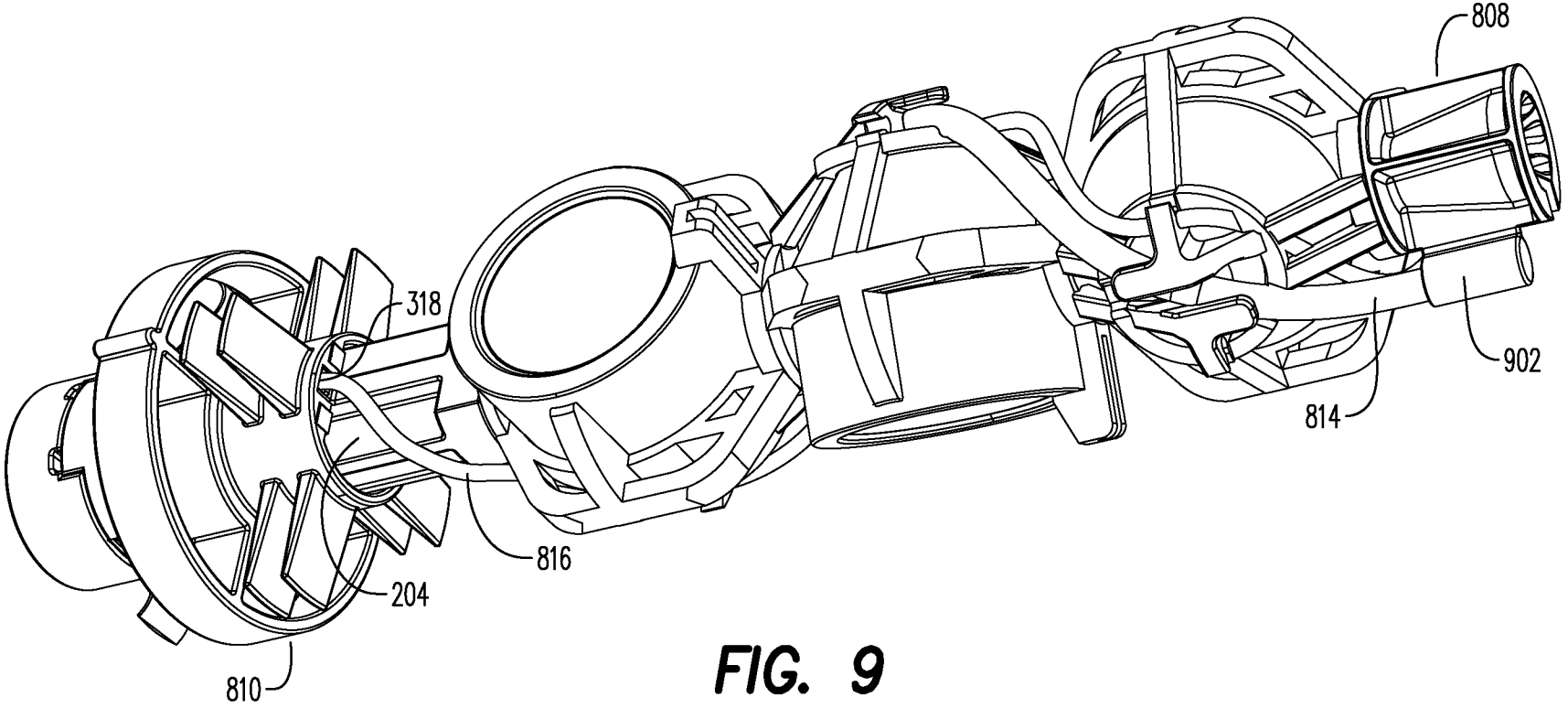
FIG. 9 is a perspective view of an internal gun assembly according to an exemplary embodiment.
Figure 10:
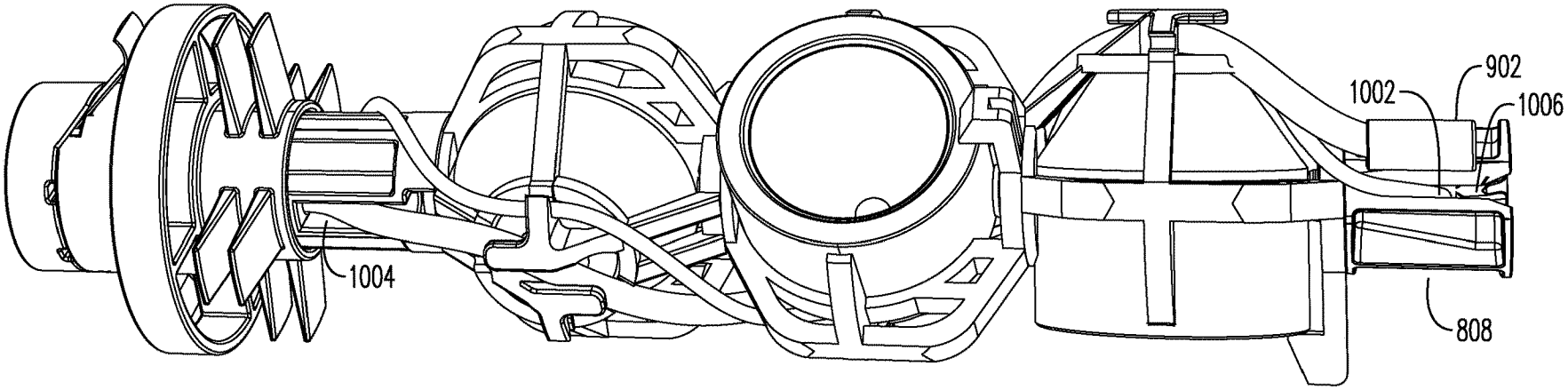
FIG. 10 is a perspective view of an internal gun assembly according to an exemplary embodiment.

With reference to FIG. 8, FIG. 9, and FIG. 10, an exemplary internal gun assembly 802 that is positioned within the housing 104 of the perforating gun 102 includes shaped charges 804 respectively received and retained in corresponding shaped charge holders 806 that are connected together in a chain 812. Each shaped charge 804 may be configured to form a perforation tunnel in a well, and may include a shaped charge case that forms a hollow cavity. Each shaped charge 804 typically includes an explosive load, for example positioned in the cavity of the shaped charge case. In some embodiments, the explosive load is disposed within the hollow cavity of the shaped charge case, and a liner is disposed adjacent to the explosive load (for example with the explosive load disposed between the liner and the shaped charge case). The liner may be configured to retain the explosive load in the hollow cavity of the shaped charge case. Some shaped charge 804 embodiments may also include a shaped charge inlay, which may be disposed on top of at least a portion of the liner (e.g. such that at least a portion of the liner is between the inlay and the explosive load). Each shaped charge 804 is typically configured to form a perforating jet for creating perforation holes in a target (e.g. the casing and/or rock formation of the well). Further details regarding shaped charges 804 are described in U.S. application Ser. No. 17/383,816, filed Jul. 23, 2021, and U.S. Pat. No. 11,053,782, issued Jul. 6, 2021, which are hereby incorporated by reference in their entirety to the extent not inconsistent and/or incompatible with this disclosure.

Figure 17:
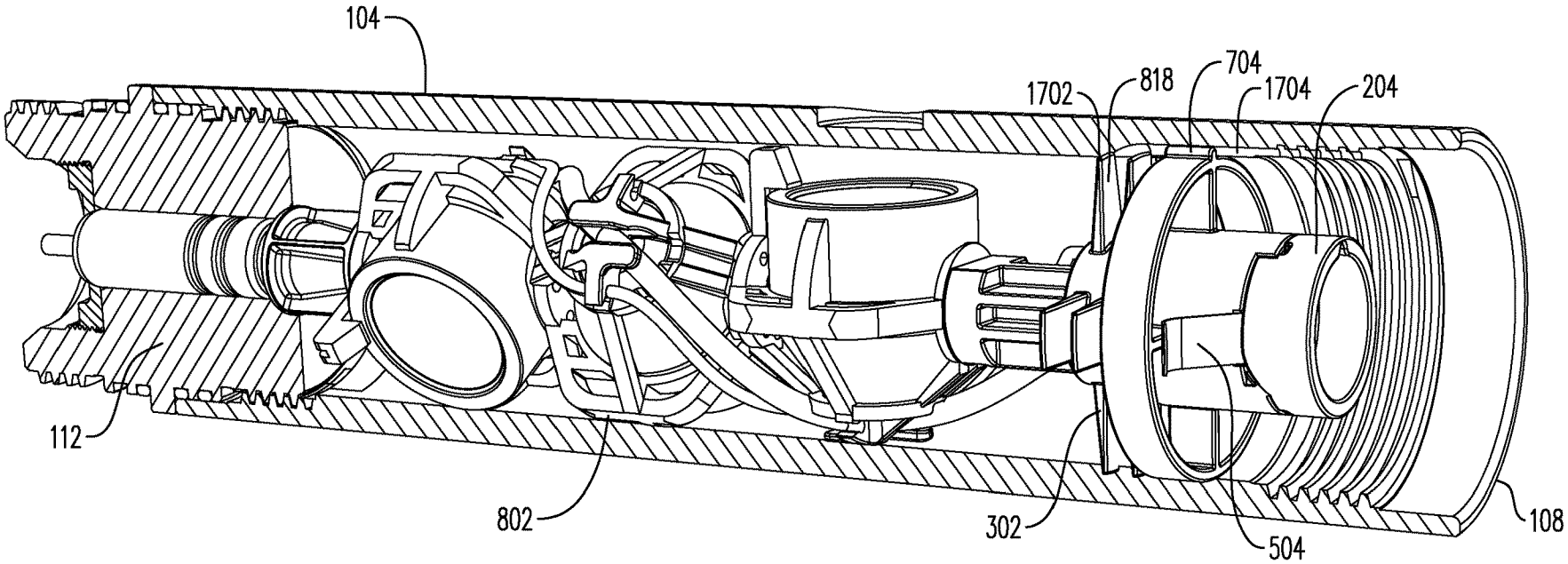
FIG. 17 is a perspective, cutaway view of an exemplary embodiment of a perforating gun in accordance with an aspect of the disclosure.
Figure 18:
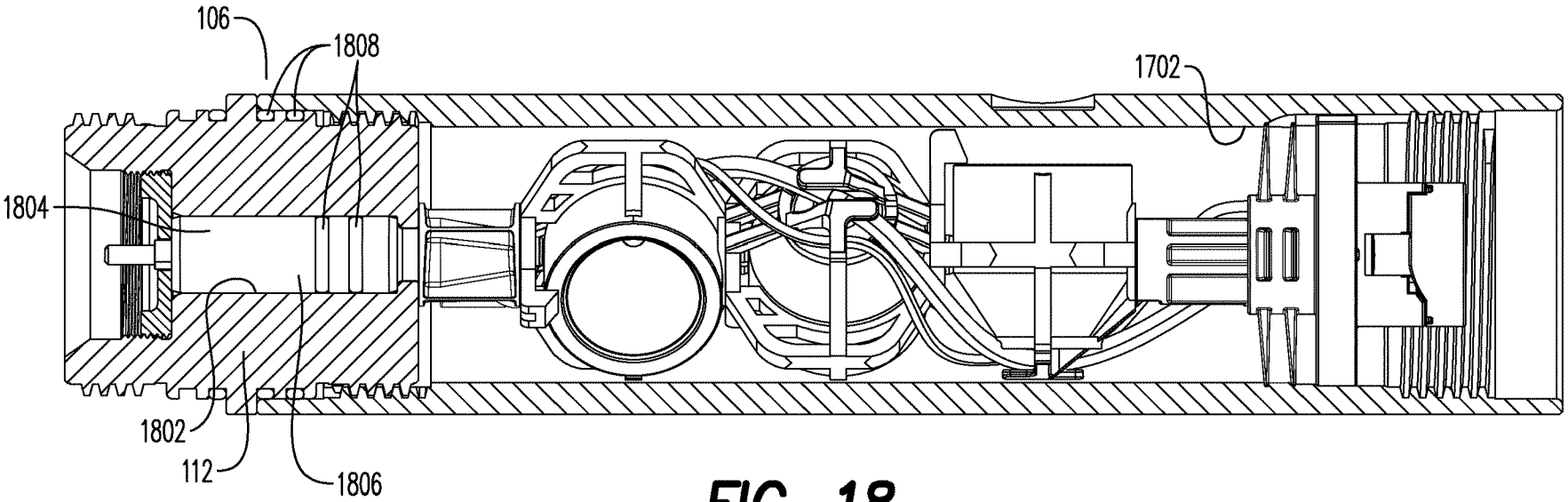
FIG. 18 is a side, cutaway view of the perforating gun shown in FIG. 17.

The detonator holder 204 is connected via the detonator holder stem 514 to a shaped charge holder 806 at a first end of the shaped charge chain 812. To aid in understanding the exemplary embodiments, this disclosure may refer to the detonator holder 204 and the centralizer 302 together, without limitation, as a detonator end assembly 810 of the internal gun assembly 802. In an aspect, the centralizer 302 includes one or more fins 818 extending radially outwardly from an exterior of the center tube 320, for contacting and pressing against an inner surface 1702 (FIG. 17) of the housing 104 to prevent axial movement of the centralizer 302 and thereby the internal gun assembly 802 within the housing 104. A conductive end connector 808 is connected to a shaped charge holder 806 at a second end of the shaped charge chain 812, opposite the first end.

In an aspect, the detonator end assembly 810 is configured for connecting to a component of the internal gun assembly 802 and being housed, as part of the internal gun assembly 802, within the housing 104. According to the exemplary embodiments, the detonator end assembly 810 is configured for connecting to the shaped charge holder 806 at the first end of the shaped charge chain 812. In other embodiments, the detonator end assembly 810 may connect to another component of the internal gun assembly 802, such as a spacer (not shown) configured for, e.g., connecting to components of the internal gun assembly 802 according to the exemplary embodiments.

A detonating cord 814 extends from the detonator holder 204 within which it is positioned and held in sufficiently close proximity (i.e., "ballistic proximity") to the detonator 202, or a ballistic transfer such as a booster in ballistic proximity to each of the detonator 202 and the detonating cord 814, such that the detonating cord 814 will initiate in response to the detonator 202 initiating. The detonating cord 814 exits the detonator holder 204 via a detonating cord channel 1004 which extends into the detonator holder 204 in a configuration that provides the ballistic proximity between a portion of the detonating cord 814 that is within the detonating cord channel 1004 within the detonator holder 204. In the exemplary embodiments, without limitation, the detonating cord channel 1004 is adjacent to a detonator bore 1106 (FIG. 11) within which the detonator 202 is housed as explained further below.

The detonating cord 814 extends along the shaped charge chain 812 and connects to each shaped charge holder 806 at a cord clip 820 that holds the detonating cord 814 in position for initiating the shaped charge 804. The detonating cord 814 is ultimately held by a terminal cord retainer 902 that serves to hold the detonating cord 814 at or near an end of the detonating cord 814 and to keep the detonating cord 814 from interfering with the assembly, or insertion into the housing 104, of the internal gun assembly 802. In the exemplary embodiment, the terminal cord retainer 902 is a blind cylindrical container on the conductive end connector 808, but may take any form consistent with this disclosure.

The signal relay wire 816 extends via the relay wire channel 318 out of the detonator holder 204, within which it is positioned and held in electrical contact with the feedthrough contact plate 502 or an electrical relay in electrical contact with each of the feedthrough contact plate 502 and the signal relay wire 816. The signal relay wire 816 extends along the shaped charge chain 812 and is routed through cord slots 822 on each shaped charge holder 806. The signal relay wire 816 extends to the conductive end connector 808 and relays and electrical signal between the feedthrough contact plate 502 and the conductive end connector 808. The signal relay wire 816 is inserted, via a relay wire slot 1002, into the conductive end connector 808, and positioned in electrical contact with a conductive end contact 1006 that is also positioned within the conductive end connector 808.

Figure 11:
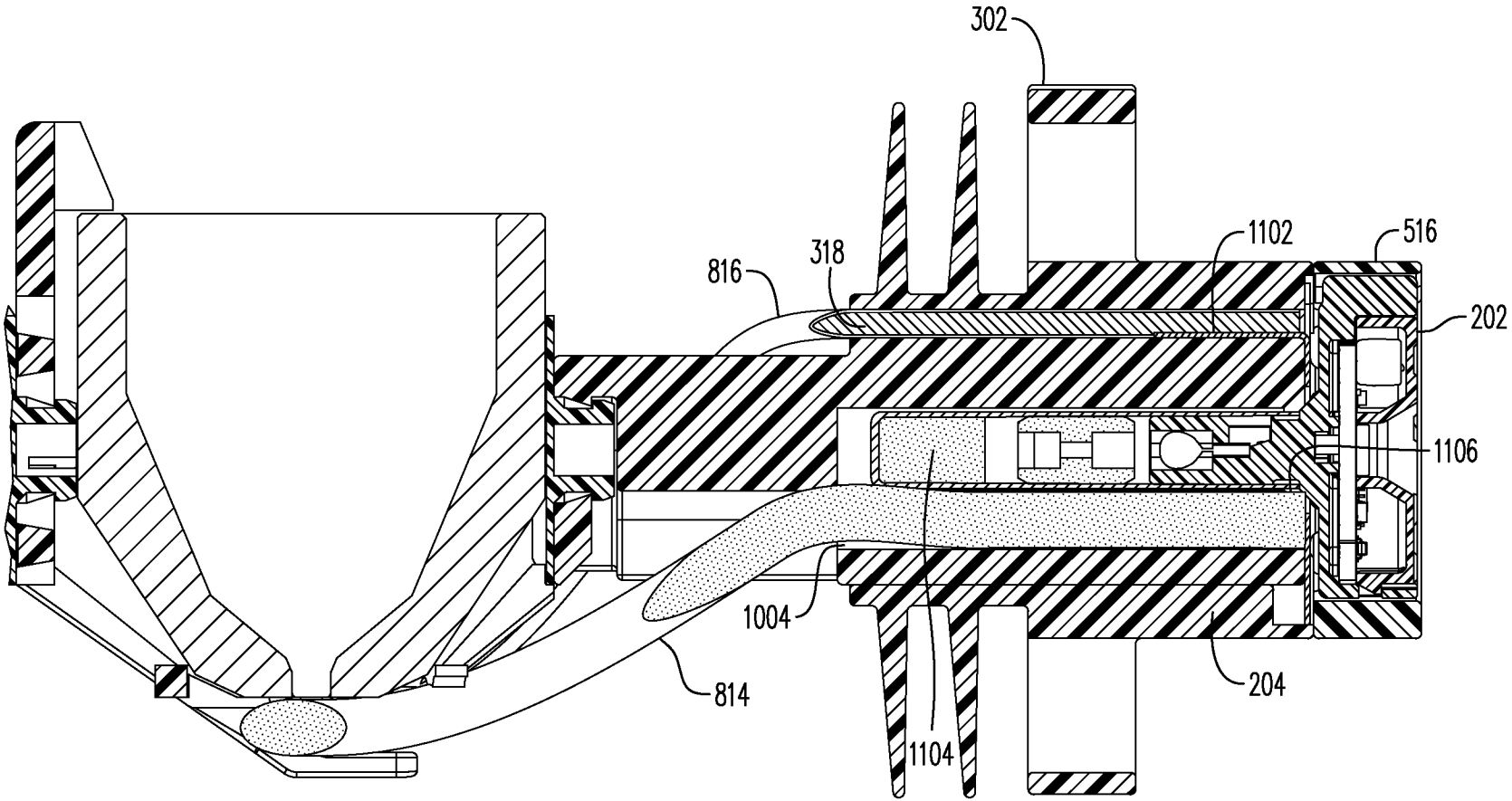
FIG. 11 is a cross section of an exemplary embodiment of a shaped charge holder, detonator holder, and centralizer in accordance with an aspect of the disclosure.

With reference to FIG. 11, a cross-section of the detonator holder 204, among other things, is shown. The signal relay wire 816 is positioned in the relay wire channel 318 that extends to the feedthrough plate slot 510, and a feedthrough contact plate leg 1102 of the feedthrough contact plate 502 extends into or adjacent to the relay wire channel 318. In an aspect, the signal relay wire 816 may be welded to the feedthrough contact plate leg 1102. The detonating cord 814 enters the detonator holder 204 via the detonating cord channel 1004 which extends into the detonator holder 204 in a position that puts the detonating cord 814 in ballistic proximity to an explosive portion 1104 of the detonator 202.

Figure 12:
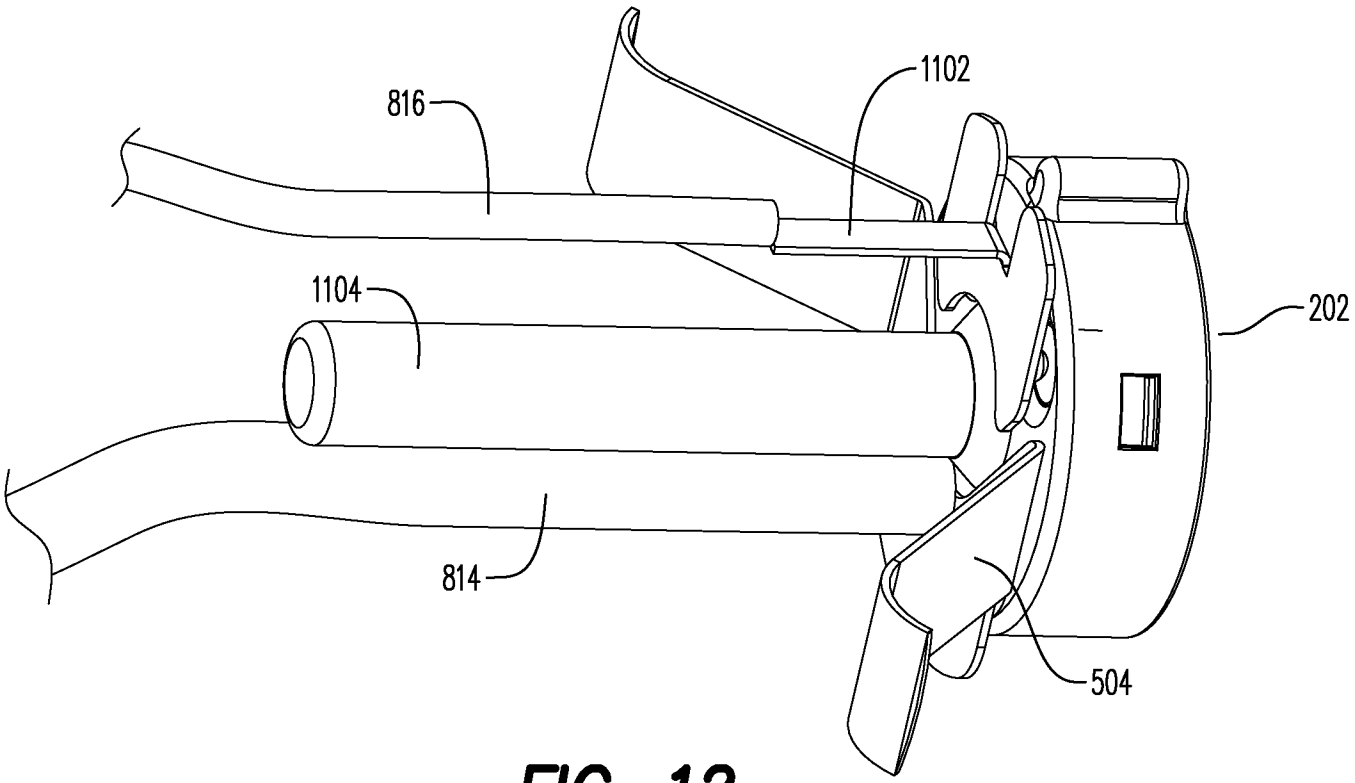
FIG. 12 is a perspective view of an arrangement of certain components within a detonator holder in accordance with an aspect of the disclosure.

FIG. 12 shows an arrangement of certain components within the detonator holder 204, in isolation. The detonator explosive portion 1104 is in ballistic proximity to the detonating cord 814, and the signal relay wire 816 is connected to the feedthrough contact plate leg 1102.

Figure 13:
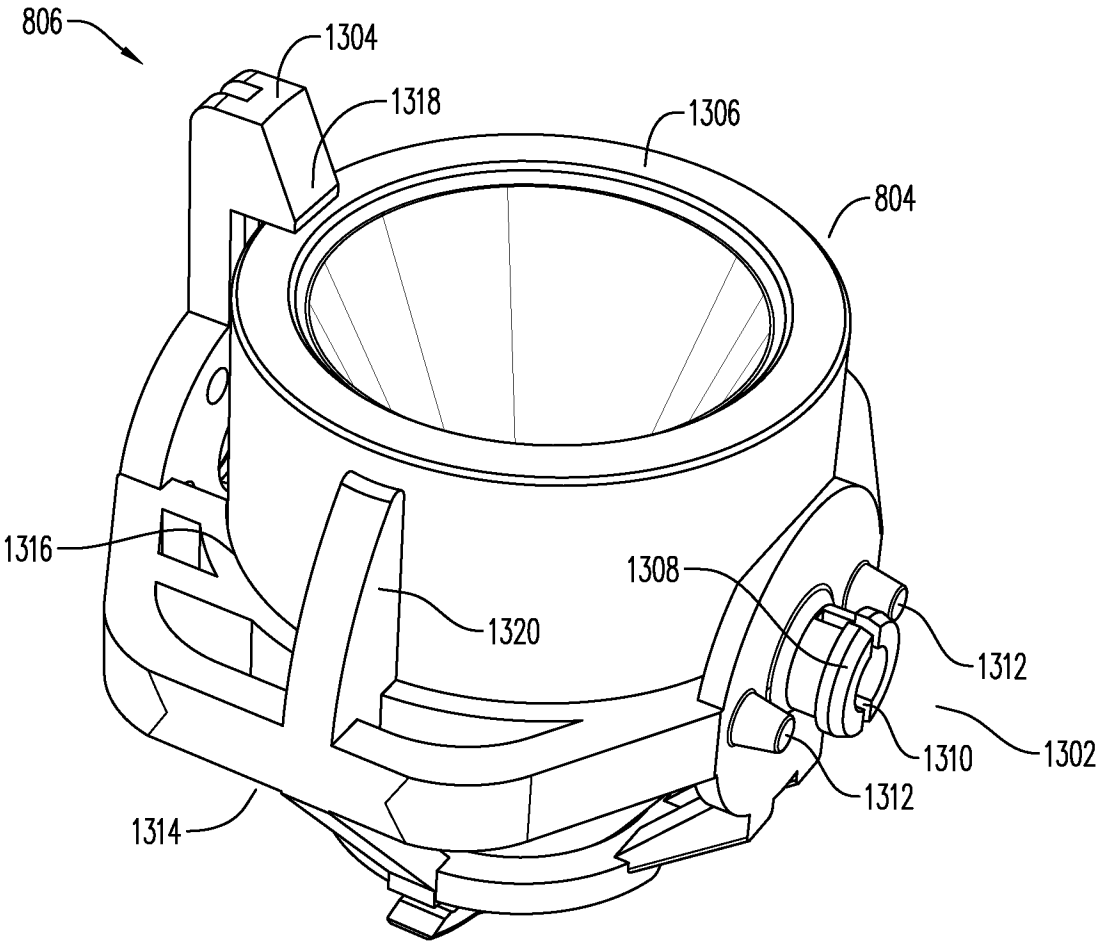
FIG. 13 is a perspective view of a shaped charge holder and shaped charge in accordance with an aspect of the disclosure.
Figure 14:
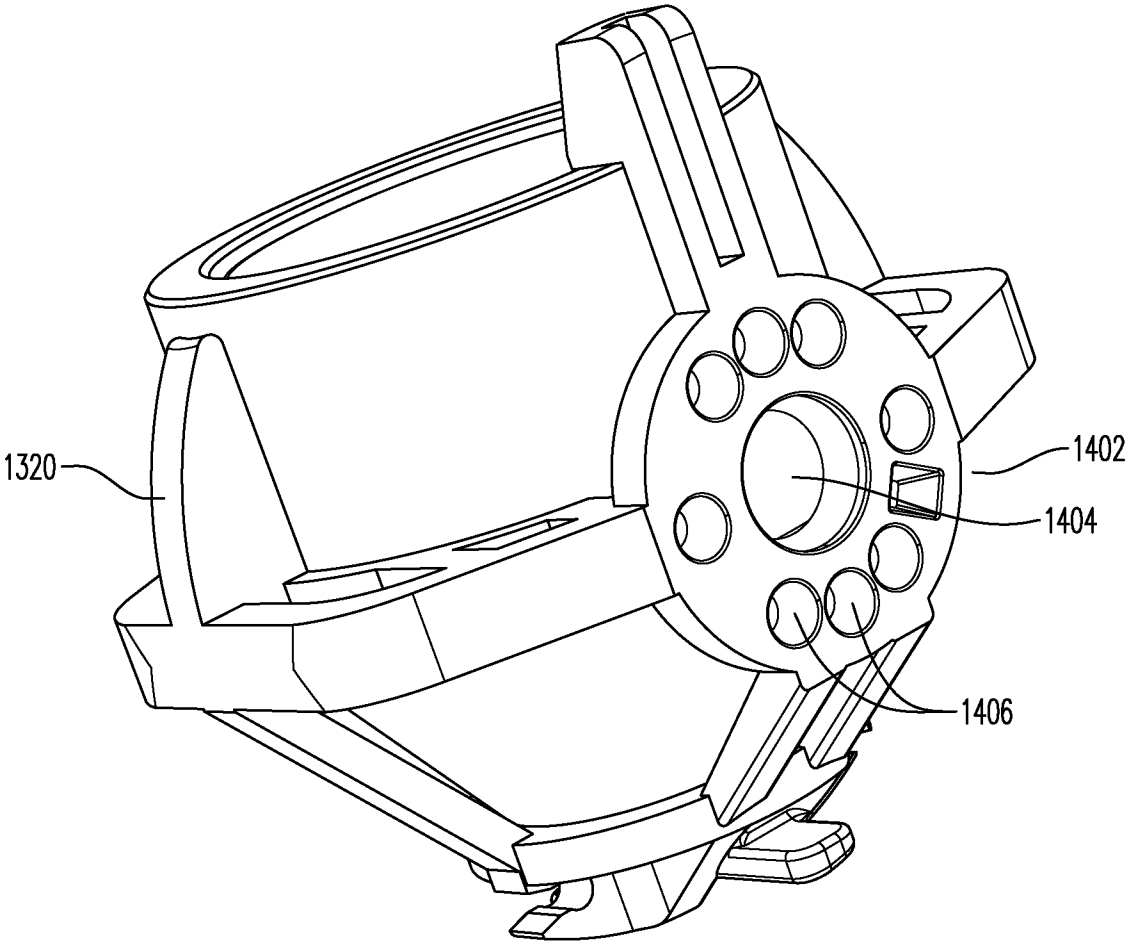
FIG. 14 is a perspective view of a shaped charge holder and shaped charge in accordance with an aspect of the disclosure.
Figure 15:
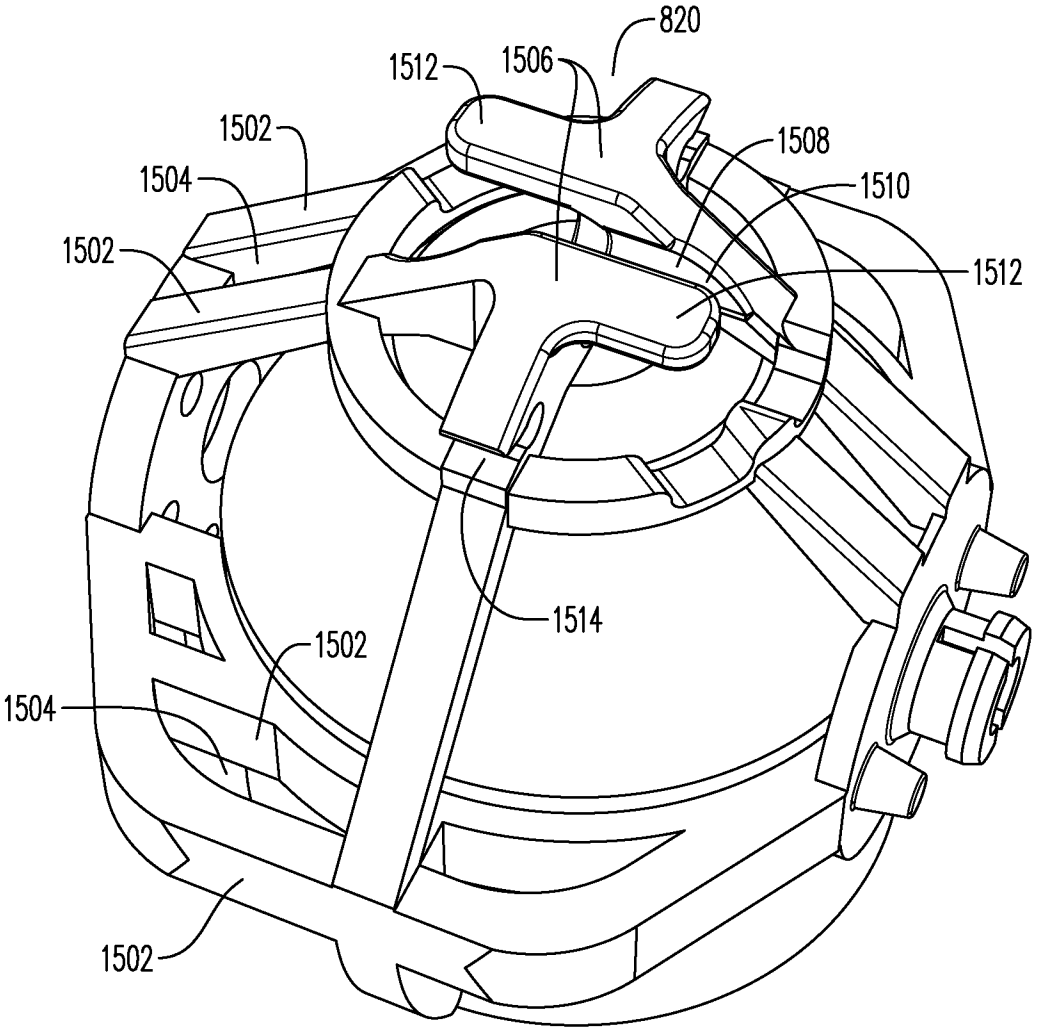
FIG. 15 is a perspective view of a shaped charge holder and shaped charge in accordance with an aspect of the disclosure.

With reference to FIG. 13, FIG. 14, and FIG. 15, an exemplary shaped charge holder 806 for use with the modular perforating gun platform is shown. Like the detonator holder 204 and the centralizer 302, the shaped charge holder 806 may be color coded according to the gun size with which it is used. The shaped charge holder 806 may include a shaped charge holder body 1314 defining a shaped charge holder receptacle 1316 in which the shaped charge 804 is inserted. One or more alignment posts 1320 may guide and orient the shaped charge 804 in the shaped charge holder receptacle 1316. One or more retention clips 1304 may extend from the shaped charge holder body 1314, in a direction that is away from the shaped charge holder receptacle 1316, and may be resilient to move out of the way when the shaped charge 804 is inserted. The retention clip(s) 1304 may be configured to move back into place once the shaped charge 804 is inserted and may be configured, i.e., positioned and dimensioned, to extend above a height of the shaped charge 804 positioned within the shaped charge holder receptacle 1316. The one or more retention clips 1304 may each include a retention tab 1318 that snaps into a depression or divot formed in the external surface of a case 1306 of the shaped charge 804, to retain the shaped charge 804 within the shaped charge holder receptacle 1316.

The shaped charge holder 806 may have a male connecting side 1302 for connecting to e.g., an adjacent shaped charge holder 806, the detonator holder 204, or an additional component, such as a spacer, of the internal gun assembly 802. The connections may be standardized between different components. The male connecting side 1302 may include a knob connector 1308 that may be a cylindrical extension and include an area of increased diameter at its top, and a slit 1310 extending along its length. The area of increased diameter and the slit 1310 provide a structure and resiliency for the knob connector 1308 to engage and positively lock against a corresponding structure formed within, e.g., a central bore 1404 of a female connecting side 1402 opposite the male connecting side 1302. The male connecting side 1302 may include phasing protrusions 1312 that may fit within phasing holes 1406 arranged around the female connecting side 1402, such that adjacent shaped charge holders 806 (or other components) may be oriented at a desired phasing relative to one another by "clocking" (i.e., rotating) adjacent shaped charge holders through the different positions, such as numbers arranged around a clock face, corresponding respectively to different phasing.

Figure 16:
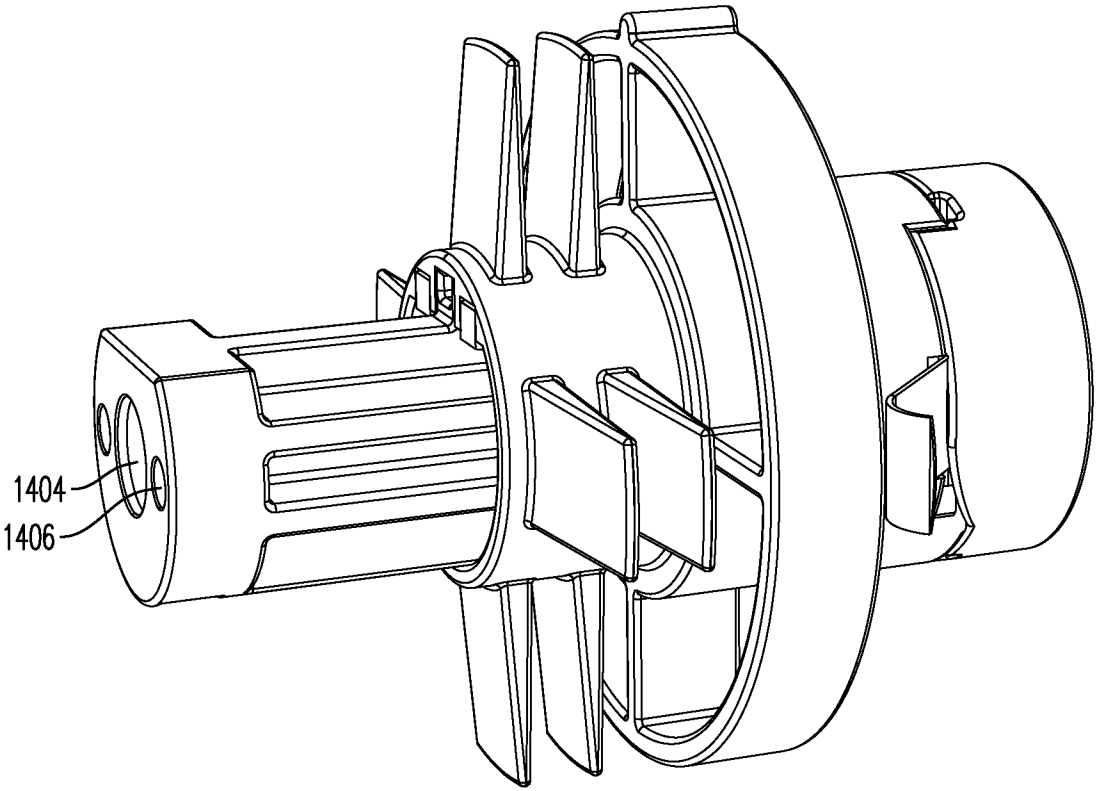
FIG. 16 is a perspective view of an assembly of a centralizer and a detonator holder according to an exemplary embodiment.

As shown in FIG. 16, the detonator holder 204 may also include a central bore 1404 and two or more phasing holes 1406 for connecting to the male connecting side 1302 of a shaped charge holder 806.

The cord clip 820 for holding the detonating cord 814 in position for initiating the shaped charge 804 may include oppositely disposed retention arms 1506 that form a detonating cord receptacle 1508 contoured for retaining the detonating cord 814 in a manner to increase the locking force on the detonating cord 814 as the phasing between adjacent charge holders increases. For example, each oppositely disposed retention arm 1506 includes a shaped sidewall portion 1510 and a corresponding flange 1512 extending transversely from a top section of the retention arm 1506.

The shaped charge holder 806 may have a cage structure in which portions of the shaped charge holder 806 are configured with cage bars 1502 with cage voids 1504 between the cage bars 1502, rather than fully solid pieces. For example, the shaped charge holder 806 may be configured without solid wall elements, to increase free gun volume. The cage structure may impart a high mechanical strength while increasing the amount of free volume (without limitation, by up to 30% or more) within the housing 104 and decreasing the amount of material required to form the shaped charge holder 806. Injection molding processes may run more efficiently, and the final product given increased mechanical strength, when a single part is broken up into separate parts with their own thickness. In addition, smaller portions may have a decreased cool-down time, which may benefit injection molding production capacity.

The shaped charge holder 806 may further include one or more relay wire clips 1514 (e.g. also termed cord slots 822, in FIG. 8) extending transversely from the detonating cord receptacle 1508. The relay wire clip 1514 may be configured to hold the signal relay wire 816 as it is routed across the shaped charge holders 806. The internal gun assembly 802 may therefore provide additional flexibility in assembling the internal gun assembly 802 because each of the detonating cord 814 and the signal relay wire 816 may be connected to the shaped charge holders 806 after the detonator end assembly 810, shaped charge holders 806, and conductive end connector 808 are assembled together. For example, the detonator end assembly 810 may be provided assembled with the signal relay wire connected to the feedthrough contact plate 502 and extending out of the detonator end assembly 810, and the shaped charges 804 connected to the detonator end assembly 810, each other, and the conductive end connector 808. The signal relay wire 816 and the detonating cord 814 may then be connected to each shaped charge holder 806 as discussed above (the detonating cord 814 may first be inserted into the detonating cord channel 1004), and then inserted respectively into the relay wire slot 1002 and terminal cord retainer 902, because each connection (except for the signal relay wire connection to the feedthrough contact plate 502) is exposed for connections. Increased mechanical strength of the shaped charge holders 806 may also eliminate the need to place the shaped charges 804 in the shaped charge holders 806 before the detonating cord 814 and signal relay wire 816 are connected.

With reference to FIG. 17, FIG. 18, FIG. 19, and FIG. 20, and the exemplary embodiments shown therein, the internal gun assembly 802 is received within the gun housing 104. According to an aspect, the internal gun assembly 802 is housed within the housing 104. The centralizer 302 and the detonator holder 204 (i.e., the detonator end assembly 810) is positioned nearest the housing second end 108 (i.e., the housing detonator end 108). The tandem seal adapter 112 is connected to the housing first end 106. Fins 818 on the centralizer 302 may contact and press against the housing inner surface 1702 to lock the internal gun assembly 802 in position within the housing 104. In an aspect, the fins 818 contact a portion of the housing inner surface 1702 that is not machined and therefore has a relatively rough texture. The rough texture may aid in, e.g., preventing axial movement of the fins 818 and thereby the internal gun assembly 802. In an aspect, the ground contact plate 504 may extend to make grounding contact with the housing inner surface 1702 at a machined portion of the surface, which may be required for effective grounding contact. In an aspect, the internal gun assembly 802 may be assembled as discussed above and inserted into the housing 104 as a modular piece, locked in position by the fins 818, and therefore able to be delivered assembled and wired, to, e.g., a wellbore site, where the detonator 202 is inserted into the detonator holder 204 and electrical connections made by connecting the housing second end 108 to, without limitation, a tandem seal adapter connected to an adjacent perforating gun, as discussed further below. The centralizer alignment key 704 may be received by a centralizer key slot 1704 formed in the housing inner surface 1702, to orient the internal gun assembly 802 within the housing 104.

In the exemplary embodiments, the tandem seal adapter 112 includes a tandem seal adapter bore 1802 extending through the tandem seal adapter 112. A bulkhead 1804 is sealingly received within the tandem seal adapter bore 1802. The bulkhead 1804 includes a bulkhead body 1806 that may be in contact with an inner circumferential surface bounding the tandem seal adapter bore 1802 within the tandem seal adapter 112. The bulkhead 1804 may further include one or more sealing assemblies 1808 positioned on the bulkhead body 1806 and in contact with the inner circumferential surface and forming a seal between the bulkhead body 1806 and the inner circumferential surface. For example, as shown in the exemplary embodiment, the sealing assembly 1808 may include one or more sealing mechanisms, such as elastomeric o-rings, respectively positioned in corresponding recesses on the bulkhead body 1806 and compressed against the inner circumferential surface. The sealing assembly 1808 may alone, or in combination with the bulkhead body 1806, seal the tandem seal adapter bore 1802, to isolate the interior of the housing 104 from, e.g., pressure or fluid from an interior of an adjacent, connected perforating gun housing. In addition, sealing assemblies 1808 on the tandem seal adapter 112 may create a seal against the housing inner surface 1702 at the housing first end 106, to seal the interior of the housing 104 from, e.g., wellbore fluid or other materials in the environment outside of the housing 104.

Figure 19:
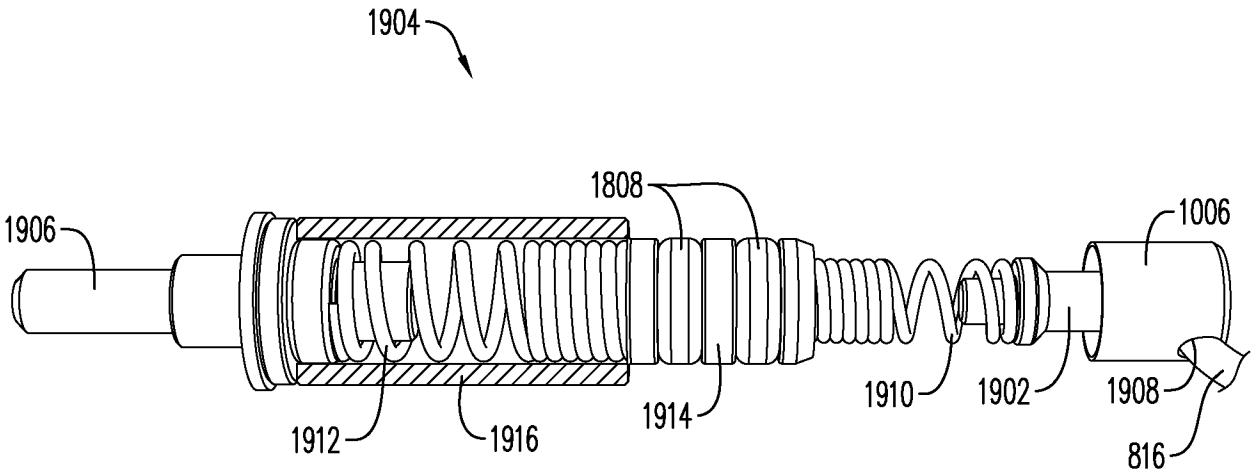
FIG. 19 is a side view an exemplary embodiment of a bulkhead electrical feedthrough in accordance with an aspect of the disclosure.
Figure 20:
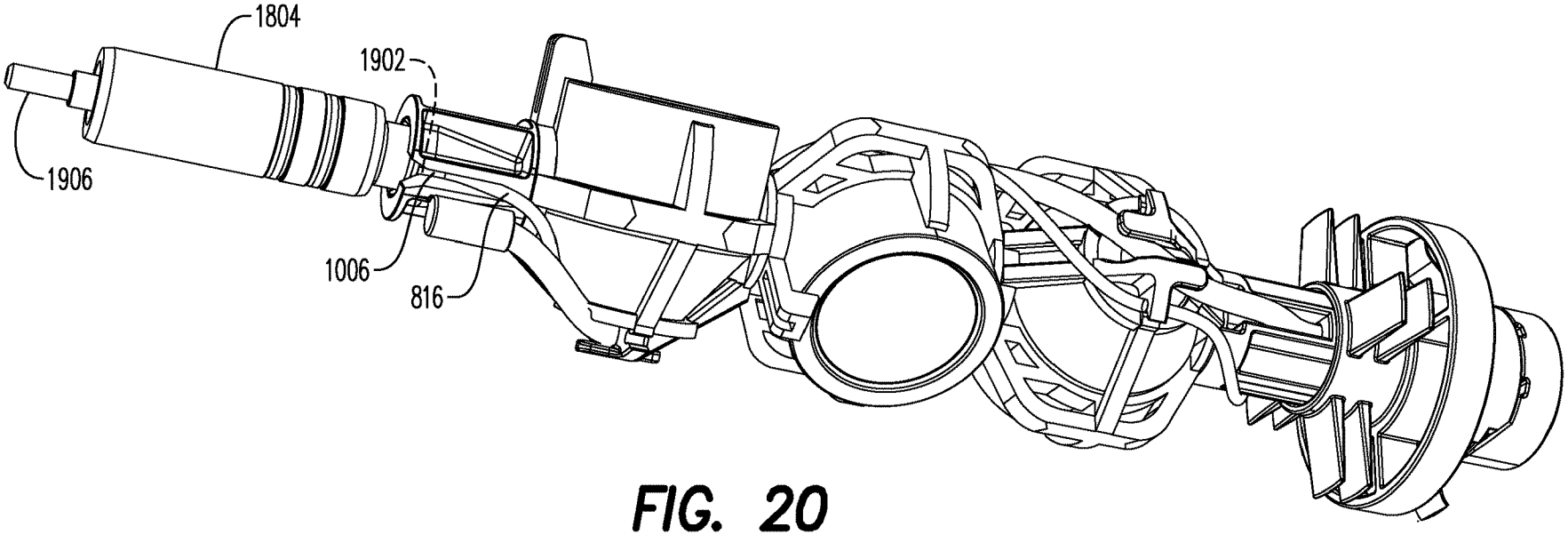
FIG. 20 is a perspective view of an exemplary embodiment of an internal gun assembly and a bulkhead in accordance with an aspect of the disclosure.

The bulkhead body 1806 houses at least a portion of a bulkhead electrical feedthrough 1904 for relaying electrical signals, such as an addressable detonation signal, a diagnostic signal, and the like, between respective electrical connections in adjacent perforating guns. The bulkhead electrical feedthrough 1904 may include, for example and as illustrated in FIG. 19, a first pin connector 1902 and a second pin connector 1906. The first pin connector 1902 may be positioned and dimensioned (i.e., configured) such that when the tandem seal adapter 112 is connected to the housing 104, the first pin connector 1902 is automatically placed in electrical contact with the conductive end contact 1006, at an end of the first pin connector 1902. The conductive end contact 1006 and/or the first pin connector 1902 may be in electrical contact with the signal relay wire 816 which may be inserted into a connecting hole 1908 on the conductive end contact 1006 or otherwise in electrical contact therewith, by known techniques. The second pin connector 1906 may be in electrical contact with an electrical connector in an adjacent perforating gun 102, as described below, at an end of the second pin connector.

FIG. 19 shows an interior of the bulkhead body 1806. The bulkhead electrical feedthrough 1904 may further include a first spring connector 1910 biasing the first pin connector 1902 towards the conductive end contact 1006. The first spring connector 1910 may be conductive and relay a signal from the first pin connector 1902 to a first intermediate conductive body 1914 within the bulkhead body 1806, and the first intermediate conductive body 1914 may be electrically connected to, or integrally formed with, a second intermediate conductive body 1916. Positioned adjacent to and in contact with the first intermediate conductive body 1916, and within the second intermediate conductive body 1916, may be a second spring connector 1912 biasing the second pin connector 1906 in a direction opposite the first pin connector 1902. The second spring connector 1912 is similarly conductive such that the first pin connector 1902 and the second pin connector 1906 are in electrical communication. In other embodiments, a solid piece of conductive metal may connect the first pin connector 1902 and the second pin connector 1906. In still other embodiments, the second intermediate conductive body 1916 may provide the electrical connection between the first pin connector 1902 and the second pin connector 1906. In embodiments in which the bulkhead electrical feedthrough 1904 includes a solid piece of conductive metal forming the first pin connector 1902, the second pin connector 1906, and an intermediate body, electrical contacts with which the pin connectors 1902, 1906 are in electrical contact within the perforating gun housings may be spring loaded.

In an aspect, the tandem seal adapter 112, bulkhead 1804, detonator holder 204, and detonator 202 are collectively configured and positioned such that when the tandem seal adapter 112 is connected to a housing detonator end 108 of an adjacent housing, the second pin connector 1906 of the bulkhead electrical feedthrough 1904 automatically makes wireless electrical contact with a line-in contact of the detonator 202. The detonator line-in contact receives the electrical signal that is relayed from the conductive end connector 808, through the bulkhead electrical feedthrough 1904.

Features and functions of the tandem seal adapter 112 and the bulkhead 1804 may be according to those disclosed in U.S. Pat. No. 10,844,697 issued Nov. 24, 2020, which is commonly owned by DynaEnergetics Europe GmbH and incorporated by reference herein, to the extent not incompatible and/or inconsistent with this disclosure.

Figure 21:
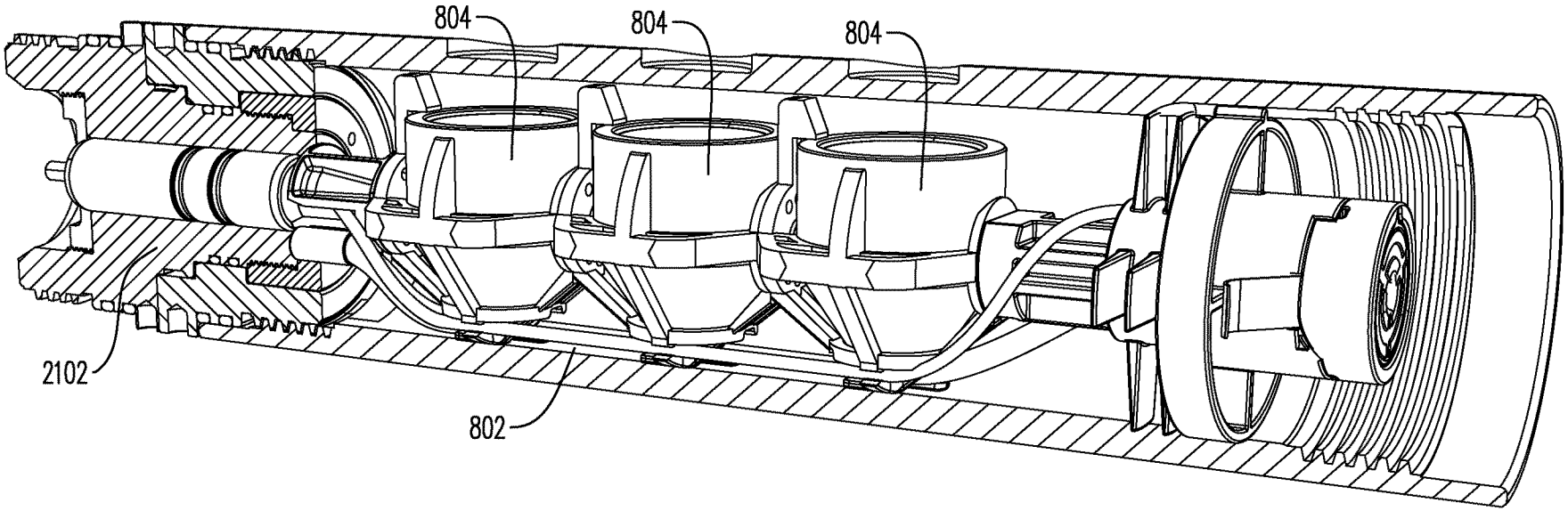
FIG. 21 is a perspective cutaway view of an exemplary embodiment of a modular platform perforating gun system according to an aspect of the disclosure.

FIG. 21 shows a modular platform perforating gun system according to the exemplary embodiments, in this case implemented with an alignment sub 2102 that functions according to the general principles of the exemplary tandem seal adapter 112 discussed above but also allows for adjacent housings to be oriented with respect to one another. In the exemplary embodiment shown in FIG. 21, each of the shaped charges 804 of the internal gun assembly 802 is pointing in the same direction, representing a zero-degree phasing.

Figure 22:
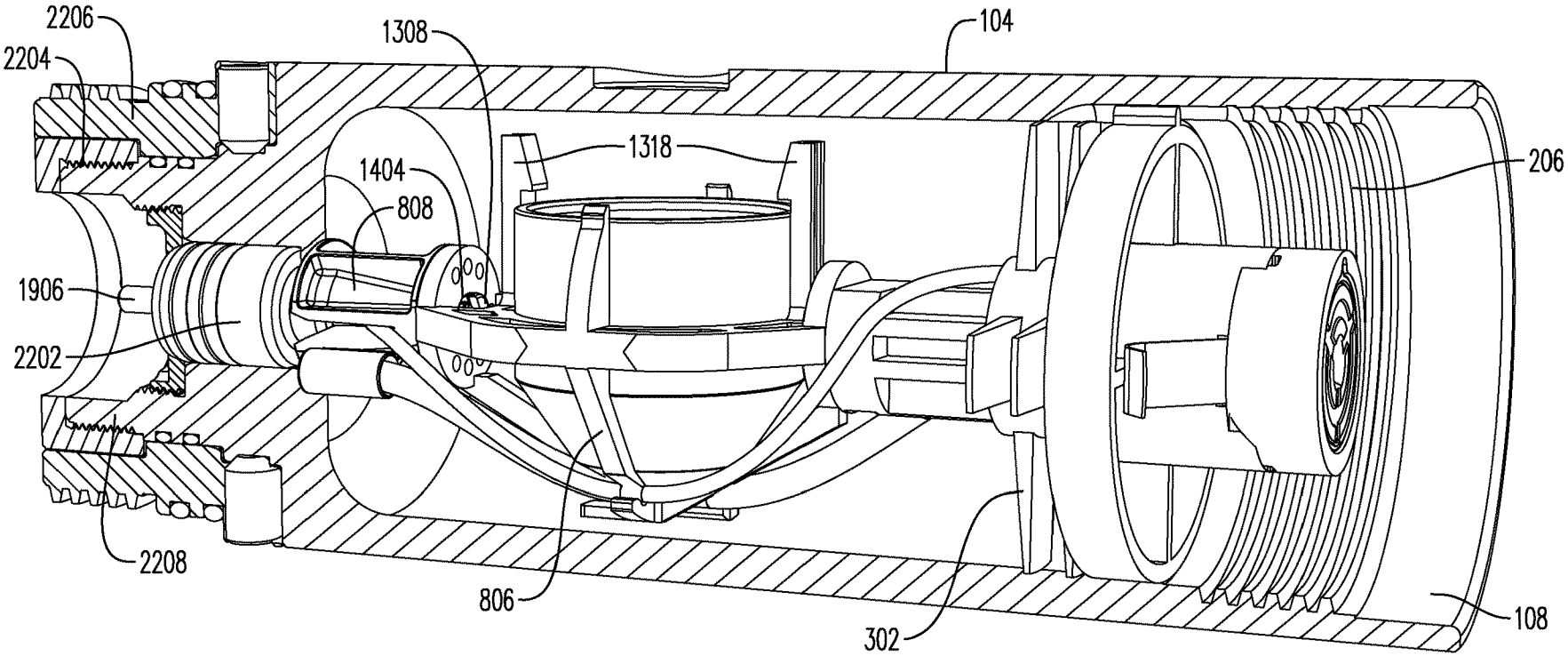
FIG. 22 is a perspective cutaway view of an exemplary embodiment of a modular platform perforating gun system according to an aspect of the disclosure.

FIG. 22 shows a modular perforating gun platform system according to the exemplary embodiments applied to a perforating gun having single shaped charge holder 806 positioned within a housing 104 including a housing detonator end 108 with internal threads 206 and a housing male end 2208 including external threads 2204 for connecting to an alignment sub 2206. The centralizer 302 and shaped charge holder 806 are green to indicate that the housing is a 2¾" housing 104*c*. In the exemplary embodiment shown in FIG. 22, a shortened bulkhead 2202 is used. The shortened bulkhead 2202 may be shorter in an axial direction but otherwise similar in form and function to the bulkhead 1804 discussed above. The shortened bulkhead 2202 includes a bulkhead electrical feedthrough including, among other things, second pin connector 1906. The shortened bulkhead 2202 may be used where, e.g., the perforating gun design including a tandem seal adapter or sub is dimensioned for a bulkhead with a shorter axial length than the exemplary bulkhead 1804 discussed with respect to, e.g., FIG. 17 and FIG. 18.

In an aspect, the shaped charge holder 806 includes two retention tabs 1318 for retaining a shaped charge in the shaped charge holder 806.

FIG. 22 further shows how, in an aspect, conductive end connector 808 includes a knob connector 1308 for connecting the conductive end connector 808 to the central bore 1404 of the shaped charge holder female connecting side 1402, and thereby the shaped charge holder 806.

Figure 23:
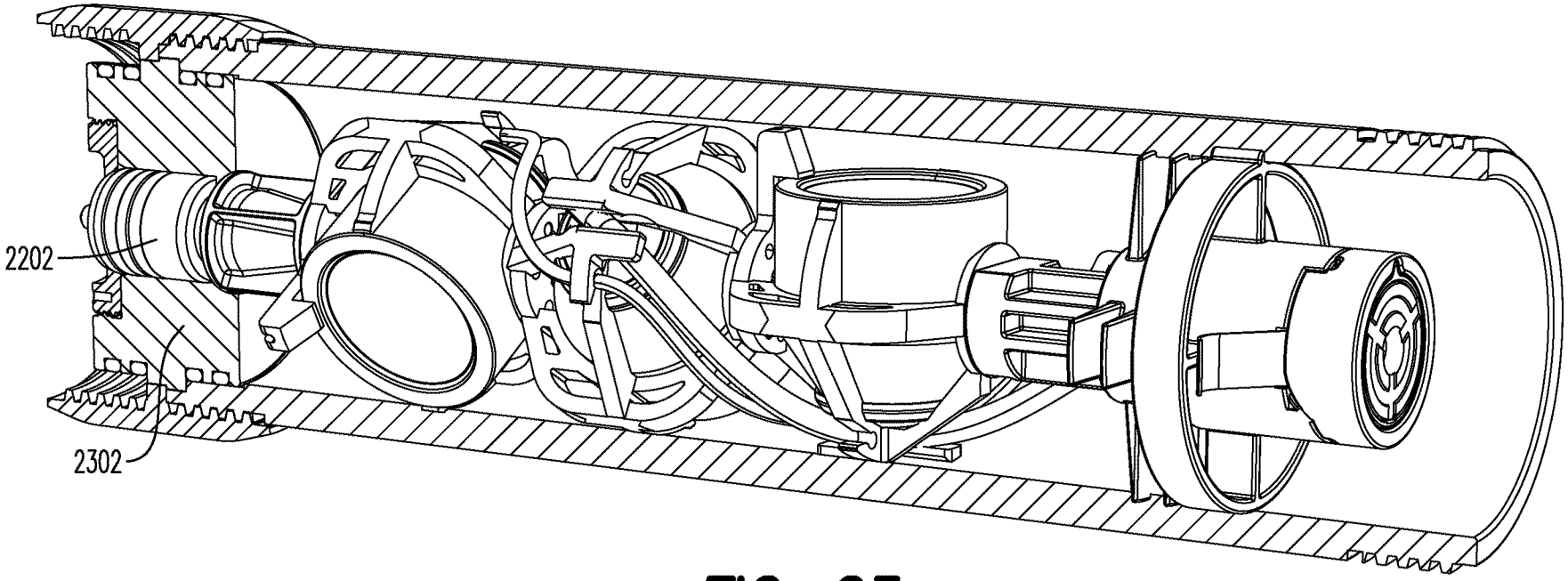
FIG. 23 is a perspective cutaway view of an exemplary embodiment of a modular platform perforating gun system according to an aspect of the disclosure.
Figure 24:
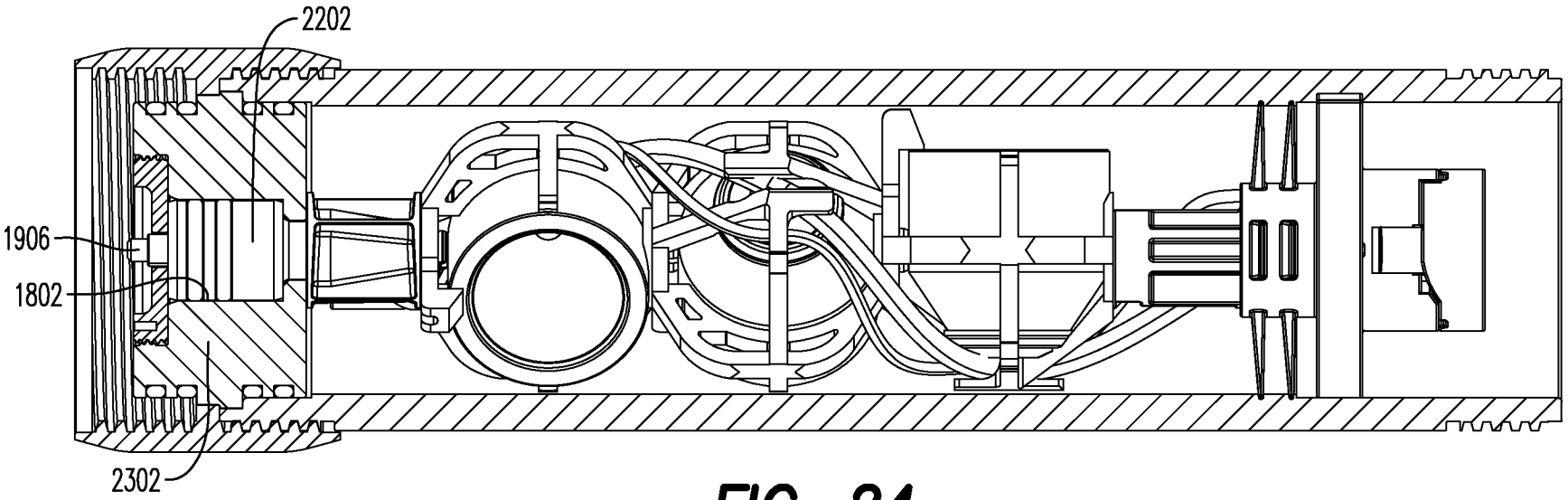
FIG. 24 is a side cutaway view of the exemplary embodiment of a modular platform perforating gun system shown in FIG. 23.

With reference to FIG. 23 and FIG. 24, the exemplary modular perforating gun platform system is shown applied to a perforating gun having a two-piece tandem seal adapter 2302. In an aspect, the exemplary embodiment of FIG. 23 and FIG. 24 also includes the shortened bulkhead 2202 with bulkhead electrical feedthrough including second pin connector 1906.

Figure 25:
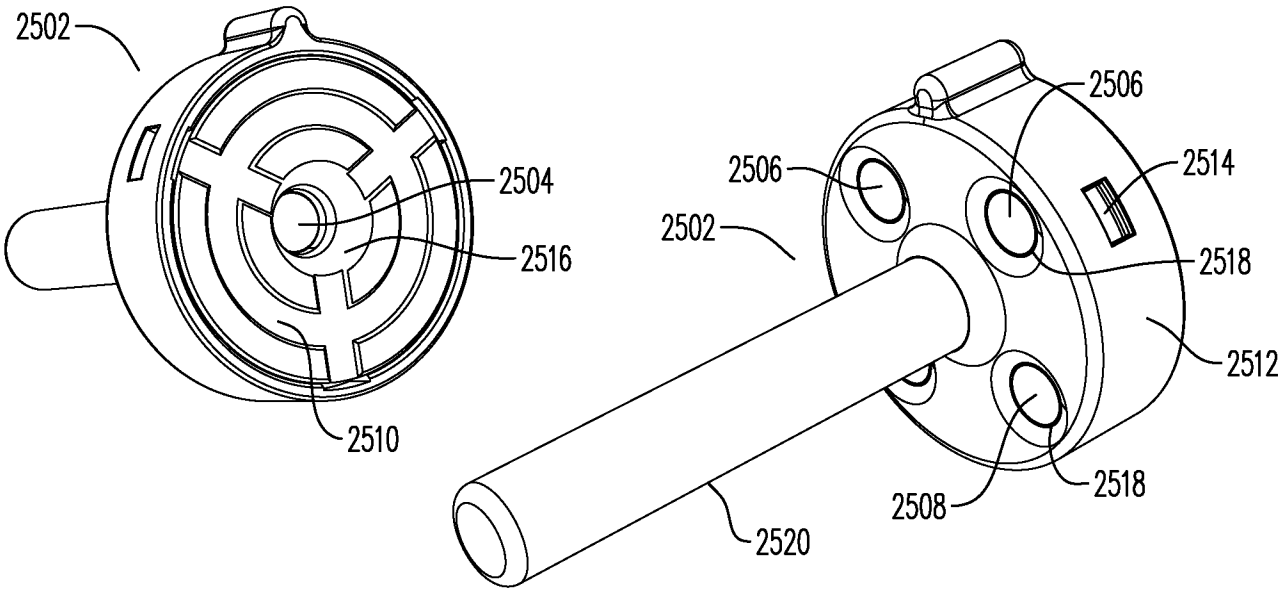
FIG. 25 shows perspective views of an exemplary embodiment of a detonator according to an aspect of the disclosure.
Figure 26:
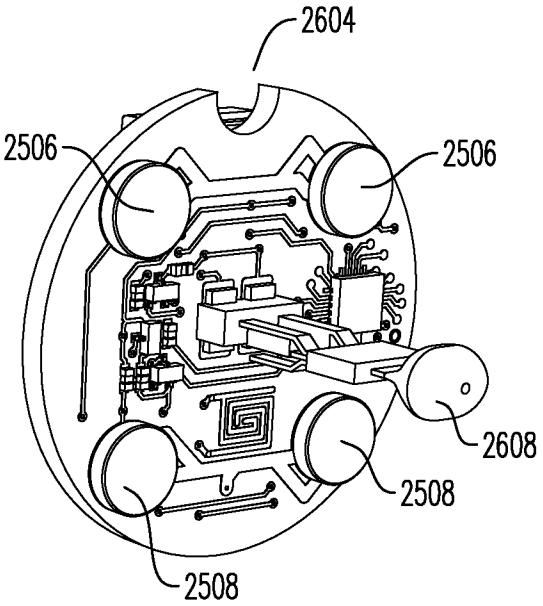
FIGS. 26 and 27 are perspective views of an exemplary embodiment of an initiator head according to an aspect of the disclosure.
Figure 26:
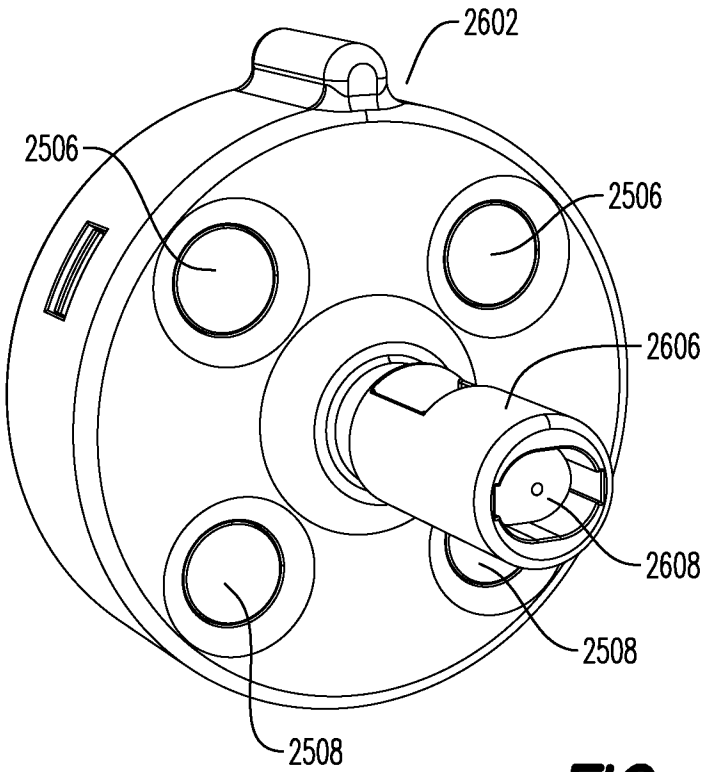
Figure 27:
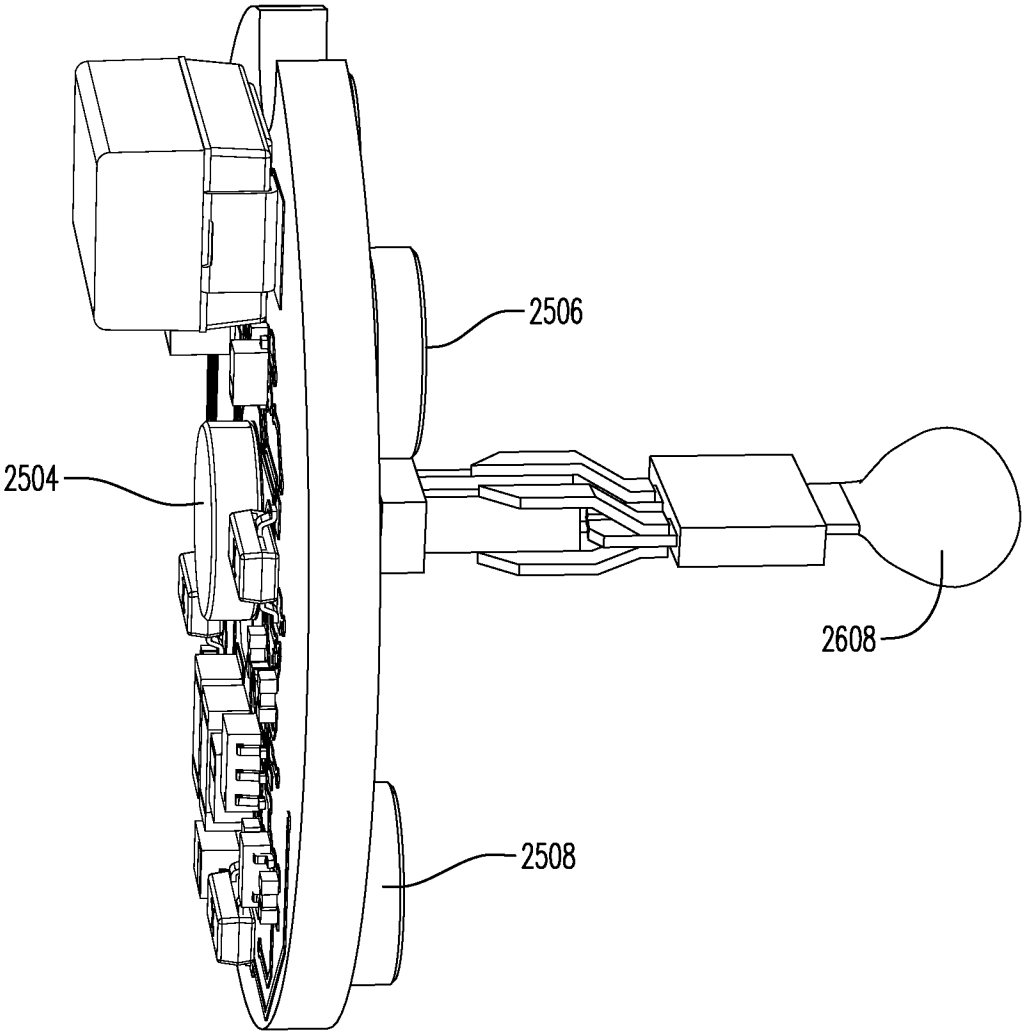

With reference to FIG. 25, FIG. 26, and FIG. 27, an exemplary embodiment of a detonator 202, such as an orienting detonator, for use with the exemplary modular platform perforating gun system is shown. FIG. 25 and FIG. 26 show, among other things, an exemplary embodiment of an initiator head 2502. The initiator head may include an initiator head housing 2602, a circuit board 2604, a line-in terminal 2504, a feedthrough (or, "line-out") terminal 2506, a ground terminal 2508, an initiator stem 2606, and a fuse 2608.

The initiator head housing 2602 may be formed of an insulating material, by, e.g., molding, 3D-printing, additive manufacturing, subtractive manufacturing, or any other suitable method. The initiator head housing 2602 may include a first housing piece 2510 and a second housing piece 2512 engaged together by a latch 2514. The initiator head housing 2602 may define an interior space within the first housing piece 2510 and the second housing piece 2512 within which the circuit board 2604 is positioned. Alternatively, the initiator head housing 2602 may be an integral or monolithic piece molded or additively manufactured around the circuit board 2604.

A through hole 2516 in the first housing piece 2510 may be structured to expose the line-in terminal 2504 to an exterior of the initiator head housing 2502. The second housing piece 2512 may include contact through holes 2518 structured to expose the feedthrough terminals 2506 and the ground terminals 2508 to an exterior of the initiator head housing 2502. The line-in terminal 2504, the feedthrough terminals 2506, the ground terminals 2508, and the fuse 2608 may be in electrical communication with the circuit board 2604. The line-in terminal 2504 may be provided on an opposite side of the circuit board 2604 from the feedthrough terminals 2506 and the ground terminals 2508. The circuit board 2604 may further include surface mounted components such as a temperature sensor, an orientation sensor, a safety circuit, a capacitor, and the like. Readings from one of these components may be used by a microprocessor on the circuit board 2604 to determine when it is appropriate to activate the fuse 2608 to detonate the detonator 202.

The fuse 2608 may be positioned within a hollow interior of the initiator stem 2606. The initiator stem 2606 may be received within a hollow initiator shell 2520 and crimped therein. The detonator explosive portion 1104 may be an explosive load positioned within the hollow initiator shell 2520 and configured for initiation by the fuse 2608. With reference back to FIG. 11, the hollow initiator shell 2520 is received within the detonator bore 1106, when the detonator 202 is inserted into the detonator holder 204. The detonator bore 1106, hollow initiator shell 2520, initiator head housing 2602, and detonator holder cap 516 are together configured for the initiator head housing 2602 to be received in the detonator holder cap 516 when the detonator 202 is inserted into the detonator holder 204, including when the hollow initiator shell 2520 is pushed into the detonator bore 1106. Upon inserting the detonator 202 into the detonator holder 204, feedthrough terminals 2506 and ground terminals 2508 are respectively positioned for automatically making wireless electrical contact with the feedthrough contact pins 604 and the ground contact pins 602.

Accordingly, as discussed above, when, e.g., a pin connector such as second pin connector 1906 from a bulkhead electrical feedthrough 1904 makes wireless electrical contact with the line-in terminal 2504, an electrical signal from the bulkhead electrical feedthrough 1904 may be relayed to the circuit board 2604 which may, e.g., detonate the detonator 202 and/or relay the signal, via the feedthrough terminal(s) 2506, feedthrough contact plate 502, signal relay wire 816, and conductive end contact 1006, to a next bulkhead or electrical feedthrough assembly.

With reference to FIGS. 28-42B, exemplary embodiments of a perforating gun system are shown, which are applicable to an orienting perforating gun system 2814 in which the orientation of one or more shaped charges within a housing 104*c* may be set, for example by gravity. The configuration of the orienting perforation gun system 2814 may allow for everything (e.g. the one or more shaped charges, as well as the detonator and/or the detonator holder, and in some embodiments an eccentric weight) between the two bulkheads to rotate. Features of the exemplary embodiments shown in FIGS. 28-42B that are common to the exemplary embodiments discussed throughout this disclosure are not repeated here.

Exemplary embodiments of a modular perforating gun system will now be introduced according to FIGS. 28-35. The exemplary embodiments according to FIGS. 28-35 are illustrative and not limiting, and exemplary features may be referenced throughout this disclosure. As shown in FIGS. 28-35, an exemplary perforating gun assembly 2814 includes a housing 104*c* (which may be similar to housing 104, 104*a*, and/or 104*b*) and an orienting internal assembly 3202. The housing 104*c* has a longitudinal bore, and the orienting internal assembly 3202 may be configured to be disposed within the longitudinal bore of the housing 104*c*. In some embodiments, the orienting internal assembly 3202 may be configured to allow gravitational orientation of the orienting internal assembly 3202 within the housing 104*c*.

Figure 28:
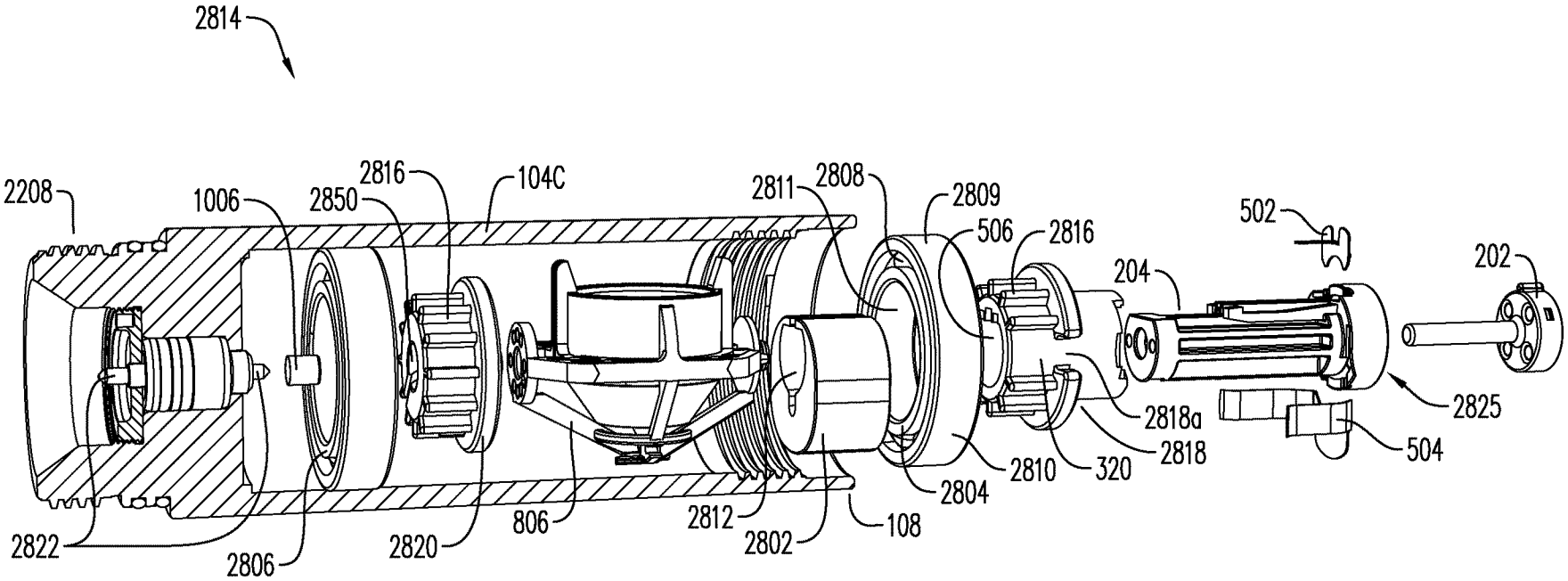
FIG. 28 is a perspective exploded cutaway view of an exemplary embodiment of a modular platform perforating gun system according to an aspect of the disclosure.
Figure 31:
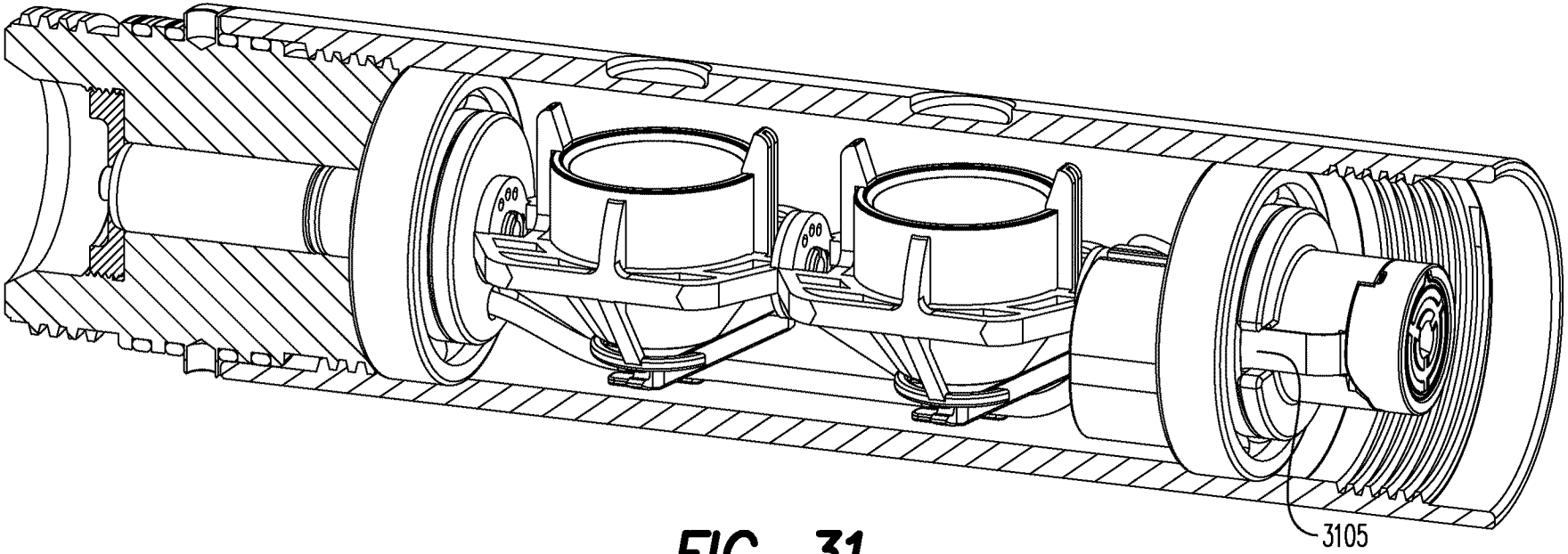
FIG. 31 is a perspective cutaway view of an exemplary embodiment of a modular platform perforating gun system according to an aspect of the disclosure.
Figure 32A:
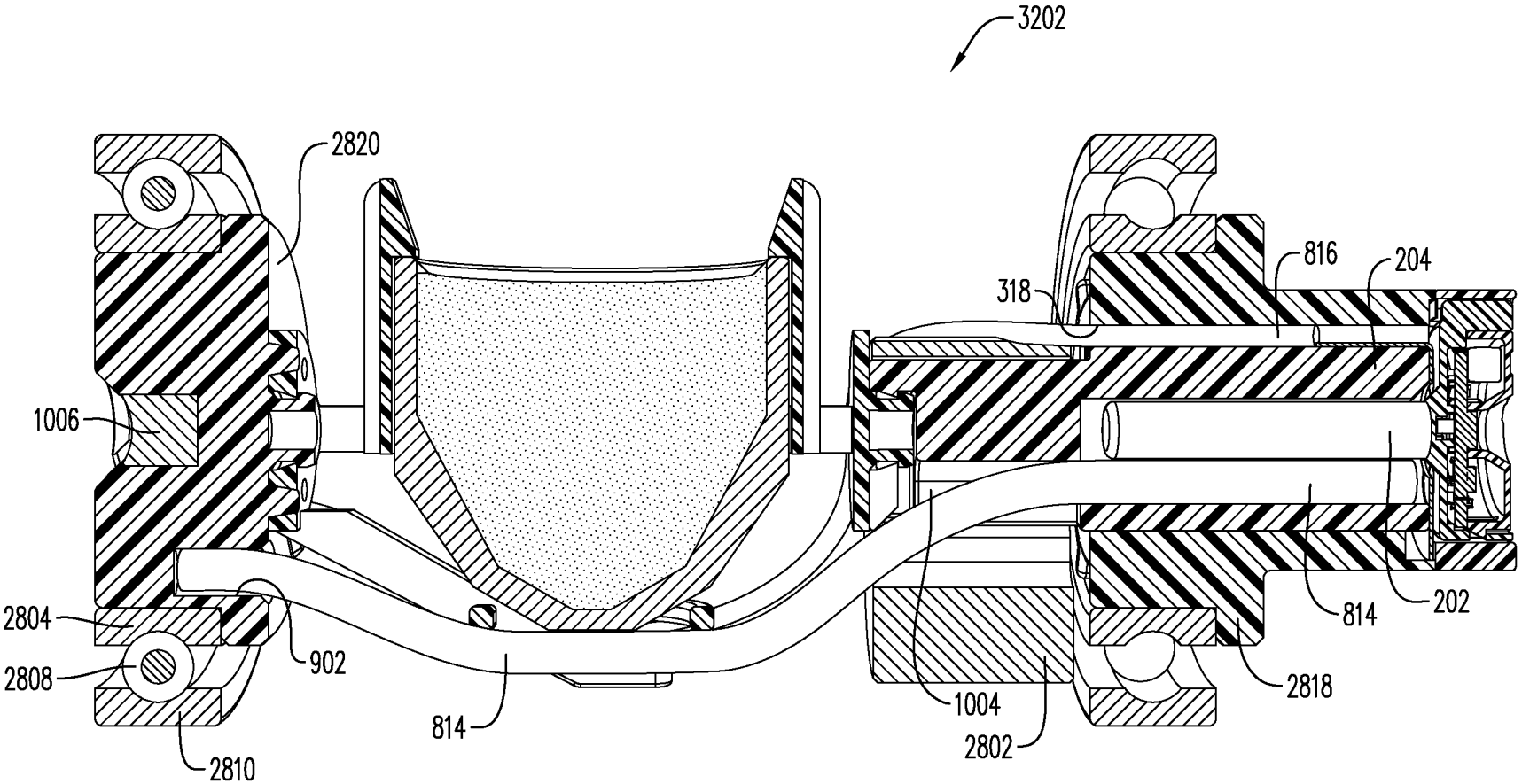
FIG. 32A is a cross-sectional view of an exemplary embodiment of a modular platform perforating gun system according to an aspect of the disclosure.
Figure 32B:
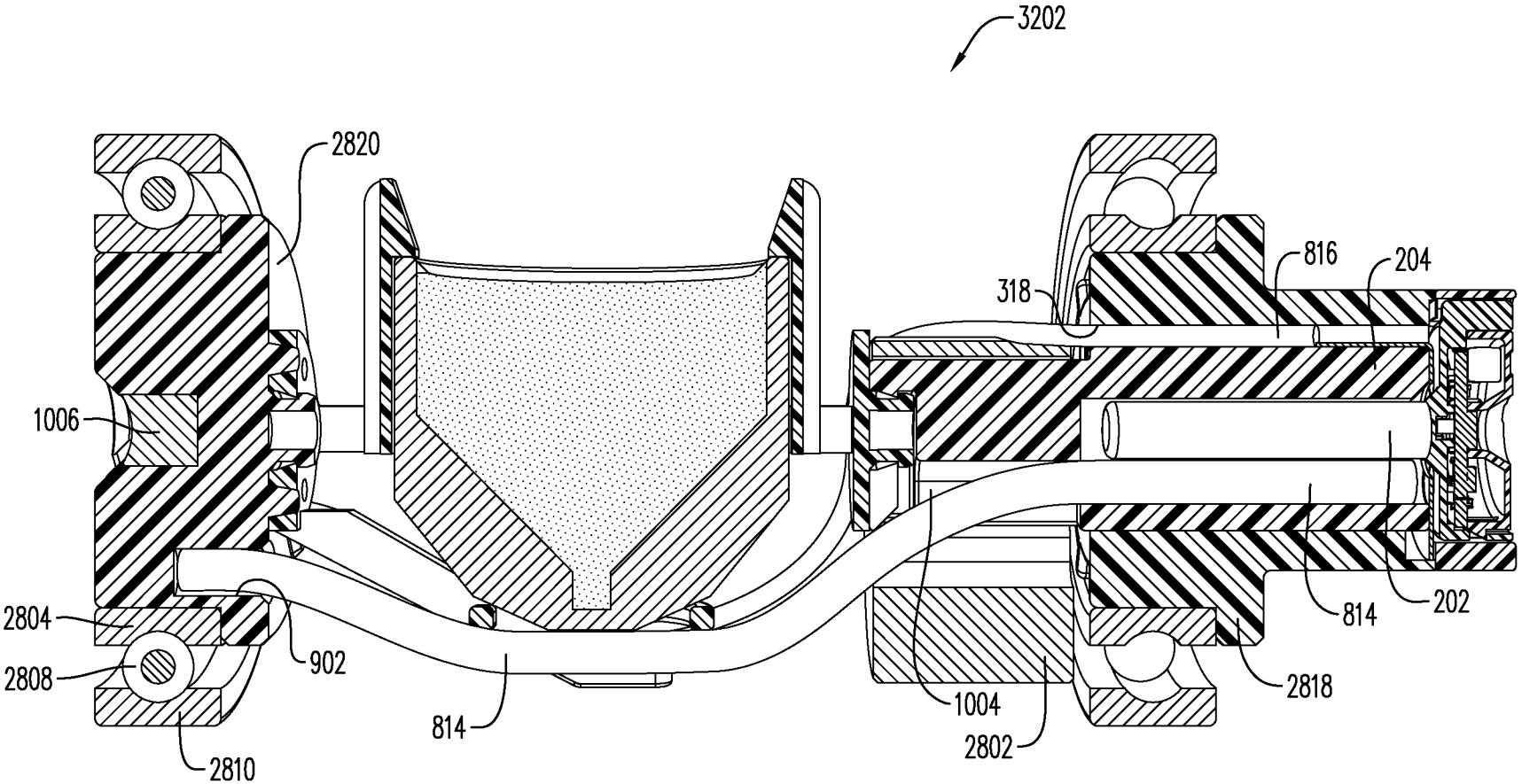
FIG. 32B is a cross-sectional view of an exemplary embodiment of a modular platform perforating gun system according to an aspect of the disclosure.
Figure 33:
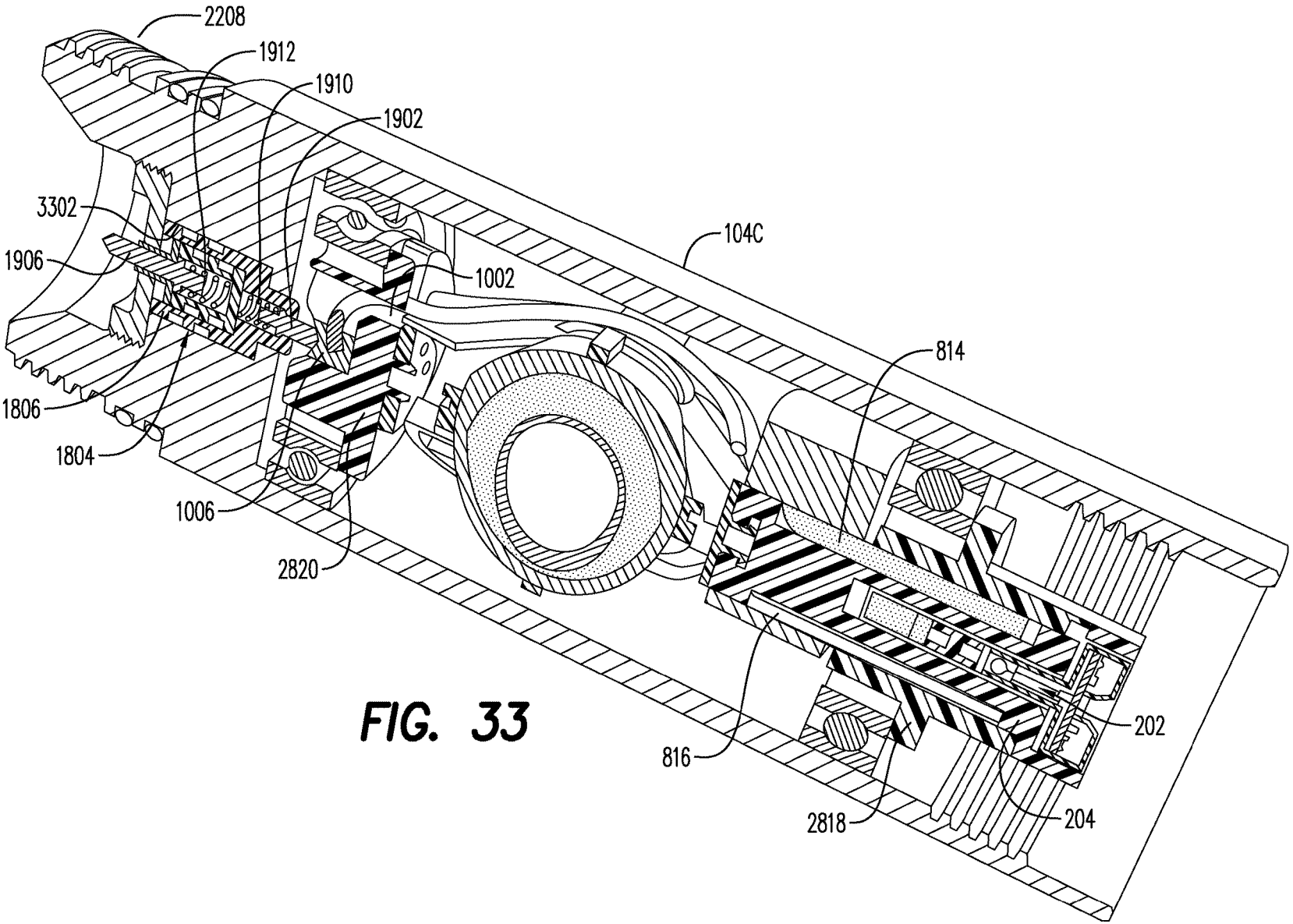
FIG. 33 is a cross-sectional view of an exemplary embodiment of a modular platform perforating gun system according to an aspect of the disclosure.

For example, the orienting internal assembly 3202 may include at least one shaped charge holder 806, at least one bearing assembly (for example as shown in FIG. 28, two bearing assemblies 2806, 2810), and an eccentric weight 2802. FIGS. 28 and 32 illustrate an orienting internal assembly 3202 having only one shaped charge holder 806, while FIG. 31 illustrates an exemplary orienting internal assembly 3202 having a plurality of shaped charge holders 806 (e.g. all of which may be rotationally fixed together, so as to rotate as a whole). The at least one shaped charge holder 806 and the eccentric weight 2802 may be configured to rotate as a whole, for example being rotationally fixed together. In some embodiments, the eccentric weight 2802 has a center of gravity configured to be offset from the longitudinal axis of the housing and/or offset from the central axis of the bearing assemblies 2806, 2810. The configuration of the at least one shaped charge holder 806 and the eccentric weight 2802 to rotate as a whole may encourage or enable gravitational orientation of the at least one shaped charge holder 806, for example with the eccentric weight 2802 being configured to rotate under the influence of gravity (especially in a non-vertical well). For example, in a non-vertical well, the eccentric weight 2802 may be drawn and/or rotate towards the bottom of the wellbore (e.g. downward and/or away from the surface), which would in turn rotate the at least one shaped charge holder 806. As shown in FIGS. 28-36 for example, a detonator holder 204 may be connected to the shaped charge holder 806 as previously described. The eccentric weight 2802 may be connected to a portion of the detonator holder stem 514 adjacent the shaped charge holder 806. The detonator holder 204 receives a detonator 202 as previously discussed. Accordingly, the detonator 202, the at least one shaped charge holder 806, and the detonator holder 204 are configured to rotate as a whole (e.g., rotationally fixed together) with the eccentric weight 2802.

In some embodiments, the two bearing assemblies 2806, 2810 may be coaxial and spaced apart. In some embodiments, the at least one bearing assembly (e.g. the two bearing assemblies 2806, 2810) may be configured to interact with the at least one shaped charge holder 806, the eccentric weight 2802, and the detonator holder 204, for example to allow rotation as a whole about a central axis (e.g. of the two bearing assemblies 2806, 2810.) In some embodiments, the two bearing assemblies 2806, 2810 may be identical. In some embodiments, each of the two bearing assemblies 2806, 2810 may be disposed within and contact the housing 104*c*. For example, the exterior of the bearing assemblies 2806, 2810 may directly contact the inner surface of the longitudinal bore of the housing 104*c* (as discussed further below), without any interposing element. In some embodiments, there may be no non-conductive interposing element between the bearing assemblies 2806, 2810 and the housing 104*c*. In some embodiments, the two bearing assemblies 2806, 2810 may be fixed within the bore of the housing 104*c*, for example by friction fit against a rough or unmachined portion of the inner surface of the housing 104*c*. In some embodiments, the bearing assemblies may be fixed within the bore of the housing 104*c* via a smooth surface finish, for example at a stepped-down portion of the bore. For example, the inner surface of the housing 104*c* may generally be rough, but the contact area may be a stepped-down machined version of the inner diameter to ensure a clean surface contact. In some embodiments, a latch system could be used for fixing, for example a safety-clip could be clicked into a grove to fix the bearing assemblies in place. In some embodiments, the two bearing assemblies 2806, 2810 are configured to hold the at least one shaped charge holder 806, the eccentric weight 2802, and the detonator holder 204 (as discussed further below), within the longitudinal bore of the housing 104*c*, away from the inner surface of the housing 104*c* (e.g. so that they are free to rotate within the bore without contacting the inner surface of the housing 104*c*).

According to the exemplary embodiments shown in FIGS. 28-35, each of the two bearing assemblies 2806, 2810 includes an outer bearing ring 2809, an inner bearing ring 2804, and a plurality of bearings 2808 disposed between the outer bearing ring 2809 and the inner bearing ring 2804. In some embodiments, for each of the two bearing assemblies 2806, 2810, the inner bearing ring 2804 and outer bearing ring 2809 may be concentric and coaxial, and the bearings 2808 may be configured to allow rotation of the inner bearing ring 2804 about the central axis within the outer bearing ring 2809. In some embodiments, the outer bearing ring 2809 of each of the two bearing assemblies 2806, 2810 is configured to fit within and contact the inner surface of the longitudinal bore of the housing 104*c*. For example, the outer surface of each outer bearing ring 2809 is configured to contact the inner surface of the longitudinal bore (e.g. with no interposing element therebetween). In some embodiments, the two outer bearing rings 2809 work together to align the central axis of the bearing assemblies 2806, 2810 with the longitudinal axis of the housing 104*c*. The inner bearing ring 2804, the bearings 2808, and the outer bearing ring 2809 typically are all formed of a conductive material, such as a conductive metal (e.g. steel). In some embodiments, a conductive electrical path, for example for grounding, may exist from the inner bearing ring 2804, through the bearings 2808 and the outer bearing ring 2809, to the housing 104*c*, for at least the bearing assembly 2810 coupled to the detonator holder 204 as discussed further below. In some embodiments, the outer diameter of each outer bearing ring 2809 may be approximately the same (e.g. allowing for clearance for insertion) as the inner diameter of the longitudinal bore. In some embodiments, the outer bearing ring 2809 of each of the two bearing assemblies 2806, 2810 may be directly affixed to the inner bore of the housing 104*c*.

In some embodiments, the at least one shaped charge holder 806 and the inner bearing ring 2804 of each of the two bearing assemblies 2806, 2810 may be configured to rotate as a whole. For example, the at least one shaped charge holder 806 may be rotationally fixed to the inner bearing ring 2804 of each of the two bearing assemblies 2806, 2810. In some embodiments, the eccentric weight 2802 may be configured to rotate as a whole with the inner bearing rings 2804 of the two bearing assemblies 2806, 2810. In some embodiments, the detonator holder 204 and/or the detonator 202 may be configured to rotate as a whole with the inner bearing ring 2804 of the first of the two bearing rings. In some embodiments, the eccentric weight 2802, the at least one shaped charge holder 806, the detonator holder 204, and the inner bearing ring 2804 of the first of the two bearing assemblies 2806, 2810 all are configured and/or attached/coupled to rotate as a whole (e.g. within the outer bearing ring 2809 of the two bearing assemblies 2806, 2810).

In some embodiments, the at least one shaped charge holder 806 may be disposed between the two bearing assemblies 2806, 2810. In some embodiments, the eccentric weight 2802 may be disposed between the two bearing assemblies 2806, 2810. In some embodiments, at least a portion of the detonator holder 204 and/or detonator 202 may be disposed within and/or project through the inner bearing ring 2804 of a first 2810 of the two bearing assemblies 2806, 2810 (e.g. within a central opening 2811 of the inner bearing ring and/or the bearing assembly). In some embodiments, a portion of the detonator holder 204 and/or detonator 202 may not be disposed between the two bearing assemblies 2806, 2810. For example, the first 2810 of the two bearing assemblies may be disposed between at least a portion of the detonator holder 204 (and/or the detonator 202) and the at least one shaped charge holder 806. In some embodiments, the at least one shaped charge holder 806 may be disposed along the longitudinal axis of the housing 104*c* and/or the central axis of the bearing assemblies 2806, 2810. In some embodiments, the detonator holder 204 and/or detonator 202 may be disposed along and/or extend longitudinally along the longitudinal axis of the housing 104*c* and/or the central axis of the two bearing assemblies 2806, 2810.

In some embodiments, the detonator holder 204 is configured to receive a detonator 202. For example, the detonator holder 204 may include a detonator seat 2825 (e.g. opening) configured to receive a detonator 202 and/or an outer surface configured to rotationally fix to an adapter 2818 for fixedly attaching to the rotatable inner bearing ring 2804 of the first of the two bearing assemblies 2806, 2810, so that the detonator holder 204 rotates as a whole with the inner bearing ring 2804 (e.g. to engage an inner surface of the inner bearing ring 2804 via the adapter 2818 to rotationally couple the detonator holder 204 to the inner bearing ring 2804, and thereby to the at least one shaped charge holder 806). In some embodiments, the detonator seat 2825 (e.g. configured to receive the detonator initiator head 2502 portion) may extend longitudinally along the central axis. In some embodiments, engagement of the detonator holder 204 (e.g. via the adapter 2818) within the inner bearing ring 2804 fully supports the detonator holder 204 for rotation about the central axis. In some embodiments, the detonator holder 204 is only supported by engagement within the inner bearing ring 2804. In some embodiments, the detonator holder 204 further includes a detonator holder stem 514 configured to extend longitudinally along the longitudinal axis and through the central opening 2811 of the first of the two bearing assemblies 2806, 2810, and to fixedly attach to a shaped charge holder 806. For example, the detonator holder stem 514 (e.g. with the detonator bore 1106 for receiving the detonator shell 2520) may extend longitudinally away from the detonator seat 2825, extending through the central opening 2811 of the inner bearing ring 2804 of the first bearing assembly 2810 towards the at least one shaped charge holder 806. In some embodiments, the detonator adapter 2818 may include an outer surface configured to fix the detonator holder 204 to the inner bearing ring 2804 of the first 2810 of the two bearing assemblies. In some embodiments, the detonator adapter 2818 may be similar to the centralizer 302 described above, except configured to fit within the inner ring of the first bearing assembly 2810 and/or having blade elements (e.g. centralizer blades 2816 described further below) for contacting the inner surface of the inner bearing ring 2804. In some embodiments, the first 2810 of the two bearing assemblies may be disposed between the detonator seat 2825 opening and the at least one shaped charge holder 806, and the detonator holder stem 514 may extend through the central opening 2811 of the first 2810 of the two bearing assemblies to be rotationally fixed to the at least one shaped charge holder 806. In some embodiments, the detonator adapter 2818 may include or be a centralizer (e.g. similar to those described throughout this application) configured to fit within and contact an inner surface of the inner bearing ring 2804. In some embodiments, the centralizer may include a plurality of the blade elements configured to contact the inner bearing ring 2804 and to rotationally fix the centralizer (and thereby the detonator holder 204 and/or the detonator 202) within the inner bearing ring 2804. In some embodiments, the outer surface of the detonator adapter 2818 may frictionally engage with the inner surface of the inner bearing ring 2804. In some embodiments, the outer surface of the detonator adapter 2818 may include the plurality of blade elements. In some embodiments, the blade elements may be configured to interact with key grooves (not shown here) on the inner surface of the inner bearing ring 2804.

In some embodiments, a standard size detonator 202 may be used, regardless of the size of the housing 104*c* and/or the inner bearing ring 2804, and the detonator holder 204 and/or detonator adapter 2818 may be adapted to fix the detonator 202 within the inner ring 2804 of the first 2810 of the two bearing assemblies. So for example, different size detonator adapters 2818 may be used depending on the sizing of the inner bearing ring 2804 used in a specific sized housing 104*c*. In some embodiments, a standard size detonator holder 204 may be used, regardless of the size of the longitudinal bore of the housing 104*c* and/or the inner bearing ring 2804, and an appropriately sized detonator adapter 2818 (e.g. similar to the centralizer 302) may allow for the detonator holder 204 to be securely seated and/or fixed in the central opening 2811 of the inner bearing ring 2804. In some embodiments, the detonator adapter 2818 may comprise the blade elements configured to contact the inner surface of the inner bearing ring 2804. In some embodiments, the detonator holder 204 may have an exterior configured to interact directly with the inner bearing ring 2810, with no need for a separate adapter (e.g. the detonator holder exterior may effectively incorporate the adapter and/or the adapter may be integral to the detonator holder). In some embodiments, for example when the detonator 202 itself is configured to fit within and rotationally fix directly to the inner bearing ring 2804 of the first of the two bearing assemblies 2806, 2810 or the adapter 2818, the exterior surface of the detonator 202 may form or serve as the detonator holder 204 and/or the detonator adapter (e.g. the detonator holder 204 and/or detonator adapter 2818 may be integral to the detonator 202 itself).

In some embodiments, the eccentric weight 2802 may be fixedly coupled to the at least one charge holder 806 in proximity to the longitudinal axis of the housing and/or the central axis of the bearing assemblies 2806, 2810 (although in other embodiments, that coupling connection may be radially offset). In some embodiments, the eccentric weight 2802 may be mounted on the stem 514 of the detonator holder 204 (e.g. in fixed rotational relationship), and the detonator holder 204 may be fixed to the shaped charge holder 806. In some embodiments, the eccentric weight 2802 may have a channel 2812 configured for passage of the stem 514 of the detonator holder 204, allowing the stem 514 to pass through the eccentric weight 2802 and to fixedly attach to the at least one shaped charge holder. In some embodiments, the interaction between the stem 514 and the channel 2812 of the eccentric weight 2802 fixes the position of the eccentric weight 2802 with respect to the detonator holder 204. For example, complementary geometries between the channel 2812 and the detonator holder 204 may lock/fix the rotational position of the eccentric weight 2802 and the detonator holder 204. In some embodiments, the eccentric weight may be as heavy (e.g. formed using highdensity material, such as steel or case iron) as possible for the application. For example, the eccentric weight may be configured to easily overcome and orient the weight of the shaped charge(s) and other internals, based on gravity. In some embodiments, the center of gravity of the eccentric weight may be displaced as far as possible from the center axis without contacting the inner wall of the housing. In some embodiments, more than one eccentric weight may be used.

In some embodiments, the orienting internal assembly 3202 may further include an end connector 2820 configured to rotationally fix the at least one shaped charge holder 806 to the inner bearing ring 2804 of a second 2806 of the two bearing assemblies. In some embodiments, the end connector 2820 may be disposed within the central opening 2811 of the second 2806 of the two bearing assemblies. In some embodiments, the at least one shaped charge holder 806 may be disposed between and rotationally fixed to the detonator holder 204 and the end connector 2820. So, the end connector 2820, at least one shaped charge holder 806, eccentric weight 2802, and detonator holder 204/detonator 202 may all be configured to rotate together as a whole (e.g. along with the inner bearing ring 2804 of each of the two bearing assemblies 2806, 2810). In some embodiments, the detonator adapter 2818 and/or the end connector 2820 may each have a constant outer/exterior diameter. In some embodiments, the detonator adapter 2818 and/or end connector 2820 may each have a portion with a smaller diameter and a portion with a larger diameter, and the bearing assembly may be positioned on the portion having the larger diameter. In some embodiments, the end connector 2820 and the detonator adapter 2818 may have a similar outer diameter.

The end connector 2820 may be similar to the end connector 808 above, but may be configured to fit within the inner bearing ring 2804 of the second bearing assembly 2806. In some embodiments, the end connector 2820 may comprise blade elements. Similar to the discussion above, the bulkhead may be in electrical contact with the end contact 1006 of the end connector 2820, for example via the first pin connector 1902. In some embodiments, one or more of the bulkhead pin connectors 1902, 1906 may be optimized for rotation. For example, one or more of the bulkhead pin connectors 1902, 1906 may have pointed endings, which may be configured to minimize rotational friction.

In an exemplary embodiment that FIG. 31 shows, the at least one shaped charge holder 806 may include a plurality of shaped charge holders 806, which may all be attached/coupled together (e.g. forming a stackable assembly of modular, connectable components). For example, all of the plurality of shaped charge holders 806 may be configured to be rotationally fixed with respect to one another. In some embodiments, the plurality of shaped charge holders 806 may be configured to be oriented/adjusted, for example to set positions with respect to one another (e.g. so that if rotational orientation of one is known, rotational orientation of all is known). While FIG. 31 illustrates two shaped charge holders 806 oriented the same direction, other phasing of the plurality of shaped charge holders 806 are included in the scope of this disclosure. The phasing of the plurality of shaped charge holders 806 may be adjusted, for example using corresponding phasing protrusions 1312 and phasing holes 1406 to pre-set the orientation of the various shaped charge holders with respect to one another, as discussed above. In some embodiments, the rotational position of the at least one shaped charge with respect to the eccentric weight 2802 is adjustable, for example between different set positions of a coupling with the detonator holder 204 (e.g. to allow for adjustable orientation/phasing of the at least one shaped charge holder 806 based on gravity). In some embodiments, all of the plurality of shaped charge holders 806 may be disposed between the end connector 2820 and the detonator holder 204. In some embodiments, the at least one shaped charge holder 806 may comprise only a single shaped charge holder 806. In some embodiments, the at least one shaped charge holder 806 may be attached to the end connector 2820 and the detonator holder 204 in proximity to the central axis. In some embodiments, the connection of at least one shaped charge holder 806 to the end connector 2820 and the detonator holder 204 may be offset from the central axis. In some embodiments, the point of connection between each of the plurality of shaped charge holders 806 may be in proximity to the central axis. For example, the points of connection and/or a central axis of the couplings may be disposed on the central axis. In some embodiments, the point of connection between each of the plurality of shaped charge holders 806 may be offset from the central axis. Typically, a shaped charge 804 may be disposed in each shaped charge holder 806.

In some embodiments, the orienting internal assembly 3202 may not comprise a hollow shell, sleeve, or body (e.g. tubular or cylindrical shape) for housing 104*c* the shaped charges or the shaped charge holders 806. For example, the orienting internal assembly 3202 may not comprise a hollow (tubular) sleeve extending longitudinally in the housing 104*c*. Rather, each shaped charge 804 may be mounted within the housing 104*c* by its own shaped charge holder 806. As discussed above, each shaped charge holder 806 may be configured to retain a single shaped charge within a receptacle 1316, which may be configured to orient the shaped charge radially outward (e.g. so that the perforating jet associated with each shaped charge is oriented to project outward approximately perpendicular to the wall of the housing 104*c* and/or approximately parallel to the radius of the longitudinal bore of the housing 104*c*). Each shaped charge holder 806 may be shaped and sized to retain a single shaped charge, for example having the receptacle 1316 of the shaped charge holder 806 shaped and sized to match the exterior of the shaped charge to be retained. Typically, each shaped charge holder 806 may have a center axis of the receptacle 1316 oriented to project outward. For example, the center axis of each shaped charge holder 806 may extend perpendicularly to the base of the shaped charge holder 806 (e.g. in proximity to the center of the base), approximately parallel to the side walls (or cage bars 1502 extending outward from the base) of the shaped charge holder 806, and/or approximately perpendicular to the longitudinal axis of the housing 104*c*. The orientation of the center axis of each of the shaped charge holders 806 may ensure that the shaped charges 804 (e.g. disposed within the shaped charge holders 806) are oriented outward. In embodiments with a plurality of shaped charges, a plurality of modular shaped charge holders 806 (each of which may be configured to hold only a single shaped charge) may be linked together and oriented for the specific application, as discussed above.

While some embodiments of the shaped charge holders 806 may comprise a solid base and/or solid side walls (e.g. to form the receptacle 1316 by surrounding the receptacle 1316 open space), in other embodiment the shaped charge holder 806 may be formed by cage bars 1502, for example forming a latticework of struts, beams, or bars. For example, for each shaped charge holder 806, a plurality of sidewall cage bar supports may extend outward from a base. In some embodiments, each shaped charge holder 806 may have an open top opposite the base, and the top may be configured with an opening configured for the projection of the perforating jet. The top of the shaped charge holder 806 may be configured to retain or hold the top of a shaped charge disposed within the shaped charge holder 806. In some embodiments, two or more sidewall arms may extend away from the base of the shaped charge holder 806, and the distal ends of the sidewall arms may form the top of the shaped charge holder 806. In some embodiments, a plurality of shaped charges may be disposed within the housing 104*c* by a linking of corresponding shaped charge holders 806 (e.g. forming a linkage, latticework string or chain 812), as described above. In some embodiments, this may allow for modular design and construction of the perforating gun system, for example with specific shaped charge holders 806 linked together in a chain 812 and oriented as desired for the particular downhole application. In some embodiments, this cage bar structure may allow for increased free gun volume. In some embodiments, there may be no concentric body element (e.g. concentric within the housing 104*c* longitudinal bore, such as a charge tube or the like) for mounting the shaped charges. By way of example, the one or more shaped charge holders 806 of FIGS. 28-31 do not include an enclosing body geometrically similar to the housing 104*c* with a longitudinal axis in common with the housing 104*c*. In embodiments with a plurality of shaped charge holders 806, there may be no actual longitudinal centerline of the orienting internal assembly 3202 (e.g. comprising the plurality of shaped charge holders 806 and the eccentric weight), since the center of gravity and/or the geometric center may vary longitudinally based on the location of the various elements/components (e.g. shaped charge holders 806). In some such instances, the center of gravity and/or geometric center of the orienting internal assembly 3202 may instead form a wave-like curve (e.g. be non-linear).

In some embodiments (not shown here), there may be no separate eccentric weight. For example, eccentricity may be provided for the orienting internal assembly 3202 in some instances by the shape and/or weight distribution of the shaped charge holders (see for example FIG. 32B, which is configured so that the weight orientation/distribution of the shaped charge holder and/or the case of the shaped charge itself may orient the shaped charge holder under the influence of gravity, in this instance having a base portion with thicker walls and/or more mass), which may be configured to impart rotation under the influence of gravity (for example in a non-vertical well). In some embodiments, one or more shaped charge holders 806 may receive an eccentric weight instead of a shaped charge or be configured as an eccentric weight connectable in the orienting internal assembly 3202 in substantially the same fashion as a shaped charge holder 806.

As illustrated in FIGS. 36-40, other embodiments of the orienting internal assembly 3202 may include a hollow sleeve or body (e.g. a charge tube 3610) for supporting the one or more shaped charges 804. Typically, such embodiments would not provide modularity for the perforating gun system. In some embodiments, the shaped charge orienting internal assembly 3202 may include or may be a hollow sleeve or body (e.g. a charge tube 3610), which may be configured to house one or more shaped charges 804, typically a plurality. For example, the charge tube 3610 may include openings configured to allow for positioning of the shaped charges 804 directed outward. In some embodiments, the charge tube 3610 may contact and be attached directly to the inner bearing rings 2804 of one or both of the bearing assemblies 2806, 2810. In some embodiments, one end of the charge tube 3610 may contact and be directly attached to the inner bearing ring 2804, while the other end may contact and be directly attached to the detonator holder 204 (e.g. the detonator holder stem 514). In some embodiments, the outer surface of the charge tube 3610 may be fixed to the inner surface of one or both inner bearing rings 2804. For example, the outer surface of the charge tube 3610 may be welded or adhered to the inner surface of the inner bearing ring(s) 2804. In some embodiments, the charge tube 3610 may include end caps or plates (not shown) or other components at one or both ends of the charge tube 3610 for securing to the inner surface of the inner bearing ring(s) 2804, or may include components and/or configurations for connecting to connectors 2818, 2820 that secure to the inner surface of the inner bearing ring(s) 2804. Although the charge tube 3610 is shown here disposed between two bearing assemblies, in some embodiments only a single bearing assembly may be used.

Figure 38:
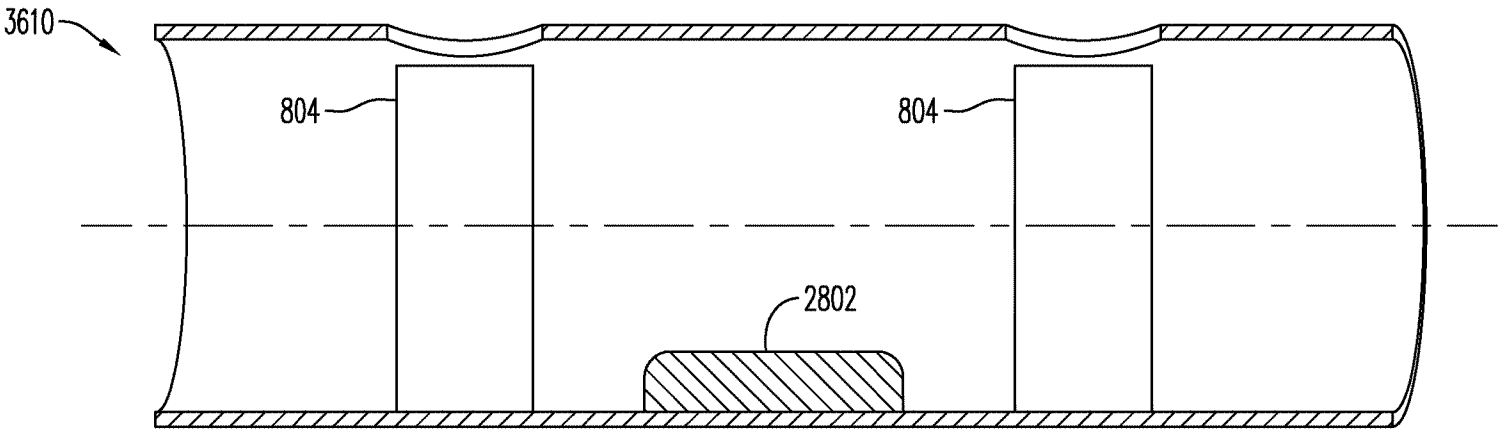
FIG. 38 is a perspective cutaway view of an exemplary embodiment of the charge tube of FIG. 37 according to an aspect of the disclosure.
Figure 39:
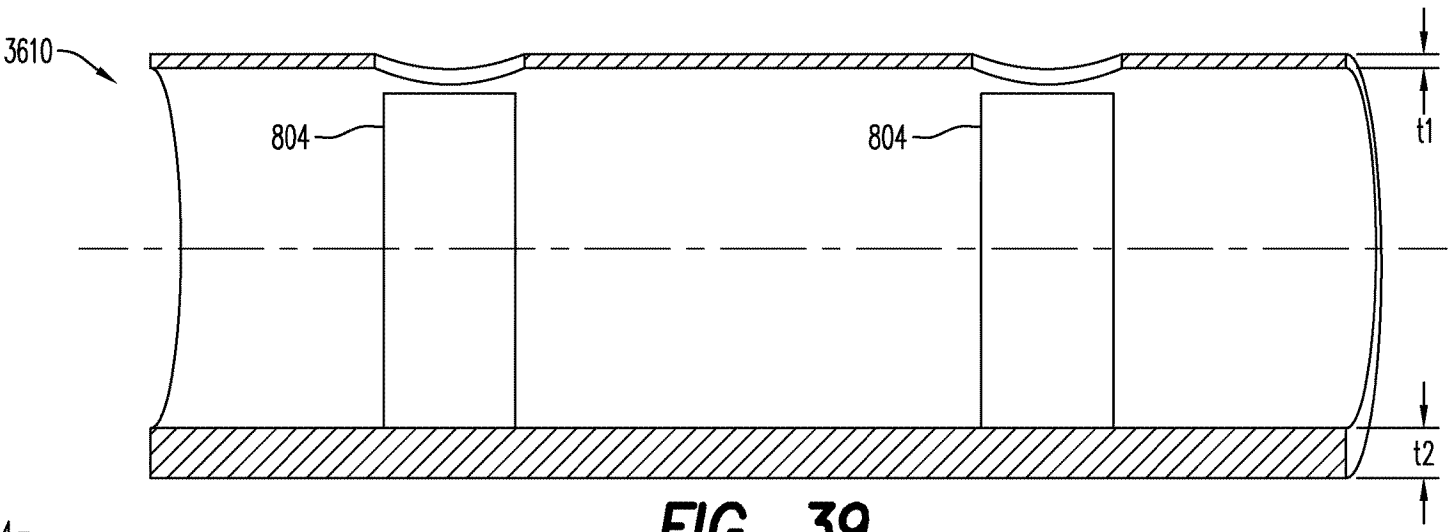
FIG. 39 is a perspective cutaway view of an alternate exemplary embodiment of the charge tube of FIG. 37 according to an aspect of the disclosure.
Figure 40:
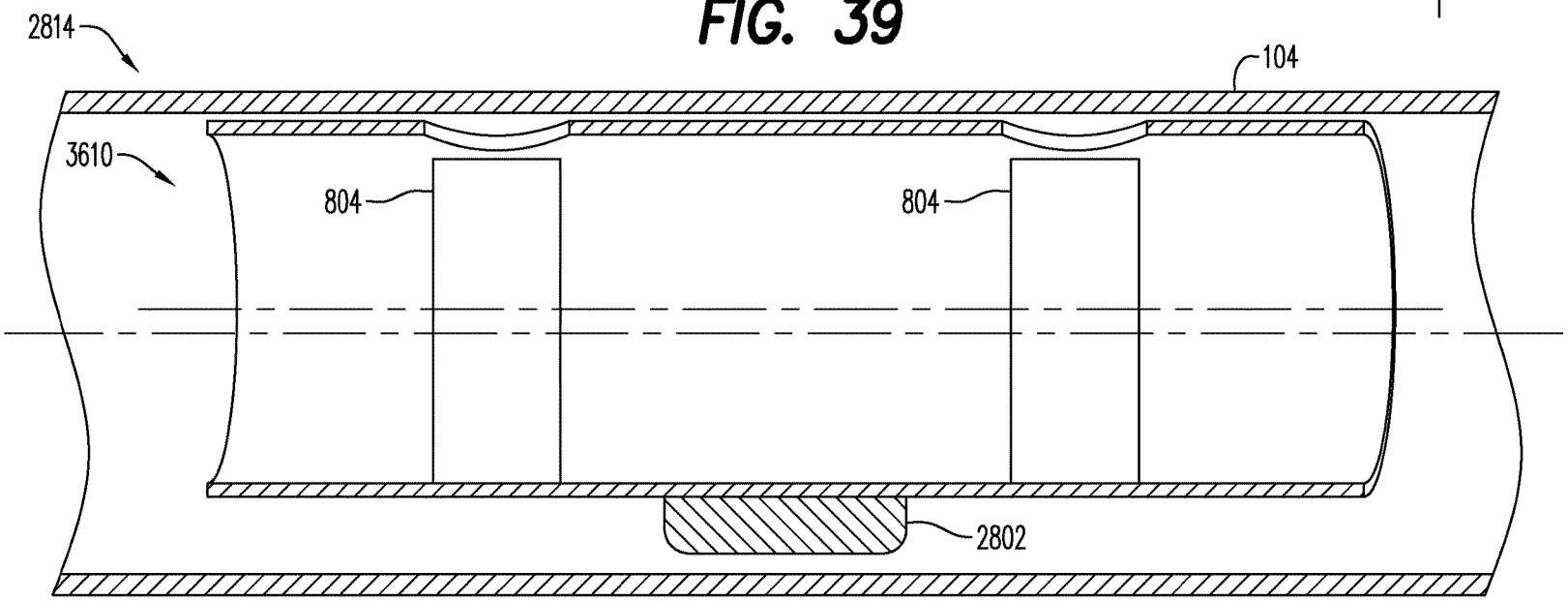
FIG. 40 is a partial perspective cutaway view (e.g. illustrating only the charge tube within the housing, with other elements omitted for ease of view) of an alternate exemplary embodiment of a perforating gun system according to an aspect of the disclosure.

In the embodiments of FIGS. 36-40, the charge tube 3610 of the orienting internal assembly 3202 may have a longitudinal axis, which may for example be aligned with the longitudinal axis of the housing 104*c* (when the charge tube 3610 is disposed within the housing 104*c*). In some embodiments, the charge tube 3610 may be concentric within the housing 104*c*. In some embodiments, the eccentric weight 2802 may be disposed within (e.g. attached to an interior surface of) the charge tube 3610, as shown in FIG. 38 for example. In other embodiments, the eccentric weight 2802 may be disposed outside of the charge tube 3610 (e.g. attached to the exterior surface of the charge tube 3610, as shown in FIG. 40 for example). In yet other embodiments, there may be no separate eccentric weight 2802 element. For example, the charge tube 3610 may be formed to provide eccentricity to the charge tube 3610 (e.g. with the eccentric weight 2802 integral to the charge tube 3610 and/or with the weight distribution of the charge tube 3610 being asymmetrical about the longitudinal axis). In other words, the charge tube 3610 itself may be eccentric about its longitudinal axis. For example, the wall thickness of the charge tube 3610 may vary about its circumference, for example with one side portion being thicker (e.g. having a larger thickness t2) than an opposite side portion (having a smaller thickness t1), as shown in FIG. 39. In some embodiments, the charge tube may be eccentrically configured (e.g. with the wall thickness of the charge tube varying to provide eccentricity).

In some embodiments, the charge tube 3610 may be radially off-set within the housing 104*c*. In some embodiments, the charge tube 3610 may be non-concentric with the housing 104*c* and/or the longitudinal axis of the charge tube 3610 may not align (e.g. may be radially offset) from the longitudinal axis of the housing 104*c*. See for example, FIG. 40. In other embodiments, the one or more shaped charge holders 806 may be radially offset from the longitudinal axis of the housing 104*c*, the connection points between the one or more shaped charge holders 806 and the detonator holder 204 and/or the end connector 2820 may be radially offset from the longitudinal axis of the housing 104*c*, and/or the connection points between the plurality of shaped charges in the shaped holder chain 812 may be radially offset from the longitudinal axis of the housing 104*c*. In some embodiments, the radial offset (e.g. non-concentric nature) of the charge tube or shaped charge holders may provide eccentricity (for example, without the need for additional weight). While the shaped charges 806 in FIGS. 36-40 are shown as having the base mounted on the inner surface of the charge tube 3610, the shaped charges 806 may be mounted in other ways. For example, each shaped charge 806 may be configured to hang down from the associated opening in the charge tube 3610. In some embodiments, the charge tube 3610 may be conductive (e.g. formed of metallic conductive material), while in other embodiments, the charge tube 3610 may be non-conductive (e.g. formed of an insulating material).

In some embodiments, rotation and/or centralization may occur based on a rotation support system. While the rotation support system may include or consist essentially of one or more bearing assemblies (as discussed above), in other embodiments, the rotation support system may include or consist essentially of a plurality of rollers/wheels. In some embodiments, the rotation support system may include both one or more bearing assembly and a plurality of wheels/rollers. For example, embodiments of an orienting internal assembly may include at least one shaped charge holder or a charge tube (e.g. configured to hold and direct one or more shaped charges outward), a rotation support system, and a detonator holder and/or a detonator. In some embodiments, the rotation support system may be configured so that the at least one shaped charge holder and the detonator holder and/or detonator rotate together as a whole. In other embodiments, the rotation support system may be configured so that the charge tube and the detonator holder and/or detonator rotate together as a whole.

Figure 36:
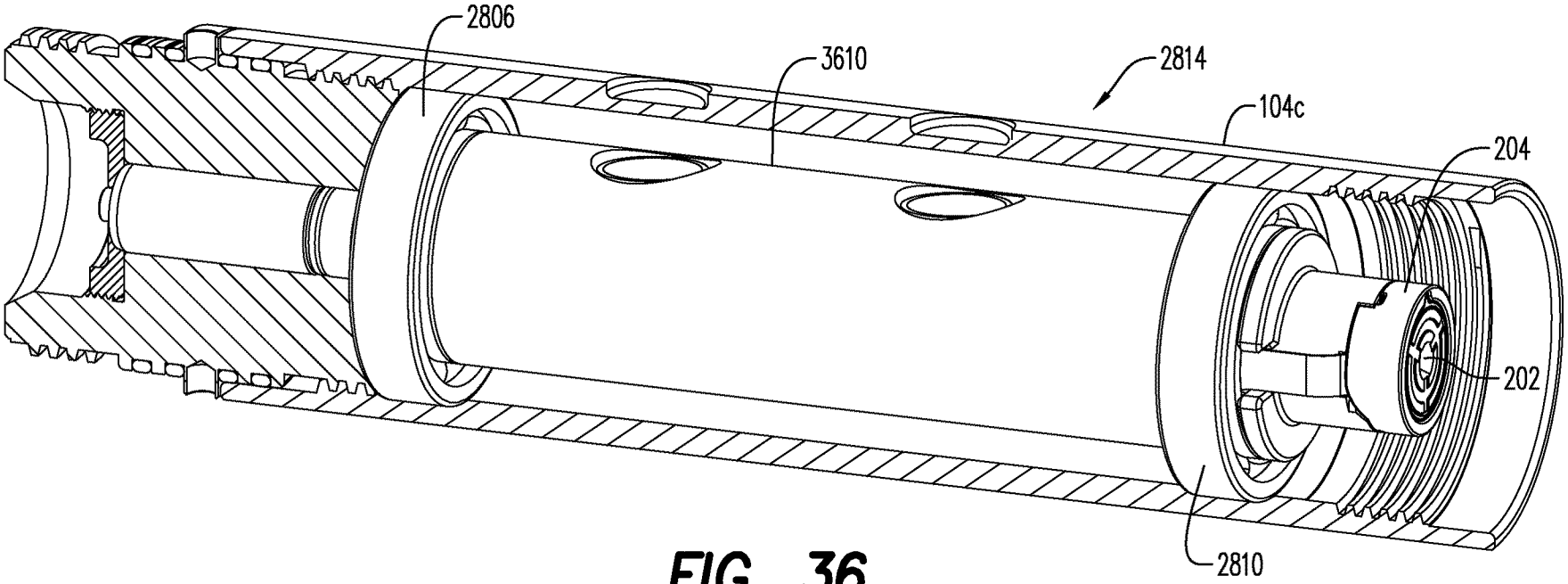
FIG. 36 is a perspective cutaway view of an exemplary embodiment of a perforating gun system according to an aspect of the disclosure.
Figure 37:
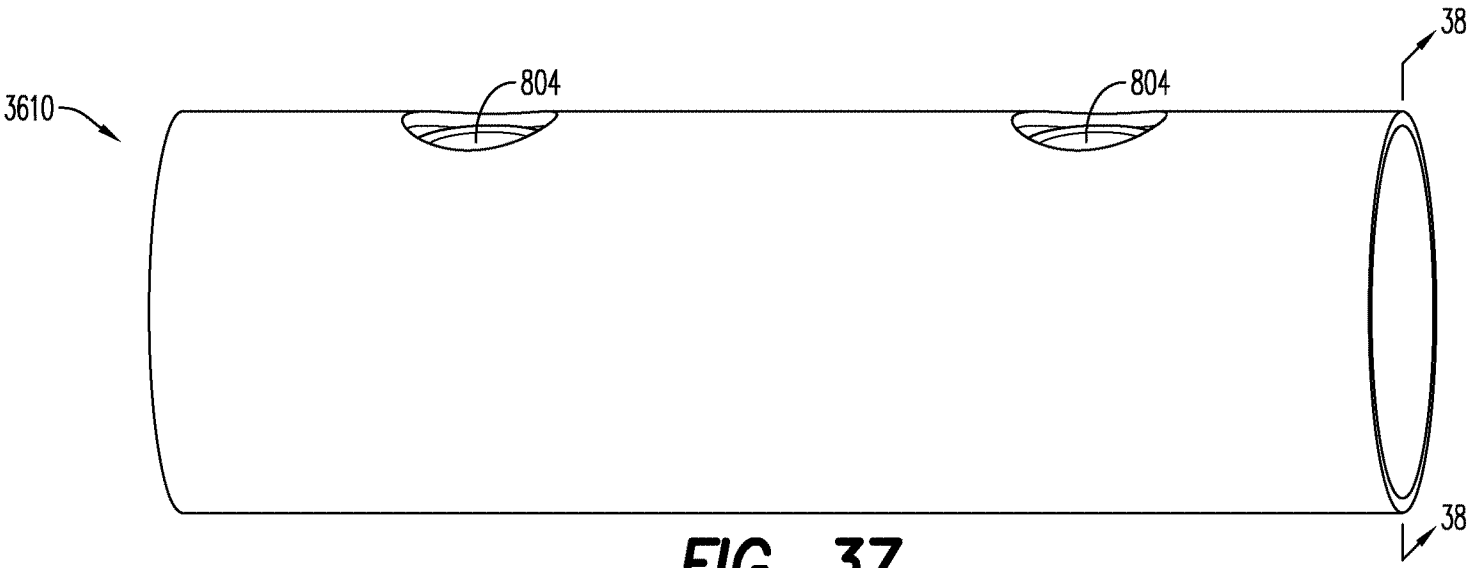
FIG. 37 is a perspective view of an exemplary embodiment of a charge tube of the perforating gun system of FIG. 36 according to an aspect of the disclosure.
Figure 41A:
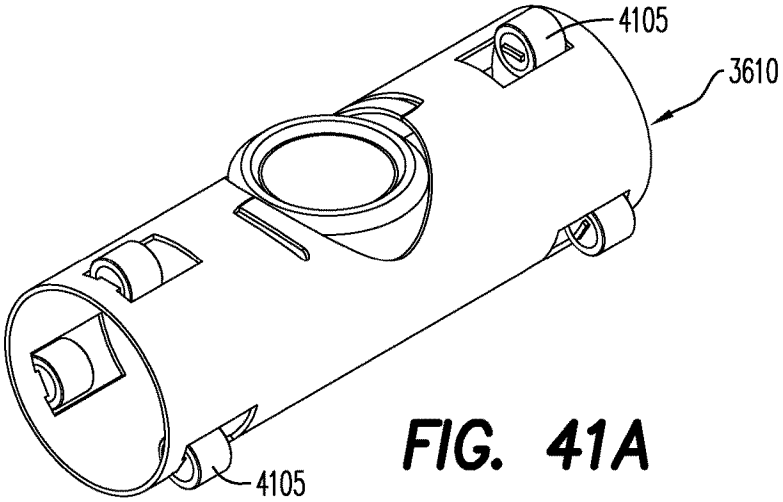
FIG. 41A is a perspective view of another alternate exemplary charge tube embodiment according to an aspect of the disclosure.
Figure 41B:
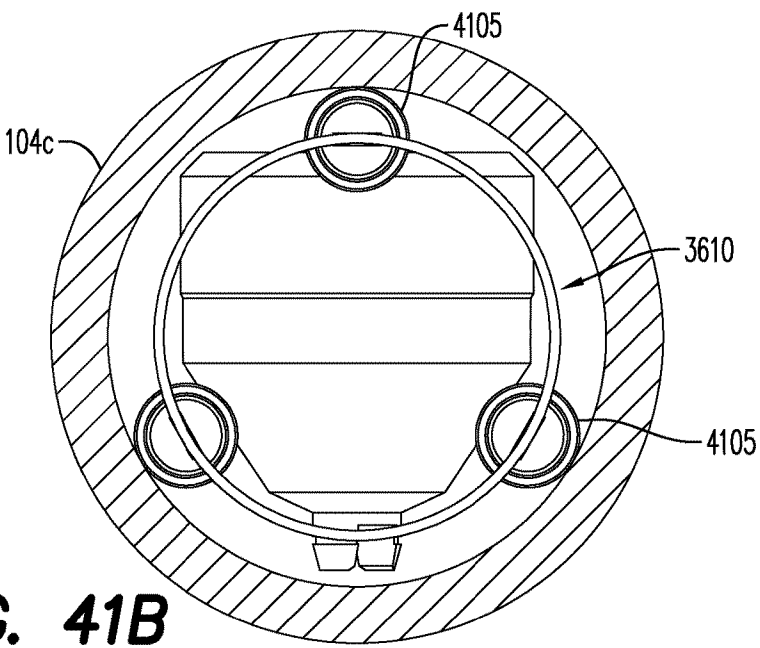
FIG. 41B is an end view of the charge tube of FIG. 41A disposed within an exemplary housing.

FIGS. 41A-42B illustrate alternate embodiments, using three of more rollers 4105 (e.g. wheels, balls, or pivoting cylinders) attached to and/or disposed on the charge tube 3610 to allow for rotation (e.g. in place of the ball bearing assembly shown in FIG. 36, for example). While shown in FIG. 41A as wheels (e.g. cylindrical elements configured to rotate about an axis, such as an axle), the rollers 4105 may take any form which allows for the rotational movement of the charge tube 3610 within the longitudinal bore of the housing. For example, rollers 4105 can include balls disposed in a half-shell seat. Typically, the three or more rollers 4105 may be substantially the same. In some embodiments, three or more rollers 4105 may be disposed (e.g. symmetrically spaced) at each end of the charge tube 3610. In FIG. 41A, the rollers 4105 are integrated into (e.g. attached directly to, for example at their pivoting/rotating axis, such as the central axis of the roller) the charge tube 3610. For example, a rotational axle of each roller 4105 may be rigidly attached to the charge tube 3610, and the roller surface (e.g. wheel) may be configured to rotate freely about the axle. As shown in FIG. 41A, the rollers 4105 may each be configured to rotate in a direction perpendicular to the longitudinal axis of the charge tube 3610 (e.g. so that together the rollers 4105 are configured to allow rotation of the charge tube 3610 about its longitudinal axis). For example, a portion of each roller 4105 may be extend within the charge tube 3610, while a portion of each roller 4105 may extend outside the charge tube 3610. The central axis of each roller 4105 may be aligned with and extend longitudinally along a portion of the sidewall of the charge tube 3610, for example extending parallel to the longitudinal axis (see for example FIG. 41B, illustrating alignment of the axis of the rollers with the cross-section of the adjacent sidewall of the charge tube 3610). In some embodiments, the central axis of each roller 4105 may be disposed on the charge tube 3610 sidewall, spaced from the longitudinal axis of the charge tube 3610 a distance equal to the radius of the charge tube 3610, and may extend perpendicular to the radius of the charge tube 3610. FIG. 41B illustrates the charge tube 3610 of FIG. 41A within an exemplary housing 104*c*. The rollers 4105 may each have a diameter sufficient to space the charge tube 3610 and/or the shaped charge and/or shaped charge holder away from the inner surface of the housing 104*c*, so that each roller 4105 contacts the inner surface of the housing 104*c* and holds (via attachment to the charge tube 3610 at the axis of the roller) the charge tube 3610 within the housing 104*c* so as to allow rotation therein. In some embodiments, the rollers 4105 may be configured to each contact an inner surface of the housing when the orienting internal assembly is disposed within the longitudinal bore of the housing.

Figure 42A:
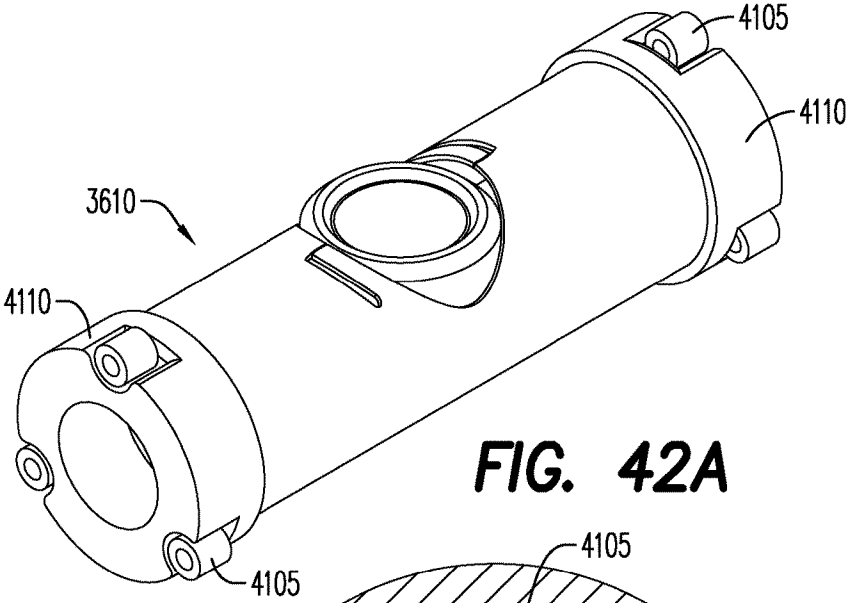
FIG. 42A is a perspective view of yet another alternate exemplary charge tube embodiment according to an aspect of the disclosure.
Figure 42B:
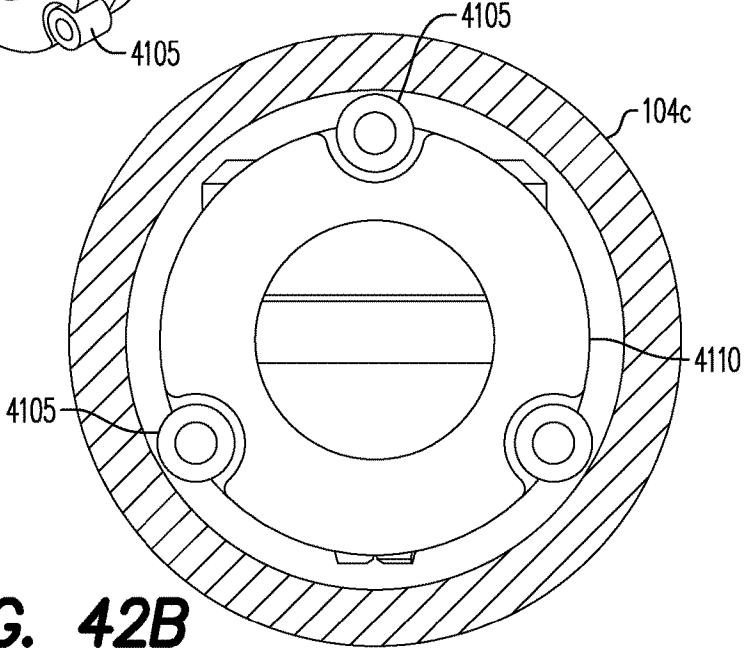
FIG. 42B is an end view of the charge tube of FIG. 42B disposed within an exemplary housing.

In FIG. 42A, the rollers 4105 may be attached to an end plate 4110, which is attached to the charge tube 3610 (e.g. at an end of the charge tube). For example, the rotational axis of each roller 415 may be attached to the end plate 4110 (e.g. similar to the attachment in FIG. 41A-B of the rollers to the charge tube). The charge tube 3610 may then rotate within the housing 104*c*, with the rollers 4105 of the end plates 4110 contacting the housing 104*c* as shown in FIG. 42B. In some embodiments, pin bearings could be used at one or both ends of the orienting internal assembly (e.g. the charge tube 3610). For example, a rigid pointy pin could contact one or both bulkheads, and could be configured to allow for rotation of the orienting internal assembly (e.g. with or without any other rotation element, such as one or more ball bearing assembly). In some embodiments, the rollers of the charge tube may be used with one or more bearing assembly. In some embodiments, the charge tube 3610 may have only two rollers. In some embodiments, the charge tube may have two or more rollers disposed at each end. In some embodiments, having rollers and at least one bearing assembly, the rollers may be disposed away from the at least one bearing assembly.

In some embodiments, the rotation support system may include either only rollers or only one or more bearing assemblies (e.g. configured for rotation of the orienting internal assembly), while in other embodiments, the rotation support system may include both rollers and one or more bearing assemblies (e.g. configured for rotation of the orienting internal assembly). In some embodiments, the orienting internal assembly may comprise the charge tube (e.g. similar to FIG. 36), while in other embodiments, the orienting internal assembly may include one or more shaped charge holder (e.g. similar to FIGS. 28 and 31). For example, the rollers may be used alone in some embodiments, while in other embodiments, the rollers may be used in conjunction with one or more bearing assemblies. For example, if used with two bearing assemblies, the rollers may be disposed away from the ends of the charge tube (e.g. to provide rotational support for a central portion of the orienting internal assembly, such as the charge tube). If used with only one bearing assembly, the rollers may be disposed away from the bearing assembly.

Figure 43:
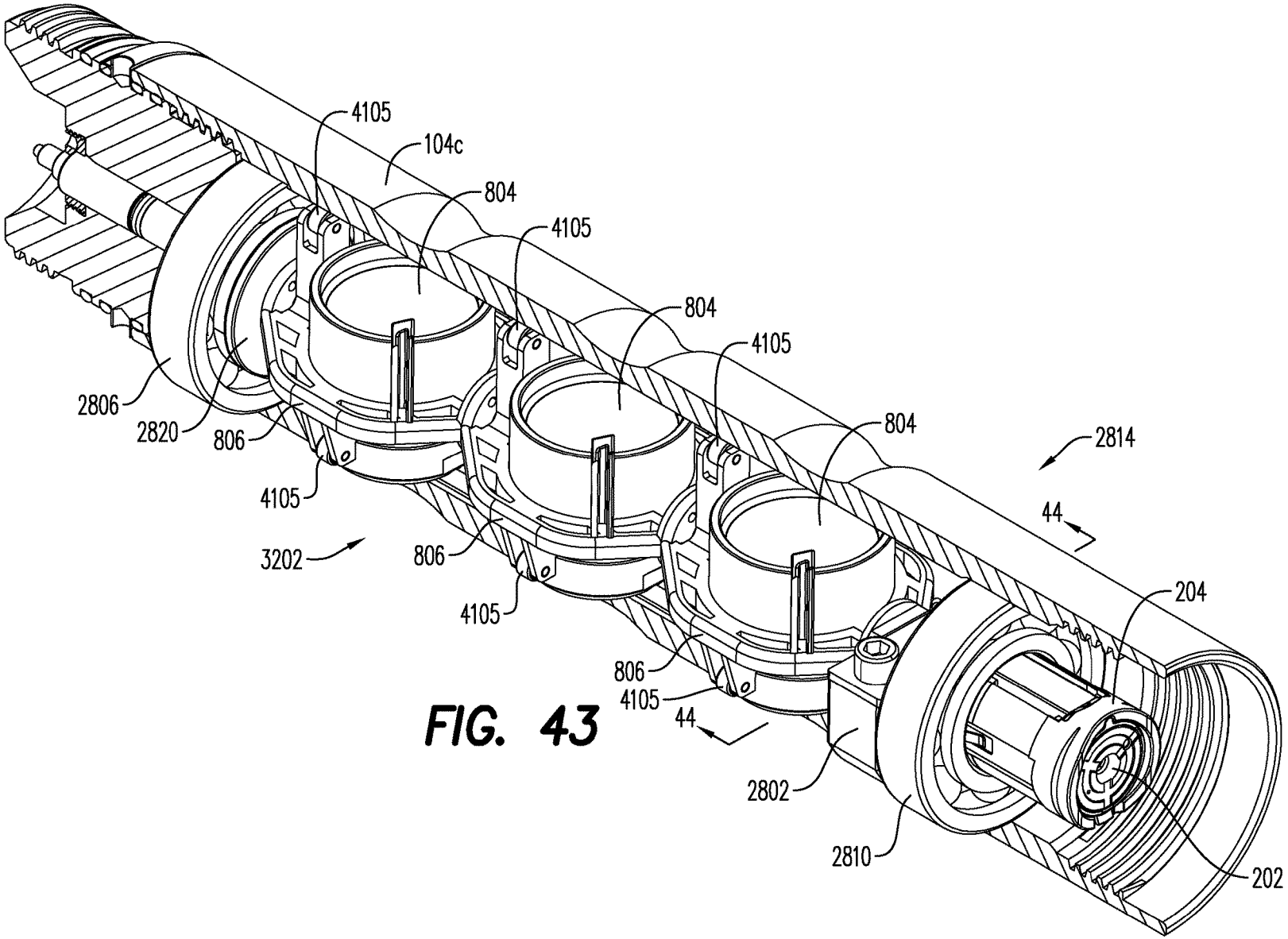
FIG. 43 is a perspective cutaway view of an exemplary embodiment of a perforating gun system according to an aspect of the disclosure.
Figure 44:
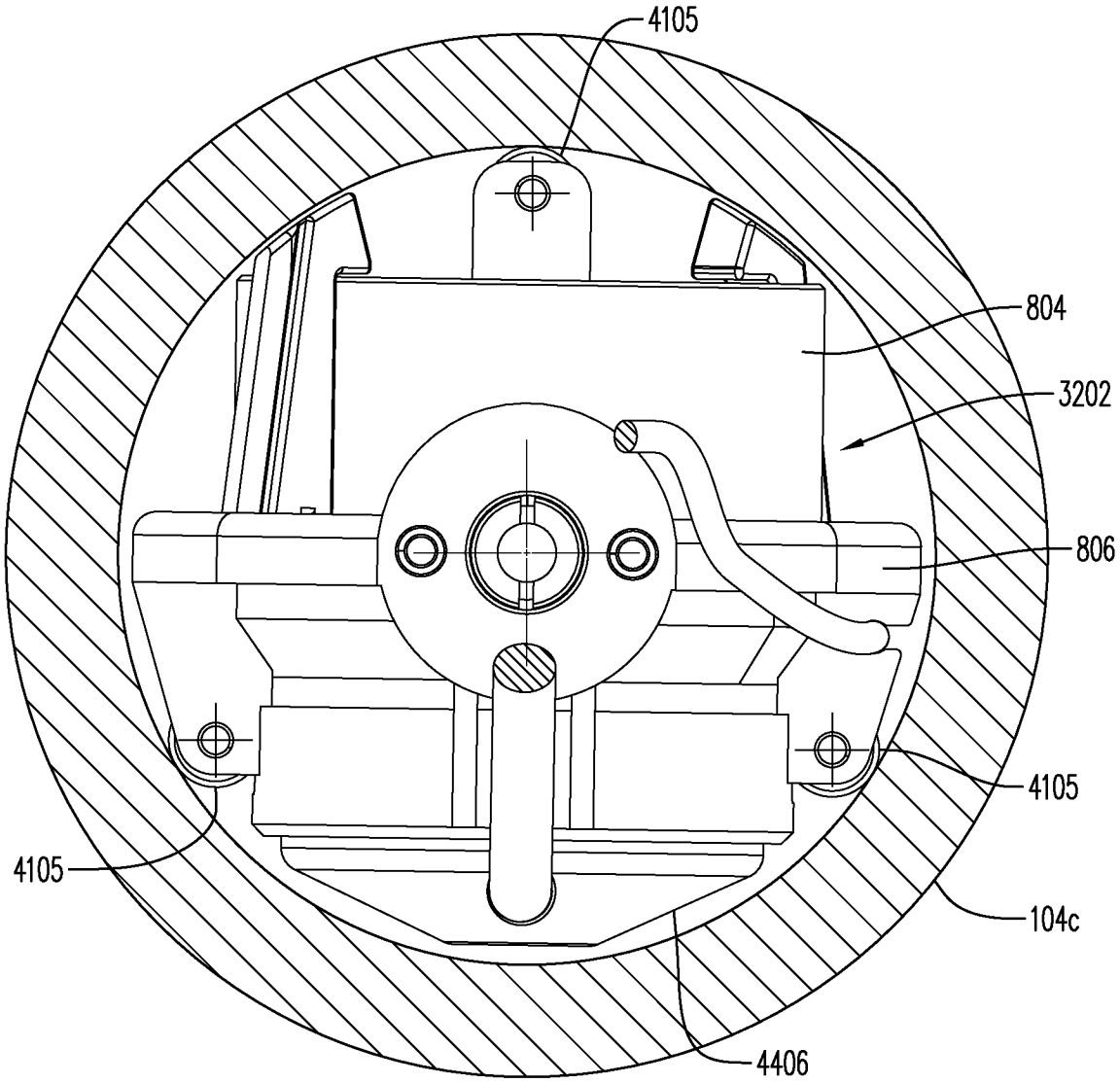
FIG. 44 is a cross-sectional view of the perforating gun system of FIG. 43.

In some embodiments, rollers 4105 may also be used in conjunction with one or more shaped charge holders 806. For example, FIG. 43 shows an embodiment of an orienting internal assembly 3202 which is similar to that described herein with respect to FIGS. 28-35, but which further includes one or more rollers 4105 disposed on the at least one shaped charge holder 806. For example, the orienting internal assembly 3202 may include at least one shaped charge holder 806, at least one bearing assembly 2810 or 2806, and a detonator holder 204 and/or a detonator 202. One or more rollers 4105 may be mounted on and/or affixed to the at least one shaped charge holder 806 and configured to contact an inner surface of the longitudinal bore of the housing 104*c*, for example to rotationally support the at least one shaped charge holder 806 within the longitudinal bore of the housing 104*c*. The at least one shaped charge holder 806 and the detonator holder 204 and/or detonator 202 may be configured to rotate as a whole within the longitudinal bore of the housing 104*c*. For example, the at least one bearing assembly (2810 or 2806) and the one or more rollers 4105 can be configured to support the at least one shaped charge holder 806 within a longitudinal bore of a housing 104*c* and to allow rotation of the at least one shaped charge 804 within the housing 104*c* (e.g. with the rotation configured to allow orientation of the shaped charge 804 within the housing 104*c* so as to direct the shaped charge perforating j et outward at the appropriate circumferential location on the housing 104*c* for the specific circumstances). FIG. 44 further illustrates the orienting internal assembly 3202 of FIG. 43 disposed within the housing 104*c*, with the rollers 4105 rotationally supporting the at least one shaped charge holder 806 within the longitudinal bore of the housing 104*c*. FIG. 44 also illustrates an optional embodiment in which a weight 4406 is coupled to the at least one shaped charge holder 806. For example, the base of the shaped charge holder 806 may be configured to retain the weight 4406.

In some embodiments, the at least one bearing assembly (2806 or 2810) may include an outer bearing ring (e.g. a track or bearing race), an inner bearing ring (e.g. a track or bearing race), and a plurality of bearings disposed between the outer bearing ring and the inner bearing ring, and the inner bearing ring and outer bearing ring can be concentric and coaxial. The bearings may be configured to allow rotation of the inner bearing ring about the central axis within the outer bearing ring, with the at least one shaped charge holder 806 being rotationally fixed to the inner bearing of the at least one bearing assembly. This may be similar to the configuration in FIG. 28, for example, but further including rollers for rotational support.

In some embodiments, an axis of each roller 4105 (e.g. the axis of rotation of the roller, such as an axle of a wheel) may be parallel to a longitudinal axis of the housing 104*c* and/or a central axis of the at least one bearing assembly (2806, 2810), with each roller 4105 configured to rotate about its axis. In some embodiments, the one or more roller 4105 may be configured to rotate circularly (e.g. along a circular path) around the inner circumference of the longitudinal bore of the housing 104*c*. For example, the one or more roller 4105 may be configured to allow rotation tangentially perpendicular to the radius of the housing within the longitudinal bore (e.g. so that the one or more roller 4105 is configured to be able to traverse a path along the circumference of the longitudinal bore). In some embodiments, the one or more roller 4105 may be configured to allow rotation about the longitudinal axis of the longitudinal bore of the housing 104*c*. In some embodiments, the one or more rollers 4105 may be configured to allow rotation about the central axis of the at least one bearing assembly. In some embodiments, each of the one or more rollers 4105 may be approximately equal in size (e.g. diameter). In some embodiments, each roller 4105 may be configured to rotate backward and forward along only one direction, and all rollers may be configured to rotate the same direction (e.g. circumferentially around the longitudinal bore of the housing 104*c* and/or about the longitudinal axis of the housing 104*c*). For example, there may be substantially no longitudinal movement of the rollers 4105 as they rotationally support the orienting internal assembly 3202 within the housing 104*c* and/or there may be substantially no radial movement (e.g. inward or outward along the radius of the housing). In some embodiments, the axis of each roller 4105 (e.g. the axis of rotation of the roller, such as an axle of a wheel) may be held between two elements of the cage structure forming the shaped charge holder 806 (e.g. with two approximately parallel elements of the cage structure being configured approximately perpendicular to the axis of the roller being held).

Figure 45:
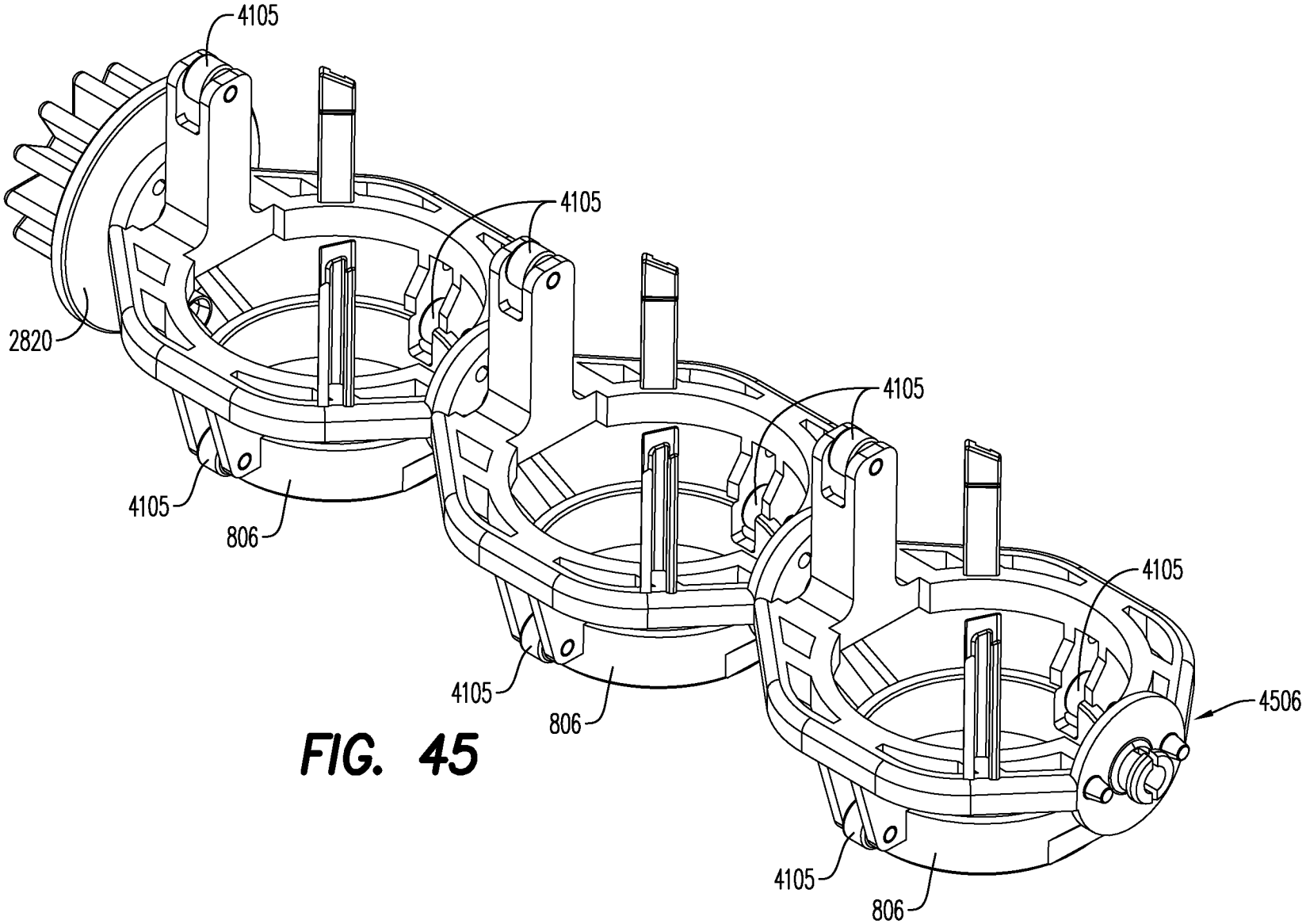
FIG. 45 is a perspective view of an exemplary linkage of a plurality of shaped charge holders, which may be used within the housing of the perforating gun system of FIG. 43, for example.
Figure 46B:
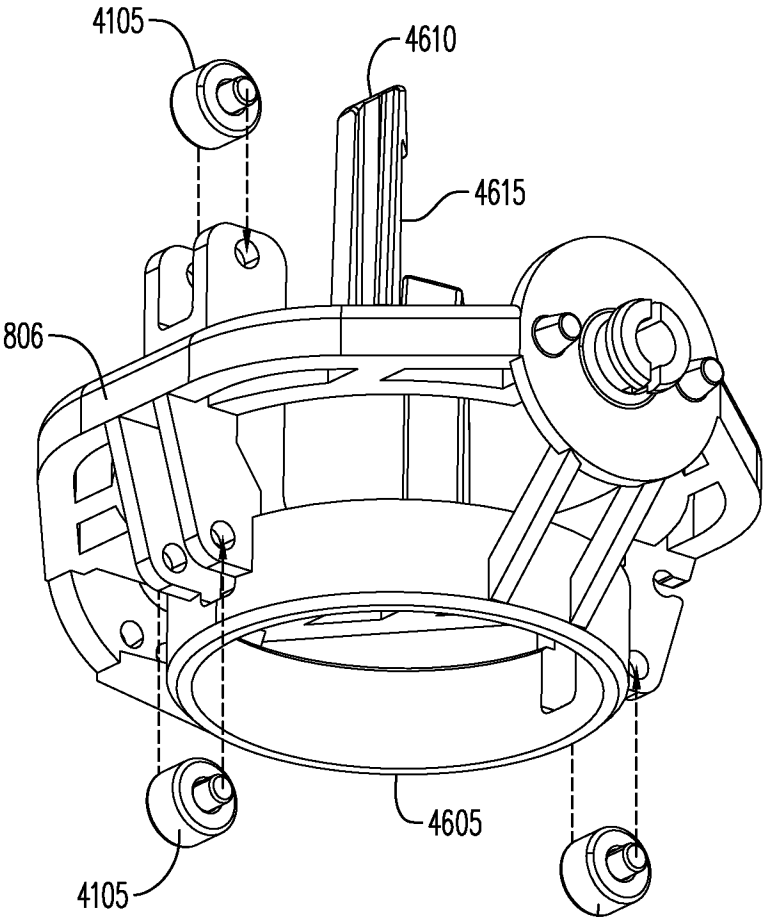
FIG. 46B is an exploded perspective view of the exemplary shaped charge holder of FIG. 46A.
Figure 46A:
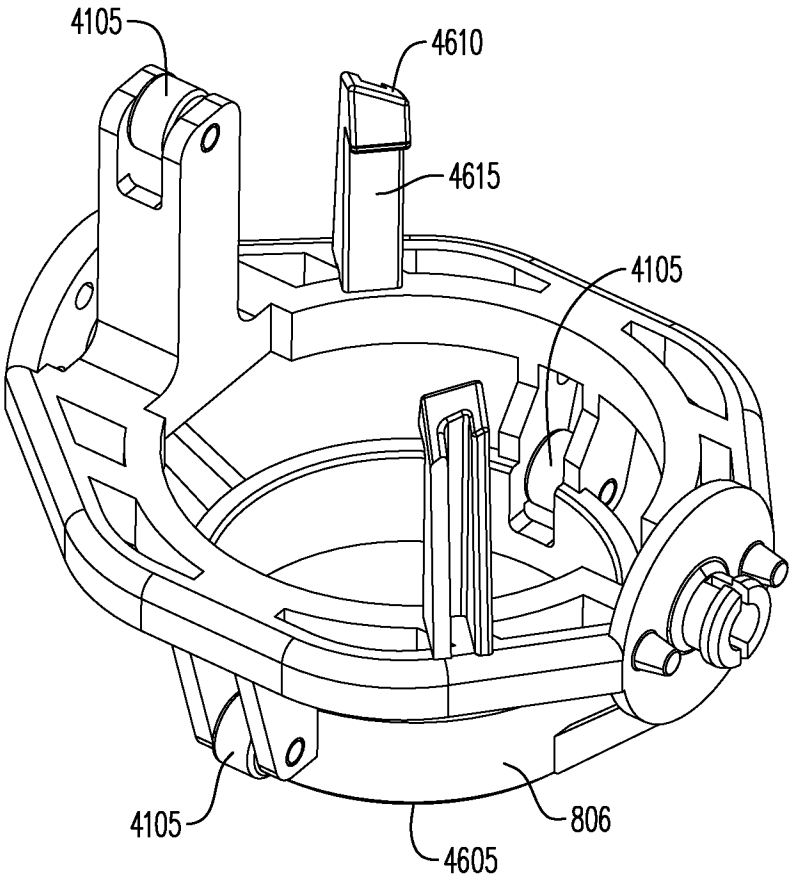
FIG. 46A is a perspective view of an exemplary shaped charge holder according to an aspect of this disclosure.

The rollers 4105 may be configured to rotationally support the at least one shaped charge holder 806 within the longitudinal bore of the housing 104*c* (e.g. with the rollers 4105 contacting the inner surface of the longitudinal bore of the housing 104*c*), while spacing the at least one shaped charge holder 806 (e.g. the cage structure, including the base 4605 and the open top 4610) away from the inner surface of the longitudinal bore of the housing 104*c* sufficiently so as to allow for rotation of the at least one shaped charge holder 806 and/or the orienting internal assembly 3202 within the longitudinal bore of the housing 104*c*. FIGS. 45, 46A, and 46B further illustrate exemplary rollers 4105 disposed on the one or more shaped charge holders 806.

In some embodiments, the orienting internal assembly 3202 may further include an eccentric weight 2802, configured to orient the at least one shaped charge holder 806 based on gravity. For example, the at least one shaped charge holder 806, the eccentric weight 2802, and the detonator holder 204 and/or the detonator 202 may be configured to rotate as a whole. In some embodiments, the at least one bearing assembly may comprise two bearing assemblies 2806 and 2810. For example, the two bearing assemblies 2806 and 2810 may be disposed on opposite ends of the orienting internal assembly 3202. In some embodiments, the at least one shaped charge holder 806 may be disposed between the two bearing assemblies 2806 and 2810.

In some embodiments, each of the at least one shaped charge holders 806 may have at least one roller 4105 mounted thereon. In other embodiments, each of the at least one shaped charge holder 806 may have two or more rollers 4105 mounted thereon. For example, at least two of the rollers 4105 may be disposed/mounted/attached in proximity to the base 4605 of the shaped charge holder 806. In some embodiments, each of the at least one shaped charge holder 806 may have three or more rollers 4105 mounted thereon. For example, at least one of the rollers 4105 may be disposed in proximity to the top 4610 of the shaped charge holder 806 (e.g. in proximity to the opening in the shaped charge holder through which the perforating jet projects outward and/or at a distance from the base approximately equal to (e.g. slightly longer than) support arms 4615 configured to hold the top of the shaped charge 804), and at least two rollers 4105 may be disposed in proximity to the base 4605 of the shaped charge holder 806 (e.g. opposite the opening of the shaped charge holder). Each of the rollers 4105 may be configured to extend outward from the shaped charge holder 806 sufficiently so that, when contacting the inner surface of the longitudinal bore of the housing 104*c*, the shaped charge holder 806 and shaped charge 804 do not contact the inner surface of the longitudinal bore (e.g. providing a clearance gap, for example between both the top 4610 and the base 4605 with the housing 104*c*). In some embodiments, the at least 3 rollers 4105 of a shaped charge holder 806 may be angularly spaced by about 120 degrees (e.g. around the longitudinal axis of the housing). In some embodiments, at least 2 of the rollers 4105 may be angularly spaced apart by about 60-180 degrees (e.g. about 120 degrees). In some embodiments, at least two of the rollers 4105 may be angularly spaced apart by less than 180 degrees, for example about 90-179 degrees, about 120-179 degrees, or about 90-120 degrees. In some embodiments, at least one roller 4105 may be disposed in proximity to the base 4605 of the shaped charge holder 806, and at least one roller may be disposed in proximity to the top 4610 of the shaped charge holder 806. Although not shown here, in some embodiments, the eccentric weight may have one or more roller mounted thereon. In some embodiments, one or more roller may be mounted on the eccentric weight, but not on a shaped charge holder.

In some embodiments, the at least one shaped charge holder 806 may include a plurality of shaped charge holders, which may be linked together into a unitary linkage 4506, so as to rotate together as a whole. For example, the linkage 4506 may include two or more shaped charge holders 806 which are rotationally fixed. FIG. 45 illustrates an exemplary linkage having three exemplary shaped charge holders 806. In some embodiments, the two or more shaped charge holders 806 may be rotationally fixed so that the linkage 4506 extends longitudinally, for example in a direction parallel to the longitudinal axis of the housing 104*c*. As discussed previously, the specific orientation of the two or more shaped charge holders 806 may be adjustable, but after adjustment (e.g. while disposed in the housing) their relative orientations may be fixed so that the linkage 4506 rotates together as a whole. In some embodiments, the linkage 4506 may have at least two rollers 4105 mounted thereon, while in other embodiments the linkage 4506 may have at least three rollers 4105, at least four rollers 4105, or at least six rollers 4105 mounted thereon. In some embodiments, each shaped charge holder 806 of the linkage 4506 may have at least one roller 4105 mounted thereon. In some embodiments, each shaped charge holder 806 of the linkage 4506 may have at least two rollers 4105 mounted thereon. For example, each shaped charge holder 806 of the linkage 4506 may have at least two rollers 4105 disposed in proximity to the base 4605 of the shaped charge holder 806. In some embodiments, each shaped charge holder 806 of the linkage 4506 may have at least three rollers 4105 mounted thereon (e.g. as shown in FIGS. 46A-B). For example, each shaped charge holder 806 of the linkage 4506 may have at least one roller 4105 disposed in proximity to the top 4610 of the shaped charge holder, and at least two rollers 4105 disposed in proximity to the base 4605 of the shaped charge holder. The rollers 4105 may disposed on any embodiment of the linkage 4506 so as to rotationally support the linkage 4506 within the longitudinal bore of the housing 104*c* and/or to centralize the linkage 4506 within the longitudinal bore of the housing 104*c*.

While shown in FIG. 43 as using the rollers 4105 in conjunction with one or more (e.g. two) bearing assemblies (2806, 2810), in some embodiments, the rollers 4105 may be used alone (e.g. as the only rotation support element for the at least one shaped charge holder 806 and/or linkage of shaped charge holders). Stated another way, the rotation support system for rotationally supporting the at least one shaped charge holder 806 within the longitudinal bore of the housing 104*c* may have one or more rollers 4105, without any bearing assembly. In some embodiments, the orienting internal assembly 3202 may not include a bearing assembly that is configured to support and allow rotation of the at least one shaped charge holder within the housing. For example, the rollers 4105 may provide all of the rotational support for the orienting internal assembly 3202 within the longitudinal bore of the housing 104*c* (e.g. the rollers 4105 may be configured to fully support the at least one shaped charge holder 806 in the longitudinal bore of the housing).

FIG. 44 also illustrates an embodiment in which the at least one shaped charge holder 806 may be configured to include a weight 4406 attached to the base (e.g. a separate eccentric weight which may be coupled to the base of the shape charge holder 806) and/or a shaped charge holder configured with a weight distribution which may provide weight/eccentricity (e.g. disposed at the base to orient the shaped charge). For example, the base of one or more of the at least one shaped charge holder 806 may be configured to house a separate eccentric weight 4406. In some embodiments, this weighted shaped charge holder approach may be used without any other eccentric weight (such as 2802), and may provide the only eccentricity for the orienting internal assembly. In other embodiments, this weighted shaped charge holder approach may be used in conjunction with one or more additional eccentric weight (e.g. 2802, which may be coupled to the stem of the detonator holder). In some embodiments, each shaped charge holder 806 may include a weight 4406 coupled directly thereto, while in other embodiments less than all (e.g. only one or half) of the shaped charge holders 806 may have such a weight 4406. In some embodiments, the attachment of the weight to the shaped charge holder may be similar to that described in U.S. patent application Ser. No. 17/610,377, which is hereby incorporated herein to the extent that it is not inconsistent and/or incompatible with the explicit disclosure herein (and specifically incorporated by reference with respect to aspects concerning weights mounted on shaped charge holders).

Embodiments may include a grounding mechanism for the detonator, for example so that a detonator disposed in the detonator holder of the orienting internal assembly may be configured to ground the detonator when the orienting internal assembly is disposed within the housing. By way of general example, disclosed embodiments may include an electrical assembly for use in a housing having a longitudinal bore. The electrical assembly may include a bearing assembly having a first portion configured to be stationary with respect to the housing and a second portion configured to be rotatable with respect to the first portion; and a ground conductor which is rotationally fixed to the second portion of the bearing assembly. The ground conductor and the second portion of the bearing assembly may be configured to rotate together as a whole.

In some embodiments, the first portion and the second portion of the bearing assembly may be conductive, and the ground conductor may include a conductive path between ends of the ground conductor. In some embodiments, the electrical assembly may extend from the ground conductor, through the second portion of the bearing assembly, through the first portion of the bearing assembly, to the housing. Some embodiments may further include a detonator holder and/or a detonator, with the detonator holder and/or detonator rotationally fixed to the second portion of the bearing assembly so that the ground conductor, the second portion of the bearing assembly, and the detonator holder and/or the detonator are configured to rotate together as a whole.

In some embodiments, the bearing assembly may include an outer bearing ring, an inner bearing ring, and a plurality of bearings disposed between the outer bearing ring and the inner bearing ring. For example, the first portion of the bearing assembly may include the outer bearing ring; the second portion of the bearing assembly may include the inner bearing ring; the inner bearing ring and outer bearing ring may be concentric and coaxial; and the bearings may be configured to allow rotation of the inner bearing ring about a central axis within the outer bearing ring. In some embodiments, the second portion of the bearing assembly may further include the plurality of ball bearings. The bearing assembly as a whole can be electrically conductive. For example, the outer bearing ring, inner bearing ring, and ball bearings may all be electrically conductive (e.g. formed of steel). In some embodiments, the ground conductor may include at least one ground contact plate. The at least one ground contact plate may be configured to extend from the detonator holder and/or detonator to contact the inner bearing ring, whereby electrical ground connection/communication for the detonator is through the at least one ground contact plate, the inner bearing ring, the ball bearings, and the outer bearing ring, to the housing. In some embodiments, the at least one ground contact plate may be configured to contact a ground terminal of the detonator in the detonator holder at one end, and to contact the inner bearing ring at the opposite end.

In some embodiments, at least one shaped charge holder may be rotationally fixed to the second portion of the bearing assembly (e.g. the inner bearing) of the at least one bearing assembly. The at least one shaped charge (e.g. disposed in the at least one shaped charge holder) may be electrically isolated from the second portion of the bearing assembly (e.g. the inner bearing ring), the bearing assembly as a whole, and/or the ground conductor (e.g. at least one ground contact plate). For example, an insulating element may be configured to electrically isolate the at least one shaped charge from the second portion of the bearing assembly (e.g. the inner bearing ring), the bearing assembly as a whole, and/or the ground conductor (e.g. at least one ground contact plate). In some embodiments, the insulating element may include the detonator holder and/or the shaped charge holder (which may be composed of plastic, such as insulating plastic).

In some embodiments, the electrical assembly may be disposed within an orienting internal assembly configured for rotational orientation of one or more shaped charges with the housing (e.g. the orienting internal assembly may include the electrical assembly, with the bearing assembly of the electrical assembly serving as one of the at least one bearing assembly of the orienting internal assembly). In some embodiments, the electrical assembly may be configured to electrically ground the detonator of the orienting internal assembly to the housing. For example, the inner bearing ring, the outer bearing ring, and the plurality of bearings each may include an electrically conductive material; the outer bearing ring may be in electrical communication with the housing; and the at least one ground contact plate may be in electrical communication with the housing through the bearing assembly.

With more specific reference to the figures, in some exemplary embodiments (e.g. as shown in FIG. 28), the orienting internal assembly 3202 may further include at least one ground contact plate 504 configured to extend from the detonator holder 204 or detonator 202 to contact (e.g. the inner surface of) the inner bearing ring 2804, whereby electrical ground connection for the detonator 202 is through the at least one ground contact plate 504, the inner bearing ring 2804, the bearings 2808, and the outer bearing ring 2809, to the housing 104*c*. In some embodiments, the at least one ground contact plate 504 may be configured to rotate as a whole with the inner bearing ring 2804 and/or the detonator holder 204/detonator 202. For example, the at least one ground contact plate 504 may be coupled/fixed to the detonator holder 204 and/or the detonator 202 at a first end, or a generally central portion of a single ground contact plate 504 that extends from one side of the detonator holder 204 to the other, and may extend outwardly/radially from the detonator holder 204 and/or longitudinally towards the inner bearing ring 2804 of the first bearing assembly 2810. In some embodiments, the second end of the at least one ground contact plate 504 may contact the inner bearing ring 2804, for example contacting the inner surface of the inner bearing ring 2804. So for example, the at least one ground contact plate 504 may be configured to contact a ground terminal of the detonator 202 in the detonator holder 204 at the first end, and to contact the inner surface of the inner bearing ring 2804 at the second end. According to the exemplary embodiments described throughout this disclosure, the ground contact plate 504, in an aspect, may be formed as a single plate that extends outwardly in opposite directions from a generally central portion that is positioned within the detonator holder 204. Each of the outwardly extending portions extends out of the detonator holder 204 to an end that is in contact with the inner bearing ring 2804, to provide redundant grounding for the detonator 202. For brevity, the "second end" of the at least one ground contact plate 504 is not limited to any particular configuration of the ground contact plate 504 but refers generally to any end/portion of a ground contact plate 504 that is in electrical contact with a conductive component, e.g., the inner bearing ring 2804, to provide an electrical ground contact for the detonator 202.

In some embodiments, the at least one ground contact plate 504 is biased radially outward at the second end to ensure contact and engagement with the inner surface of the inner bearing ring 2804. In some embodiments, the second end of the at least one ground contact plate 504 may be rigidly attached to the inner bearing ring 2804. In some embodiments, both ends of the at least one ground contact may be coupled in place. In some embodiments, the an exterior of the detonator adapter 2818 may have one or more notches, indentations, or slots 3105 configured to allow passage of the ground contact plate 504 into the central opening 2811, between the exterior of the detonator adapter 2818 and the inner surface of the inner bearing ring 2804 of the first bearing assembly 2810, for contact with the inner surface of the inner bearing ring 2804. In some embodiments, the slots 3105 may each correspond to respective second ends of the at least one ground contact plate 504 and extend longitudinally for at least a portion of the detonator adapter 2818 within the inner bearing ring 2804. For example, the second end of the at least one ground contact plate 504 may extend through the slot 3105 to contact the inner surface of the inner bearing ring 2804.

In some embodiments, the detonator holder 204 may also have at least one gap 702 corresponding to the detonator seat 2825, for example configured to allow contact of the at least one ground contact plate 504 (e.g. the first end or generally central portion of the ground contact plate 504) with a ground terminal of a detonator 202 disposed within the detonator holder 204. For brevity, the "first end" of the at least one ground contact plate 504 is not limited to any particular configuration of the ground contact plate 504 but refers generally to any end/portion of a ground contact plate 504 that is, for example, positioned within the detonator holder 204, or otherwise configured for electrically contacting a ground terminal of the detonator 202 or a conductive component in electrical communication with the ground terminal. For example, the gap 702 may extend radially inward from the exterior of the detonator holder 204 to the detonator seat 2825 opening, and may be configured to allow the first end of the at least one ground contact plate 504 to extend inward through the detonator holder 204 to contact the detonator 202 (e.g. a ground terminal of the detonator 202). In some embodiments, the interaction of the at least one ground contact plate 504 with the gap 702 in the detonator holder 204 may fix the at least one ground contact plate 504 with respect to the detonator holder 204.

In some embodiments, the at least one ground contact plate 504 may include a plurality of ground contact plates 504, for example two ground contact plates 504. In some embodiments, the plurality of ground contact plates 504 may be symmetrically disposed about and/or located on opposite sides of the detonator holder 204/detonator 202. In some embodiments, the detonator holder 204 may have a corresponding set of slots 3105 and gaps 702 for each ground contact plate 504.

In some embodiments, the at least one shaped charge 804 (e.g. disposed in the at least one shaped charge holder 806) may be electrically isolated from the inner bearing ring 2804, the bearing assembly, and/or the at least one ground contact plate 504. For example, the stem 514 of the detonator holder and/or the shaped charge holder 806 may comprise electrically insulating materials and may be positioned to electrically isolate the shaped charge 804 from the bearing assembly and/or the at least one ground contact plate. In some embodiments, at least the stem 514 of the detonator holder may be formed of plastic (e.g. electrically insulating plastic). In some embodiments, the detonator holder as a whole may be formed of plastic (e.g. electrically insulating plastic). In some embodiments, the shaped charge holder 806 may be formed of plastic (e.g. electrically insulating plastic). In some embodiments with a charge tube, the at least one shaped charge 804 may be electrically isolated from the inner bearing ring 2804, the bearing assembly, and/or the at least one ground contact plate 504. For example, the charge tube of some embodiments may be electrically insulating (e.g. formed of plastic). In other embodiments, an insulating element (not shown) may electrically isolate each shaped charge 804 from the charge tube (which may be conductive in some embodiments). For example, the insulating element may be an insulating collar disposed between the shaped charge 804 and the charge tube in some embodiments.

While grounding of the detonator 202 may be via at least one ground contact plate or element extending from the detonator holder/detonator to an inner bearing ring of a bearing assembly, as shown for example in FIG. 28 and discussed above, in other embodiments alternate grounding configurations may be used. For example, alternative grounding configurations may include a sliding contact (such as a conductive roller contact) extending from the detonator holder/detonator to an inner surface of the housing longitudinal bore, grounding contact through the rollers to the housing (for example, via a conductive charge tube), a centralizer with a conductive roll configured for grounding, or a ground contact fixed to the gun housing and extending to the detonator holder/detonator. In some embodiments, the ground contact plate or element may be rotationally fixed to the detonator holder/detonator (e.g. so that it rotates with the detonator holder/detonator). In other embodiments, the ground contact plate or element may be rotationally fixed to the housing, and may be rotationally rotatably coupled to the detonator holder/detonator.

In some embodiments, the detonator 202 may include a line-in terminal which may be configured for wireless electrical contact, e.g., without a wired connection, with an electrical feedthrough element, for example a bulkhead including an electrical feedthrough assembly, positioned between the detonator 202 and an electrical contact of an adjacent perforating gun. In some embodiments, the detonator 202 may include one or more feedthrough terminals (e.g. which may be configured for wireless electrical contact, e.g., without a wired connection, with an electrical feedthrough contact in electrical communication with a wire/signal relay wire 816), and one or more ground terminals (e.g. which may be configured for wireless electrical contact, without a wired connection, with the one or more ground contact plates 504 and/or an electrical ground contact in electrical communication with a corresponding one of the one or more ground contact plates 504). The detonator 202 and the detonator holder 204 may be configured for, e.g., the one or more feedthrough terminals and the one or more ground terminals to make wireless electrical contact with a corresponding electrical contact when the detonator 202 is received and seated within the detonator holder 204. Some embodiments of the detonator 202 may further include a fuse, a circuit board (or other processing unit), and an initiator shell having an explosive load. For example, the line-in terminal, the feedthrough terminal, the ground terminal, and the fuse may be in electrical communication with the circuit board, which may be configured for selective firing. In some embodiments, the circuit board may be configured to determine if the electrical signal from the line-in terminal indicates firing of this particular perforating gun or another perforating gun in the string. If the electrical signal via the line-in terminal corresponds (e.g. with a digital code) to the particular perforating gun of the circuit board, the circuit board can activate the fuse. If not, then the circuit board can pass the electrical signal through to the next perforating gun in the string via the feedthrough terminal.

Some embodiments of the detonator 202 may further include a rotational orientation sensor. In some embodiments, the rotational orientation sensor may detect a rotational position, for example of the shaped charge around the longitudinal axis of the housing 104*c* to determine, for example, the firing direction of the shaped charge. For example, the rotational orientation sensor may include an inclinometer (such as a dual axis inclinometer sensor and/or a MEMS inclinometer sensor), a gyroscope, and/or an accelerometer. In some embodiments, the rotational orientation sensor may be in electrical communication with the circuit board (e.g. of the detonator). For example, the sensor may send a signal to the circuit board in response to orientation of the shaped charge meeting a predetermined threshold (e.g. such as a range of rotational positions acceptable for firing of the shaped charge). According to an aspect, information from the rotational orientation sensor and information from other sensors (e.g. location sensors, temperature sensors, inclinometers or tilt-sensors—triaxial or biaxial, GMR-sensors, etc.) in the detonator or other components of the perforating gun assembly may define the predetermined threshold for arming and/or activating the detonator to fire the shaped charge. In some embodiments, the detonator or other initiator may arm and/or activate to fire the shaped charge, responsive to the positive signal. In some embodiments, the sensor may send a negative signal to the circuit board in response to orientation of the shaped charge not meeting the predetermined threshold, for example with the detonator/initiator preventing/blocking firing responsive to the negative signal. In some embodiments, the sensor may communicate rotational information to a surface communication unit, which may allow operators at the surface to monitor the rotational position/orientation of the shaped charge. In other embodiments, the rotational orientation sensor may be located elsewhere in the orienting internal assembly 3202, but rotationally fixed to the detonator 202 and/or the at least one shaped charge holder 806. For example, the rotational orientation sensor may be located on the eccentric weight 2802 or on one of the shaped charge holders 806. The detonator holder 204 may rotationally fix the detonator 202 with respect to the inner bearing ring 2804 (and thereby with respect to the at least one shaped charge and the eccentric weight 2802). The rotational orientation sensor may be operable to determine the rotational orientation of the at least one shaped charge, for example for verifying the directional orientation of the at least one shaped charge in the wellbore. In some embodiments, the detonator 202 may be configured to rotate as a whole with the inner bearing ring 2804, the at least one shaped charge holder 806, the eccentric weight 2802, the detonator holder 204, and/or the at least one ground contact plate 504. In some embodiments, the rotational orientation sensor may be configured for wireless communication to the surface of the well.

In some embodiments, the orienting system 2814 may have a color-coded bladed centralizer (e.g. detonator adapter 2818) and shaped charge holder 806, which may again be used to indicate a gun size (e.g., 104*c*) with which they are used. In the exemplary embodiment of FIG. 28, the housing 104*c* may include a housing male end 2208 and a housing detonator end 108 with a female connection. The orienting system 2814 of FIG. 28 includes a detonator holder 204, a detonator 202, a feedthrough contact plate 502, and a ground contact plate 504, as discussed above. A bladed end connector 2820 and a second bearing assembly 2806 are positioned adjacent the housing male end 2208 in FIG. 28. A conductive end contact 1006 is positioned within a center bore 2850 of the bladed end connector 2820. In FIG. 28, a bladed centralizer (e.g. detonator adapter 2818) and a first bearing assembly 2810 are positioned adjacent the housing detonator end 108. An eccentric weight 2802 is positioned adjacent to the shaped charge holder 806 in FIG. 28.

The bladed centralizer 2818 of FIG. 28 includes a center tube 320 with a passage 506 through which the detonator holder stem 514 passes. Accordingly, the bladed centralizer 2818 serves to cover the various components, including the signal relay wire 816 and the feedthrough contact plate 502, in the same manner as a centralizer 302 as discussed above. As shown in FIG. 28, a series of centralizer blades 2816 are arranged around a circumference of the center tube 320 of the bladed centralizer 2818 and extend away from the center tube 320. Similarly, the bladed end connector 2820 includes a cylindrical structure around which centralizer blades 2816 are arranged. The portions of each of the bladed centralizer 2818 and the bladed end connector 2820 including the centralizer blades 2816 are positioned within an inner bearing ring 2804 of the bearing assemblies. For example, each bearing assembly 2806, 2810 includes bearings 2808, e.g., ball bearings, roller bearings, or the like, between the inner bearing ring 2804 and an outer bearing ring 2809. The centralizer blades 2816 engage with the inner bearing ring 2804 such that the bladed centralizer 2818 and the bladed end connector 2820 rotate along with the inner bearing ring 2804, relative to the outer bearing ring 2809.

Figure 29:
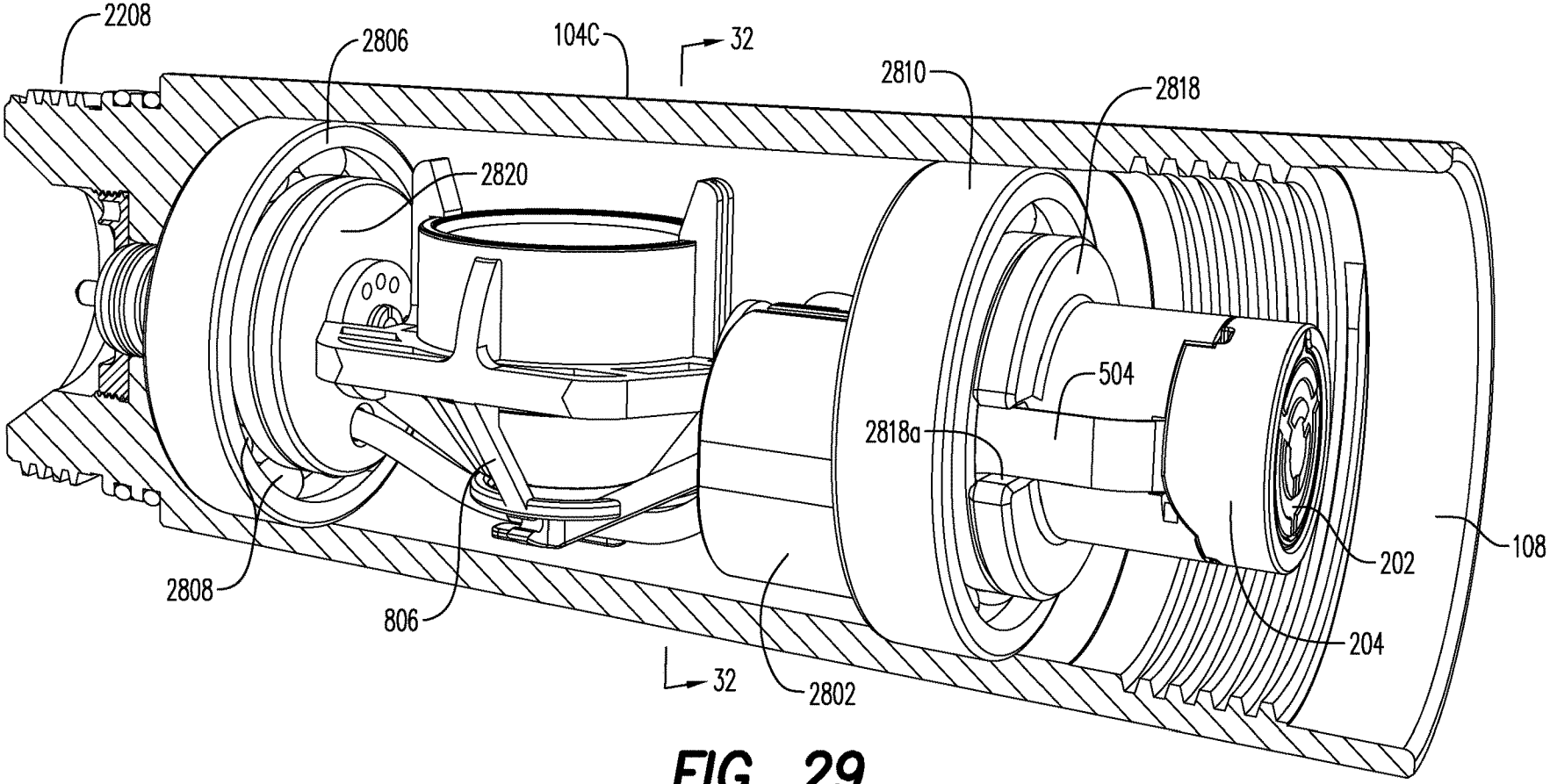
FIG. 29 is a perspective cutaway view of an exemplary embodiment of a modular platform perforating gun system according to an aspect of the disclosure.
Figure 30:
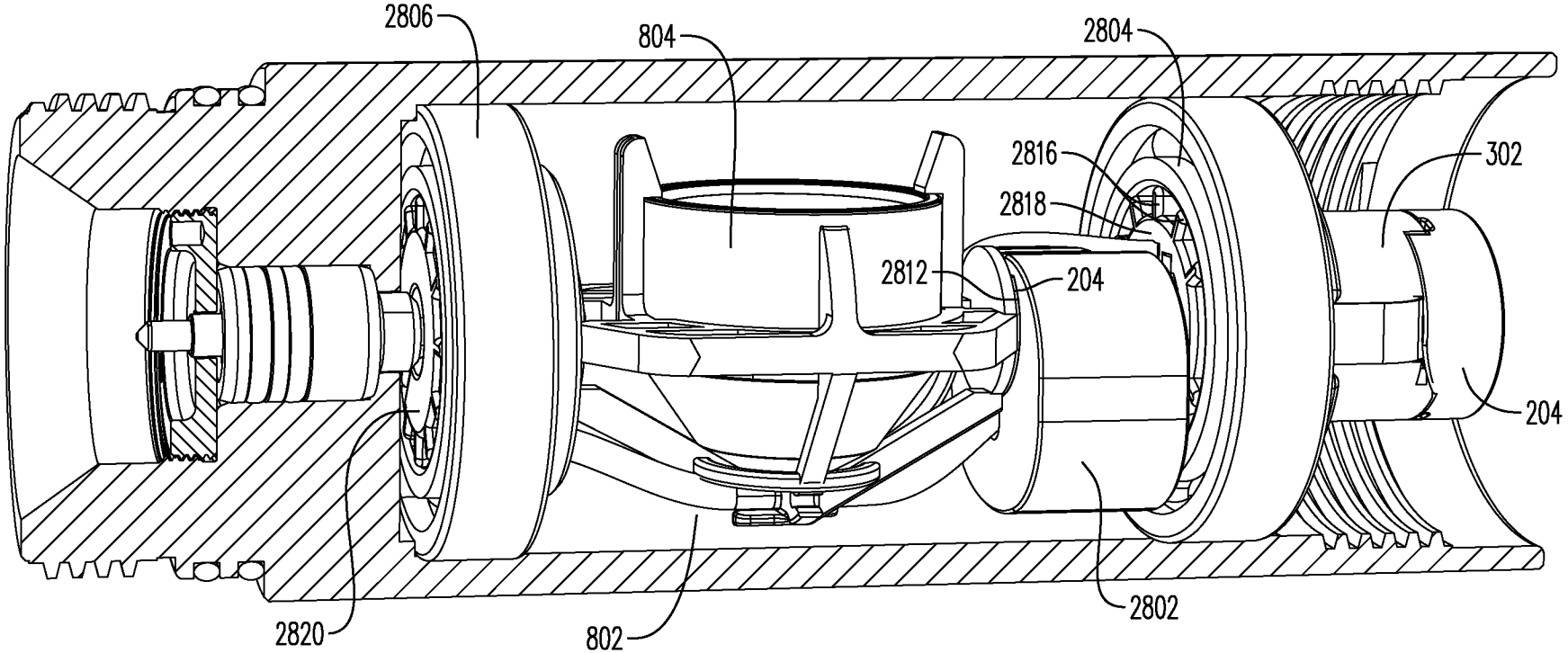
FIG. 30 is another perspective view of the exemplary embodiment of the modular platform perforating gun system shown in FIG. 29.
Figure 34:
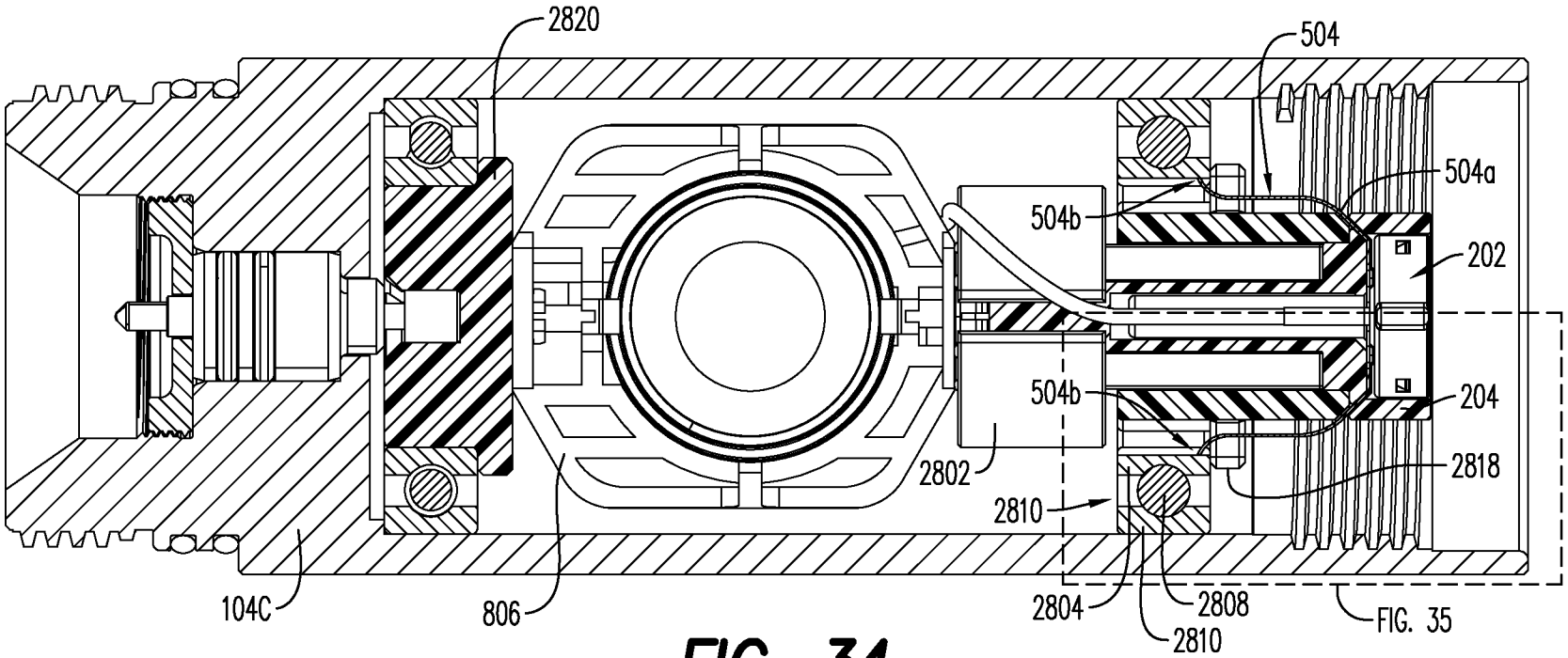
FIG. 34 is a cross-sectional view of an exemplary embodiment of a modular platform perforating gun system according to an aspect of the disclosure.

With momentary reference to FIG. 34, the ground contact plate 504 includes a central portion (not labeled) that is positioned within the detonator holder 204, according to the exemplary embodiments described throughout this disclosure. Portions of the ground contact plate 504 extend outwardly, i.e., in a direction that includes a radial component relative to the detonator holder 204, from respective first ends 504*a* positioned on opposite ends of the central portion, and longitudinally to second ends 504*b* at the inner bearing ring 2804. As shown in FIG. 28 and FIG. 29, notches 2818*a* are formed in the bladed centralizer 2818 for alignment and passage of the ground contact plate 504, e.g., each ground contact plate portion extending between a corresponding first end 504*a* and second end 504*b*. The ground contact plate 504 extends through the notches 2818*a* to permit the second ends 504*b* to reach the inner bearing ring 2804, where each second end 504*b* makes physical and electrical contact with the inner bearing ring 2804.

Figure 35:
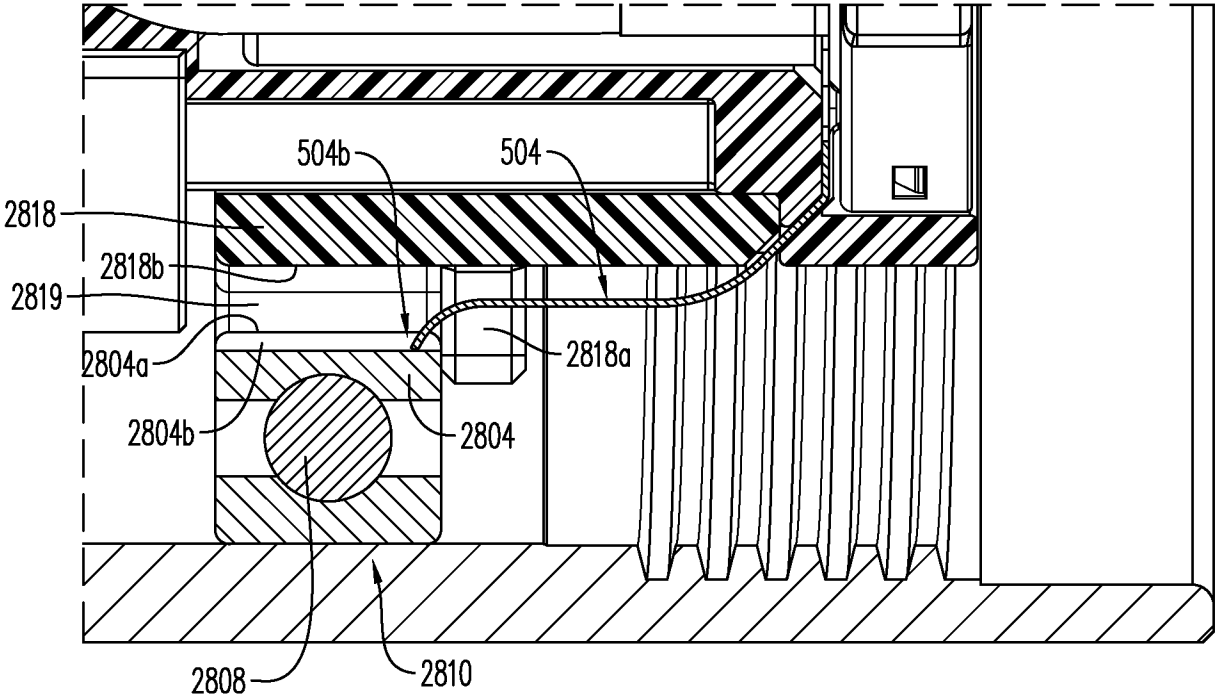
FIG. 35 is an enlarged cross-sectional view of the area bounded by broken lines in FIG. 34.

In the exemplary embodiment shown in FIGS. 34 and 35, the second ends 504*b* of the ground contact plate 504 each extend into an annular opening 2819 (FIG. 35) defined between an outer surface 2818*b* of the bladed centralizer 2818 and an inner surface 2804*a* of the inner bearing ring 2804. In the exemplary embodiment shown in FIG. 34 and FIG. 35, an axial notch 2804*b* may also be formed in the inner surface 2804*a* of the inner bearing ring 2804 for seating of a corresponding second end 504*b* of the ground contact plate 504.

The ground contact plate 504 may be biased radially outwardly at each second end 504*b* (e.g., along the portion extending from the first end 504*a* to the second end 504*b*) to maintain physical and electrical contact with the inner bearing ring 2804. The inner bearing ring 2804 is in physical and electrical contact with the bearings 2808, which are in physical and electrical contact with the outer bearing ring 2809, which is in physical and electrical contact with the housing 104*c*. Thus, the ground contact plate 504 is in electrical communication with the housing 104*c* through the inner bearing ring 2804, bearings 2808, and outer bearing ring 2809. In an aspect, two or more second ends 504*b* of the ground contact plate 504 in electrical contact with the inner bearing ring 2804 provide redundant grounding for the detonator 202; i.e., one or more additional ground connections in the event that one or more of the ground connections fail.

When assembled, the detonator holder 204 extends through both the bladed centralizer 2818 and an eccentric weight channel 2812 formed through the eccentric weight 2802, such that the detonator holder 204 may connect to the shaped charge holder 806 in the manner previously discussed. The eccentric weight channel 2812 may be keyed or geometrically configured to receive the detonator holder 204 so that when the detonator holder 204 is received in the eccentric weight channel 2812, both the eccentric weight 2802 and the detonator holder can rotate together about a common central rotational axis. Accordingly, the detonating cord 814 may extend out of the detonating cord channel 1004 of the detonator holder 204 and pass through the eccentric weight channel 2812, to reach the shaped charge holder 806. The detonating cord 814 may extend to a terminal cord retainer 902 positioned on the bladed end connector 2820. The signal relay wire 816 may pass over the eccentric weight 2802 and route through the internal gun assembly to a relay wire slot 1002 through which it passes to electrically connect to a conductive end contact 1006 in the bladed end connector 2820. The conductive end contact 1006, as in the manner discussed above, may wirelessly electrically connect to a first pin connector 1902 of a bulkhead 1804 including a bulkhead body 1806 sealingly received within a housing male end bore 3302 extending between and open to each of the housing male end 2208 and an interior of the housing 104*c*. The bulkhead body 1806 may house, without limitation, a first spring connector 1910 and a second spring connector 1912, and one or more electrically conductive components providing electrical communication between the first pin connector 1902 and a second pin connector 1906. In an aspect, the first pin connector 1902 and the second pin connector 1906 may be integrally formed with, or secured to, a continuous conductive body that extends through the bulkhead body 1806. In an aspect, one or more of the conductive end contact 1006, the detonator 202, and the line-in terminal 2504 may be biased, e.g., spring-loaded. For purposes of this disclosure, an electrical feedthrough assembly that extends through the bulkhead body 1806 may be, without limitation, an integrally formed structure or a plurality of conductive components configured for transferring an electrical signal between the pin connector ends 1902, 1906. Each pin connector 1902, 1906 may include an end point or surface at the point or surface of the pin connector 1902, 1906 furthest from the bulkhead body 1806. The end point or surface may abut and/or press against a corresponding and complementarily dimensioned electrical contact, such as a surface of the conductive end contact 1006 and/or the line-in terminal 2504.

In an aspect, the pin connectors 1902, 1906 may include pointed ends 2822, to reduce friction as the assembly, including the conductive end contact 1006 and the detonator 202, rotate while in contact with the pointed ends 2822. The bulkhead may also have a rotatable design such that a bulkhead electrical feedthrough may rotate within the bulkhead body 1806, which may also accommodate the rotating internal gun assembly 802 without interfering with the rotation. While the housing 104*c* has opposite male-female connector ends according to, e.g., exemplary embodiments as shown in FIGS. 29-31 and 33-34, the gravitationally orienting system may also be used with, without limitation, a housing having female-female connector ends and using a tandem seal adapter, as discussed above.

The bladed end connector 2820 of FIG. 28 has a complementary connecting structure as described above for, e.g., the conductive end connector 808, for connecting to the shaped charge holder 806. Accordingly, as the detonator 202 and the detonator holder 204 are connected to one inner bearing ring 2804 via the bladed centralizer (e.g. detonator adapter 2818), and the shaped charge holder 806 is connected to each inner bearing ring 2804 via the bladed centralizer 2818 and the bladed end connector 2820, the entire internal gun assembly 802, including the detonator 202, may rotate freely. The eccentric weight 2802 may be adjusted in different positions, allowing the shaped charge 804 to shoot in a desired direction, such as upwards (relative to gravity) and other directions perpendicular to the wellbore axis.

When assembled together in the housing 104*c*, the detonator holder 204, shaped charge holder 806, and eccentric weight 2802 can rotate together with the bladed centralizer 2818 and bladed end connector 2820 within the housing 104*c*. Also, when the detonator 202 is connected to the detonator holder 204, the detonator 202 also can rotate together with the detonator holder 204, shaped charge holder 806, and eccentric weight 2802 (e.g. together with the bladed centralizer 2818 and bladed end connector 2820) within the housing 104*c*. Moreover, because the ground contact plate 504 extends between the detonator holder 204 and the inner bearing ring 2804, the ground contact plate 504 also can rotate together with the detonator holder 204, shaped charge holder 806, and eccentric weight 2802 (e.g. together with the bladed centralizer 2818 and bladed end connector 2820) within the housing 104*c*. Having the ground contact plate 504 rotate with the detonator holder 204 can eliminate a need for a separate rotational element housing to provide a ground contact while the rest of the detonator assembly rotates. This may allow for shorter housings and/or provide additional space within the housing for additional elements (such as more shaped charges). It may also simplify and/or speed assembly of the perforation gun elements.

While the term detonator is used herein, it is contemplated that an initiator (including a detonator or an igniter) may be utilized. Thus, further disclosed embodiments include alternatives of specific embodiments herein in which the detonator is replaced with another initiator. Likewise, the detonator holder in such further embodiments may be a holder configured to hold a corresponding initiator, for example so that it rotates with the at least one shaped charge holder 806, charge tube, and/or inner bearing ring of a bearing assembly. While embodiments described above relate to embodiments of an orienting internal assembly which may be disposed within a housing, in some other embodiments the orienting internal assembly may be configured for use within a wellbore without the use of a housing. For example, the orienting internal assembly may be configured to attach to other elements in the perforating gun tool string without the use of a surrounding housing. In some embodiments, the orienting internal assembly may be similar to other embodiments described herein, but may be configured based on the longitudinal axis of the wellbore rather than the housing, for example.

Rather than an eccentric weight or some other gravitational means of orientation, some embodiments may have an alternate means of orienting the internal assembly. For example, a mechanical means of orientation may be used in some embodiments. Some embodiments may include one or more fin (not shown) to assist in orienting the internal assembly. By way of example, see U.S. Ser. No. 17/206,416 (filed Mar. 19, 2021), which is incorporated by reference herein to the extent that it is not incompatible and/or inconsistent with the disclosure herein. Another mechanical means of orienting the internal assembly may include a motor, such as an electric motor, configured to rotate the internal assembly, the perforating gun, or the tool string, in order to orient the shaped charges. These and other rotation and/or orienting mechanisms may be used herein, for example in place of or in conjunction with the one or more bearing assembly.

This disclosure, in various embodiments, configurations and aspects, includes components, methods, processes, systems, and/or apparatuses as depicted and described herein, including various embodiments, sub-combinations, and subsets thereof. This disclosure contemplates, in various embodiments, configurations and aspects, the actual or optional use or inclusion of, e.g., components or processes as may be well-known or understood in the art and consistent with this disclosure though not depicted and/or described herein.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Such approximating language may refer to the specific value and/or may include a range of values that may have the same impact or effect as understood by persons of ordinary skill in the art field. For example, approximating language may include a range of +/−10%, +/−5%, or +/−3%. The term "substantially" as used herein is used in the common way understood by persons of skill in the art field with regard to patents, and may in some instances function as approximating language. A value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that the appended claims should cover variations in the ranges except where this disclosure makes clear the use of a particular range in certain embodiments.

The terms "determine", "calculate" and "compute," and variations thereof, as used herein, are used interchangeably and include any type of methodology, process, mathematical operation or technique.

Reference to a "detonator holder and/or detonator" herein refers to at least one selected from a detonator holder and a detonator, and may be termed a detonation-related element for more convenient reference.

This disclosure is presented for purposes of illustration and description. This disclosure is not limited to the form or forms disclosed herein. In the Detailed Description of this disclosure, for example, various features of some exemplary embodiments are grouped together to representatively describe those and other contemplated embodiments, configurations, and aspects, to the extent that including in this disclosure a description of every potential embodiment, variant, and combination of features is not feasible. Thus, the features of the disclosed embodiments, configurations, and aspects may be combined in alternate embodiments, configurations, and aspects not expressly discussed above. For example, the features recited in the following claims lie in less than all features of a single disclosed embodiment, configuration, or aspect. Thus, the following claims are hereby incorporated into this Detailed Description, with each claim standing on its own as a separate embodiment of this disclosure.

Advances in science and technology may provide variations that are not necessarily express in the terminology of this disclosure although the claims would not necessarily exclude these variations.

What is claimed is:

1. An orienting internal assembly, comprising:
at least one shaped charge holder;
two bearing assemblies;
a detonator holder; and
an eccentric weight;
wherein the at least one shaped charge holder and the detonator holder are configured to rotate as a whole.

2. The orienting internal assembly of claim 1, wherein:
the two bearing assemblies are coaxial and spaced apart; and
the two bearing assemblies are configured to interact with the at least one shaped charge holder to allow rotation of the at least one shaped charge holder and the detonator holder as a whole about a central axis of the two bearing assemblies.

3. The orienting internal assembly of claim 2, wherein:
each of the two bearing assemblies comprises:
an outer bearing ring,
an inner bearing ring, and
a plurality of bearings disposed between the outer bearing ring and the inner bearing ring;
for each of the two bearing assemblies, the inner bearing ring and outer bearing ring are concentric and coaxial; and
for each of the two bearing rings, the bearings are configured to allow rotation of the inner bearing ring about the central axis within the outer bearing ring.

4. The orienting internal assembly of claim 3, wherein the at least one shaped charge holder is rotationally fixed to the inner bearing ring of each of the two bearing assemblies.

5. The orienting internal assembly of claim 4, wherein the detonator holder is configured to receive a detonator.

6. The orienting internal assembly of claim 5, wherein the detonator holder comprises a detonator holder stem configured to extend longitudinally along the central axis and through a central opening of the first of the two bearing assemblies.

7. The orienting internal assembly of claim 5, further comprising a detonator adapter configured to retain the detonator holder, wherein the detonator adapter is configured to rotationally fix the detonator holder to the inner bearing ring of the first of the two bearing assemblies.

8. The orienting internal assembly of claim 5, wherein the eccentric weight also rotates as a whole, along with the shaped charge holder, the detonator holder, and the inner bearing ring of a first of the two bearing assemblies.

9. The orienting internal assembly of claim 5, further comprising an end connector configured to rotationally fix the shaped charge holder to the inner bearing ring of a second of the two bearing assemblies.

10. The orienting internal assembly of claim 5, further comprising at least one ground contact plate configured to extend from the detonator holder to contact the inner bearing ring of one of the two bearing assemblies, whereby electrical ground connection for the detonator is through the at least one ground contact plate, the inner bearing ring, the ball bearings, and the outer bearing ring, to the housing.

11. The orienting internal assembly of claim 10, wherein the at least one ground contact plate is configured to rotate as a whole with the inner bearing ring and the detonator holder.

12. The orienting internal assembly of claim 3, wherein the outer bearing ring of each of the two bearing assemblies is configured to fit within and contact a longitudinal bore of a housing.

13. The orienting internal assembly of claim 3, further comprising a detonator having a rotational orientation sensor, wherein the detonator holder rotationally fixes the detonator with respect to the inner bearing ring of a first of the two bearing assemblies.

14. The orienting internal assembly of claim 2, wherein the orienting internal assembly is configured to be disposed within a longitudinal bore of a housing, and the eccentric weight has a center of gravity offset from the central axis of the two bearing assemblies.

15. The orienting internal assembly of claim 1, wherein the at least one shaped charge holder comprises a plurality of shaped charge holders, all of which are configured to be rotationally fixed with respect to one another.

16. The orienting internal assembly of claim 1, wherein the at least one shaped charge holder comprises two or more rollers configured to contact an inner surface of a housing and rotationally support the at least one shaped charge holder within the housing.

17. A perforating gun assembly comprising:

a housing having a longitudinal bore;

at least one shaped charge holder;

two bearing assemblies;

a detonator holder; and an eccentric weight;

wherein:

the at least one shaped charge holder, the detonator holder, and the eccentric weight are configured to rotate as a whole about a central axis of the two bearing assemblies; and the at least one shaped charge holder, two bearing assemblies, detonator holder, and eccentric weight are disposed within the longitudinal bore of the housing.

18. The perforating gun assembly of claim 17, wherein the two bearing assemblies are coaxial and spaced apart longitudinally; and the two bearing assemblies are configured to interact with the at least one shaped charge holder and the eccentric weight to allow rotation of the at least one shaped charge holder and the eccentric weight as a whole about the central axis of the two bearing assemblies within the housing.

19. The perforating gun assembly of claim 18, wherein:

each of the two bearing assemblies comprises a plurality of bearings disposed between an outer bearing ring and an inner bearing ring;

the inner bearing ring and outer bearing ring of each of the two bearing assemblies are concentric and coaxial; and for each of the two bearing assemblies, the bearings are configured to allow rotation of the inner bearing ring about the central axis within the outer bearing ring.

20. The perforating gun assembly of claim 19, wherein the at least one shaped charge holder, the detonator holder, and the eccentric weight are rotationally fixed to the inner bearing ring of each of the two bearing assemblies.

* * * * *